US012144401B2

(12) United States Patent
Burns et al.

(10) Patent No.: US 12,144,401 B2
(45) Date of Patent: Nov. 19, 2024

(54) INTEGRATED CLOSURE DEVICE COMPONENTS AND METHODS

(71) Applicant: BOA Technology, Inc., Denver, CO (US)

(72) Inventors: Robert E. Burns, Denver, CO (US); Randon Kruse, Denver, CO (US); Thomas Pollack, Golden, CO (US)

(73) Assignee: BOA Technology, Inc., Denver, CO (US)

( * ) Notice: Subject to any disclaimer, the term of this patent is extended or adjusted under 35 U.S.C. 154(b) by 0 days.

(21) Appl. No.: 18/501,817

(22) Filed: Nov. 3, 2023

(65) Prior Publication Data

US 2024/0138529 A1 May 2, 2024

Related U.S. Application Data

(63) Continuation of application No. 18/186,779, filed on Mar. 20, 2023, now Pat. No. 11,844,404, which is a (Continued)

(51) Int. Cl.
*A44B 11/06* (2006.01)
*A43C 7/00* (2006.01)

(Continued)

(52) U.S. Cl.
CPC ..... *A44B 11/065* (2013.01); *A43C 7/00* (2013.01); *A43C 9/00* (2013.01); *A43C 11/165* (2013.01);

(Continued)

(58) Field of Classification Search
CPC ..... A44B 11/065; A43C 7/00; A43C 9/00; A43C 11/165; A43C 11/20; Y10T 24/3724; Y10T 29/49826
See application file for complete search history.

(56) References Cited

U.S. PATENT DOCUMENTS 59,332 A 10/1866 White et al.
80,834 A 8/1868 Prussia (Continued)

FOREIGN PATENT DOCUMENTS

AT 127075 B 2/1932
AT 244804 B 1/1966

(Continued)

OTHER PUBLICATIONS

"A Technical Lightweight Double Boot for Cold Environments", La Sportiva, Available online at: http://www.sportiva.com/products/footwear/mountain/spantik, Accessed on May 27, 2015, 1 page.

(Continued)

*Primary Examiner* — David M Upchurch
(74) *Attorney, Agent, or Firm* — Kilpatrick Townsend & Stockton LLP

(57) ABSTRACT

A lace tensioning device includes a housing component having an interior region, a first aperture, and a second aperture, and a spool component that is rotatably positionable within the interior region of the housing component. The spool component has a central cylindrical member and a lumen that extends through the central cylindrical portion. The spool component is rotatable within the interior region of the housing component to align one end of the lumen with the first aperture and to align an opposite end of the lumen with the second aperture to enable a lace to be inserted through the first aperture, the lumen, and the second aperture so that opposing ends of the lace are positioned exterior to the housing component. A knot may then be tied in the lace and the lace retracted to couple the lace with the housing component and spool component.

20 Claims, 59 Drawing Sheets

Related U.S. Application Data continuation of application No. 17/450,263, filed on Oct. 7, 2021, now Pat. No. 11,633,020, which is a continuation of application No. 17/006,171, filed on Aug. 28, 2020, now Pat. No. 11,457,698, which is a continuation of application No. 16/103,761, filed on Aug. 14, 2018, now Pat. No. 10,772,388, which is a continuation of application No. 14/991,788, filed on Jan. 8, 2016, now Pat. No. 10,076,160, which is a continuation-in-part of application No. 14/297,047, filed on Jun. 5, 2014, now Pat. No. 9,770,070.

(60) Provisional application No. 62/101,283, filed on Jan. 8, 2015, provisional application No. 61/831,259, filed on Jun. 5, 2013.

(51) Int. Cl.
*A43C 9/00* (2006.01)
*A43C 11/16* (2006.01)
*A43C 11/20* (2006.01)

(52) U.S. Cl.
CPC ..... *A43C 11/20* (2013.01); *Y10T 24/3724* (2015.01); *Y10T 29/49826* (2015.01)

(56) References Cited

U.S. PATENT DOCUMENTS 117,530 A 8/1871 Foote
228,946 A 6/1880 Schulz et al.
230,759 A 8/1880 Drummond
379,113 A 3/1888 Hibberd
568,056 A 9/1896 Vail, Jr.
746,563 A 12/1903 McMahon
819,993 A 5/1906 Haws et al.
908,704 A 1/1909 Sprinkle
1,060,422 A 4/1913 Bowdish
1,062,511 A 5/1913 Short
1,083,775 A 1/1914 Thomas
1,090,438 A 3/1914 Worth et al.
1,170,472 A 2/1916 Barber
1,288,859 A 12/1918 Feller et al.
1,390,991 A 9/1921 Fotchuk
1,393,188 A 10/1921 Whiteman
1,412,486 A 4/1922 Paine
1,416,203 A 5/1922 Hobson
1,429,657 A 9/1922 Trawinski
1,466,673 A 9/1923 Solomon et al.
1,469,661 A 10/1923 Migita
1,481,903 A 1/1924 Hart
1,502,919 A 7/1924 Seib
1,530,713 A 3/1925 Clark
1,862,047 A 6/1932 Boulet et al.
1,995,243 A 3/1935 Clarke
2,088,851 A 8/1937 Gantenbein
2,109,751 A 3/1938 Matthias et al.
2,124,310 A 7/1938 Murr, Jr.
2,316,102 A 4/1943 Preston
2,539,026 A 1/1951 Mangold
2,611,940 A 9/1952 Cairns
2,673,381 A 3/1954 Dueker
2,907,086 A 10/1959 Ord
2,926,406 A 3/1960 Edwards et al.
2,991,523 A 7/1961 Conte
3,028,602 A 4/1962 Miller
3,035,319 A 5/1962 Wolff
3,106,003 A 10/1963 Herdman
3,112,545 A 12/1963 Williams
3,122,810 A 3/1964 Lawrence et al.
3,163,900 A 1/1965 Martin
D200,394 S 2/1965 Hakim
3,169,325 A 2/1965 Fesl
3,193,950 A 7/1965 Liou
3,197,155 A 7/1965 Chow
3,214,809 A 11/1965 Edwards
3,221,384 A 12/1965 Aufenacker
3,276,090 A 10/1966 Nigon
D206,146 S 11/1966 Hendershot
3,345,707 A 10/1967 Rita
D210,649 S 4/1968 Getgey
3,401,437 A 9/1968 Christophersen
3,430,303 A 3/1969 Perrin et al.
3,491,465 A 1/1970 Martin
3,545,106 A 12/1970 Martin
3,618,232 A 11/1971 Shnuriwsky
3,668,791 A 6/1972 Salzman et al.
3,678,539 A 7/1972 Graup
3,703,775 A 11/1972 Gatti
3,729,779 A 5/1973 Porth
3,738,027 A 6/1973 Schoch
3,793,749 A 2/1974 Gertsch et al.
3,808,644 A 5/1974 Schoch
3,934,346 A 1/1976 Sasaki et al.
3,975,838 A 8/1976 Martin
4,084,267 A 4/1978 Zadina
4,095,354 A 6/1978 Annovi
4,130,949 A 12/1978 Seidel
4,142,307 A 3/1979 Martin
4,227,322 A 10/1980 Annovi
4,261,081 A 4/1981 Lott
4,267,622 A 5/1981 Burnett-Johnston
4,408,403 A 10/1983 Martin
4,417,703 A 11/1983 Weinhold
4,433,456 A 2/1984 Baggio
4,433,679 A 2/1984 Mauldin et al.
4,452,405 A 6/1984 Adomeit
4,463,761 A 8/1984 Pols et al.
4,480,395 A 11/1984 Schoch
4,507,878 A 4/1985 Semouha
4,516,576 A 5/1985 Kirchner
4,551,932 A 11/1985 Schoch
4,555,830 A 12/1985 Petrini et al.
4,574,500 A 3/1986 Aldinio et al.
4,616,432 A 10/1986 Bunch et al.
4,616,524 A 10/1986 Bidoia
4,619,057 A 10/1986 Sartor et al.
4,620,378 A 11/1986 Sartor
4,631,839 A 12/1986 Bonetti et al.
4,631,840 A 12/1986 Gamm
4,633,599 A 1/1987 Morell et al.
4,644,938 A 2/1987 Yates et al.
4,653,204 A 3/1987 Morell et al.
4,654,985 A 4/1987 Chalmers
4,660,300 A 4/1987 Morell et al.
4,660,302 A 4/1987 Arieh et al.
4,680,878 A 7/1987 Pozzobon et al.
4,719,670 A 1/1988 Kurt
4,719,709 A 1/1988 Vaccari
4,719,710 A 1/1988 Pozzobon
4,722,477 A 2/1988 Floyd
4,741,115 A 5/1988 Pozzobon
4,748,726 A 6/1988 Schoch
4,760,653 A 8/1988 Baggio
4,780,969 A 11/1988 White, Jr.
4,787,124 A 11/1988 Pozzobon et al.
4,790,081 A 12/1988 Benoit et al.
4,796,829 A 1/1989 Pozzobon et al.
4,799,297 A 1/1989 Baggio et al.
4,802,291 A 2/1989 Sartor
4,811,503 A 3/1989 Iwama
4,826,098 A 5/1989 Pozzobon et al.
4,841,649 A 6/1989 Baggio et al.
4,856,207 A 8/1989 Datson
4,862,878 A 9/1989 Davison et al.
4,870,723 A 10/1989 Pozzobon et al.
4,870,761 A 10/1989 Tracy
4,884,760 A 12/1989 Baggio et al.
4,901,938 A 2/1990 Cantley et al.
4,924,605 A 5/1990 Spademan
D308,282 S 6/1990 Bergman et al.
4,937,953 A 7/1990 Walkhoff
4,961,544 A 10/1990 Bidoia
4,979,953 A 12/1990 Spence

(56) References Cited

U.S. PATENT DOCUMENTS

| | | | |
|---|---|---|---|
| 4,989,805 | A | 2/1991 | Burke |
| 5,001,817 | A | 3/1991 | De Bortoli et al. |
| 5,016,327 | A | 5/1991 | Klausner |
| 5,042,177 | A | 8/1991 | Schoch |
| 5,062,225 | A | 11/1991 | Gorza |
| 5,065,480 | A | 11/1991 | De Bortoli |
| 5,065,481 | A | 11/1991 | Walkhoff |
| 5,108,216 | A | 4/1992 | Geyer et al. |
| 5,117,567 | A | 6/1992 | Berger |
| 5,129,130 | A | 7/1992 | Lecouturier |
| 5,136,794 | A | 8/1992 | Stampacchia et al. |
| 5,152,038 | A | 10/1992 | Schoch |
| 5,157,813 | A | 10/1992 | Carroll |
| 5,158,428 | A | 10/1992 | Gessner et al. |
| 5,167,612 | A | 12/1992 | Bonutti |
| 5,177,882 | A | 1/1993 | Berger |
| 5,178,137 | A | 1/1993 | Goor et al. |
| 5,181,331 | A | 1/1993 | Berger |
| 5,184,378 | A | 2/1993 | Batra |
| D333,552 | S | 3/1993 | Berger et al. |
| 5,205,055 | A | 4/1993 | Harrell |
| 5,213,094 | A | 5/1993 | Bonutti |
| 5,233,767 | A | 8/1993 | Kramer |
| 5,249,377 | A | 10/1993 | Walkhoff |
| 5,259,094 | A | 11/1993 | Zepeda |
| 5,315,741 | A | 5/1994 | Dubberke |
| 5,319,868 | A | 6/1994 | Hallenbeck |
| 5,319,869 | A | 6/1994 | McDonald et al. |
| 5,325,613 | A | 7/1994 | Sussmann |
| 5,327,662 | A | 7/1994 | Hallenbeck |
| 5,335,401 | A | 8/1994 | Hanson |
| 5,341,583 | A | 8/1994 | Hallenbeck |
| 5,345,697 | A | 9/1994 | Quellais |
| 5,346,461 | A | 9/1994 | Heinz et al. |
| 5,355,596 | A | 10/1994 | Sussmann |
| 5,357,654 | A | 10/1994 | Hsing-Chi |
| 5,365,947 | A | 11/1994 | Bonutti |
| 5,371,957 | A | 12/1994 | Gaudio |
| 5,381,609 | A | 1/1995 | Hieblinger |
| 5,392,535 | A | 2/1995 | Van Noy et al. |
| 5,395,304 | A | 3/1995 | Tarr et al. |
| D357,576 | S | 4/1995 | Steinweis |
| 5,425,161 | A | 6/1995 | Schoch |
| 5,425,185 | A | 6/1995 | Gansler |
| 5,430,960 | A | 7/1995 | Richardson |
| 5,433,648 | A | 7/1995 | Frydman |
| 5,437,617 | A | 8/1995 | Heinz et al. |
| 5,456,268 | A | 10/1995 | Bonutti |
| 5,463,822 | A | 11/1995 | Miller |
| 5,477,593 | A | 12/1995 | Leick |
| D367,755 | S | 3/1996 | Jones |
| D367,954 | S | 3/1996 | Dion |
| 5,502,902 | A | 4/1996 | Sussmann |
| 5,511,325 | A | 4/1996 | Hieblinger |
| 5,526,585 | A | 6/1996 | Brown et al. |
| 5,535,531 | A | 7/1996 | Karabed et al. |
| 5,537,763 | A | 7/1996 | Donnadieu et al. |
| 5,557,864 | A | 9/1996 | Marks |
| 5,566,474 | A | 10/1996 | Leick et al. |
| D375,831 | S | 11/1996 | Perry |
| 5,596,820 | A | 1/1997 | Edauw et al. |
| 5,599,000 | A | 2/1997 | Bennett |
| 5,599,288 | A | 2/1997 | Shirley et al. |
| 5,600,874 | A | 2/1997 | Jungkind |
| 5,606,778 | A | 3/1997 | Jungkind |
| 5,607,448 | A | 3/1997 | Stahl et al. |
| D379,113 | S | 5/1997 | McDonald et al. |
| 5,638,588 | A | 6/1997 | Jungkind |
| 5,640,785 | A | 6/1997 | Egelja |
| 5,647,104 | A | 7/1997 | James |
| 5,651,198 | A | 7/1997 | Sussmann |
| 5,669,116 | A | 9/1997 | Jungkind |
| 5,685,830 | A | 11/1997 | Bonutti |
| 5,692,319 | A | 12/1997 | Parker et al. |
| 5,718,021 | A | 2/1998 | Tatum |
| 5,718,065 | A | 2/1998 | Locker |
| 5,720,084 | A | 2/1998 | Chen |
| 5,732,483 | A | 3/1998 | Cagliari |
| 5,732,648 | A | 3/1998 | Aragon |
| 5,736,696 | A | 4/1998 | Del Rosso |
| 5,737,854 | A | 4/1998 | Sussmann |
| 5,755,044 | A | 5/1998 | Veylupek |
| 5,756,298 | A | 5/1998 | Burczak et al. |
| 5,761,777 | A | 6/1998 | Leick |
| 5,772,146 | A | 6/1998 | Kawamoto et al. |
| 5,784,809 | A | 7/1998 | McDonald |
| 5,791,068 | A | 8/1998 | Bernier et al. |
| 5,819,378 | A | 10/1998 | Doyle |
| 5,833,640 | A | 11/1998 | Vazquez, Jr. et al. |
| 5,839,210 | A | 11/1998 | Bernier et al. |
| 5,845,371 | A | 12/1998 | Chen |
| 5,891,061 | A | 4/1999 | Kaiser |
| 5,909,946 | A | 6/1999 | Okajima |
| D413,197 | S | 8/1999 | Faye |
| 5,934,599 | A | 8/1999 | Hammerslag |
| 5,937,542 | A | 8/1999 | Bourdeau |
| 5,956,823 | A | 9/1999 | Borel |
| 5,971,946 | A | 10/1999 | Quinn et al. |
| 6,015,110 | A | 1/2000 | Lai |
| 6,032,387 | A | 3/2000 | Johnson |
| 6,038,791 | A | 3/2000 | Cornelius et al. |
| 6,052,921 | A | 4/2000 | Oreck |
| 6,070,886 | A | 6/2000 | Cornelius et al. |
| 6,070,887 | A | 6/2000 | Cornelius et al. |
| 6,083,857 | A | 7/2000 | Boettger et al. |
| 6,088,936 | A | 7/2000 | Bahl |
| 6,102,412 | A | 8/2000 | Staffaroni |
| D430,724 | S | 9/2000 | Matis et al. |
| 6,119,318 | A | 9/2000 | Maurer |
| 6,119,372 | A | 9/2000 | Okajima |
| 6,128,835 | A | 10/2000 | Ritter et al. |
| 6,128,836 | A | 10/2000 | Barret |
| 6,148,489 | A | 11/2000 | Dickie et al. |
| 6,195,914 | B1 | 3/2001 | Otis |
| 6,202,953 | B1 | 3/2001 | Hammerslag |
| 6,219,891 | B1 | 4/2001 | Maurer et al. |
| 6,240,657 | B1 | 6/2001 | Weber et al. |
| 6,256,798 | B1 | 7/2001 | Egolf et al. |
| 6,267,390 | B1 | 7/2001 | Maravetz et al. |
| 6,286,233 | B1 | 9/2001 | Gaither |
| 6,289,558 | B1 | 9/2001 | Hammerslag |
| 6,311,633 | B1 | 11/2001 | Keire |
| D456,130 | S | 4/2002 | Towns |
| 6,370,743 | B2 | 4/2002 | Choe |
| 6,401,364 | B1 | 6/2002 | Burt |
| 6,416,074 | B1 | 7/2002 | Maravetz et al. |
| 6,464,657 | B1 | 10/2002 | Castillo |
| 6,467,195 | B2 | 10/2002 | Pierre et al. |
| 6,477,793 | B1 | 11/2002 | Pruitt et al. |
| 6,502,286 | B1 | 1/2003 | Dubberke |
| 6,543,159 | B1 | 4/2003 | Carpenter et al. |
| 6,568,103 | B2 | 5/2003 | Durocher |
| 6,606,804 | B2 | 8/2003 | Kaneko et al. |
| 6,685,662 | B1 | 2/2004 | Curry et al. |
| 6,689,080 | B2 | 2/2004 | Castillo |
| 6,694,643 | B1 | 2/2004 | Hsu |
| 6,708,376 | B1 | 3/2004 | Landry |
| 6,711,787 | B2 | 3/2004 | Jungkind et al. |
| 6,735,829 | B2 | 5/2004 | Hsu |
| 6,757,991 | B2 | 7/2004 | Sussmann |
| 6,775,928 | B2 | 8/2004 | Grande et al. |
| 6,792,702 | B2 | 9/2004 | Borsoi et al. |
| 6,793,641 | B2 | 9/2004 | Freeman et al. |
| 6,796,951 | B2 | 9/2004 | Freeman et al. |
| 6,802,439 | B2 | 10/2004 | Azam et al. |
| 6,823,610 | B1 | 11/2004 | Ashley |
| 6,871,812 | B1 | 3/2005 | Chang |
| 6,877,256 | B2 | 4/2005 | Martin et al. |
| 6,899,720 | B1 | 5/2005 | McMillan |
| 6,922,917 | B2 | 8/2005 | Kerns et al. |
| 6,938,913 | B2 | 9/2005 | Elkington |
| 6,942,632 | B2 | 9/2005 | Cho |
| 6,945,543 | B2 | 9/2005 | De Bortoli et al. |
| D510,183 | S | 10/2005 | Tresser |

(56) References Cited

U.S. PATENT DOCUMENTS 6,962,571 B2 11/2005 Castillo
6,976,972 B2 12/2005 Bradshaw
6,993,859 B2 2/2006 Martin et al.
D521,226 S 5/2006 Douglas et al.
7,073,279 B2 7/2006 Min
7,076,843 B2 7/2006 Sakabayashi
7,082,701 B2 8/2006 Dalgaard et al.
7,096,559 B2 8/2006 Johnson
7,134,224 B2 11/2006 Elkington et al.
7,182,740 B1 2/2007 Castillo
7,198,610 B2 4/2007 Ingimundarson et al.
7,266,911 B2 9/2007 Holzer et al.
7,281,341 B2 10/2007 Reagan et al.
7,293,373 B2 11/2007 Reagan et al.
7,314,458 B2 1/2008 Bodenschatz
7,331,126 B2 2/2008 Johnson
7,343,701 B2 3/2008 Pare et al.
7,367,522 B2 * 5/2008 Chen ..... A43C 7/00 242/378.1
7,386,947 B2 6/2008 Martin et al.
7,392,602 B2 7/2008 Reagan et al.
7,401,423 B2 7/2008 Reagan et al.
7,402,147 B1 7/2008 Allen
7,490,458 B2 2/2009 Ford
7,516,914 B2 * 4/2009 Kovacevich ..... A43C 11/165 242/395
7,568,298 B2 8/2009 Kerns
7,582,102 B2 9/2009 Heinz et al.
7,584,528 B2 9/2009 Hu
7,591,050 B2 9/2009 Hammerslag
7,597,675 B2 10/2009 Ingimundarson et al.
7,600,660 B2 10/2009 Kasper et al.
7,617,573 B2 11/2009 Chen
7,618,386 B2 11/2009 Nordt, III et al.
7,618,389 B2 11/2009 Nordt, III et al.
7,624,517 B2 12/2009 Smith
7,648,404 B1 1/2010 Martin
7,650,705 B2 1/2010 Donnadieu et al.
7,662,122 B2 2/2010 Sterling
7,694,354 B2 4/2010 Philpott et al.
7,704,219 B2 4/2010 Nordt, III et al.
7,713,225 B2 5/2010 Ingimundarson et al.
7,752,774 B2 7/2010 Ussher
7,757,412 B2 7/2010 Farys
7,774,956 B2 8/2010 Dua et al.
7,789,844 B1 9/2010 Allen
7,794,418 B2 9/2010 Ingimundarson et al.
7,806,842 B2 10/2010 Stevenson et al.
7,819,830 B2 10/2010 Sindel et al.
D626,322 S 11/2010 Servettaz
7,841,106 B2 11/2010 Farys
7,871,334 B2 1/2011 Young et al.
7,877,845 B2 2/2011 Signori
7,878,998 B2 2/2011 Nordt, III et al.
7,887,500 B2 2/2011 Nordt, III et al.
7,896,827 B2 3/2011 Ingimundarson et al.
7,900,378 B1 3/2011 Busse
7,908,769 B2 3/2011 Pellegrini
7,922,680 B2 4/2011 Nordt, III et al.
7,935,068 B2 5/2011 Einarsson
7,947,005 B2 5/2011 Castillo
7,947,061 B1 5/2011 Reis
7,950,112 B2 5/2011 Hammerslag et al.
7,954,204 B2 6/2011 Hammerslag et al.
7,963,049 B2 6/2011 Messmer
7,992,261 B2 8/2011 Hammerslag et al.
7,993,296 B2 8/2011 Nordt, III et al.
8,016,781 B2 9/2011 Ingimundarson et al.
D646,790 S 10/2011 Castillo et al.
8,056,150 B2 11/2011 Stokes et al.
8,061,061 B1 11/2011 Rivas
8,074,379 B2 12/2011 Robinson, Jr. et al.
8,091,182 B2 1/2012 Hammerslag et al.
8,105,252 B2 1/2012 Rousso
8,109,015 B2 2/2012 Signori
8,128,587 B2 3/2012 Stevenson et al.
D663,850 S 7/2012 Joseph
D663,851 S 7/2012 Joseph
8,215,033 B2 7/2012 Carboy et al.
8,231,074 B2 7/2012 Hu et al.
8,231,560 B2 7/2012 Ingimundarson et al.
D665,088 S 8/2012 Joseph
8,235,321 B2 8/2012 Chen
8,245,371 B2 8/2012 Chen
8,257,293 B2 9/2012 Ingimundarson et al.
8,266,827 B2 9/2012 Dojan et al.
8,277,401 B2 10/2012 Hammerslag et al.
8,302,329 B2 11/2012 Hurd et al.
8,303,527 B2 11/2012 Joseph
8,308,098 B2 11/2012 Chen
8,353,087 B2 1/2013 Chen
8,353,088 B2 1/2013 Ha
8,381,362 B2 2/2013 Hammerslag et al.
D677,045 S 3/2013 Voskuil
D679,019 S 3/2013 Siddle et al.
8,434,200 B2 5/2013 Chen
8,468,657 B2 6/2013 Soderberg et al.
8,490,299 B2 7/2013 Dua et al.
8,516,662 B2 8/2013 Goodman et al.
8,578,632 B2 11/2013 Bell et al.
8,652,164 B1 2/2014 Aston
8,713,820 B2 5/2014 Kerns et al.
8,984,719 B2 3/2015 Soderberg et al.
9,072,341 B2 7/2015 Jungkind
D735,987 S 8/2015 Hsu
9,101,181 B2 8/2015 Soderberg et al.
9,125,455 B2 9/2015 Kerns et al.
9,138,030 B2 9/2015 Soderberg et al.
9,259,056 B2 2/2016 Soderberg et al.
9,770,070 B2 9/2017 Cotterman et al.
10,076,160 B2 9/2018 Burns et al.
10,123,589 B2 11/2018 Soderberg et al.
10,383,403 B2 8/2019 Modena et al.
10,602,804 B2 3/2020 Modena et al.
10,772,388 B2 9/2020 Burns et al.
10,842,230 B2 11/2020 Pollack et al.
11,457,698 B2 10/2022 Burns et al.
11,633,020 B2 4/2023 Burns et al.
11,844,404 B2 12/2023 Burns et al.
2002/0050076 A1 5/2002 Borsoi et al.
2002/0052568 A1 5/2002 Houser et al.
2002/0062579 A1 5/2002 Caeran
2002/0095750 A1 7/2002 Hammerslag
2002/0129518 A1 9/2002 Borsoi et al.
2002/0148142 A1 10/2002 Oorei et al.
2002/0166260 A1 11/2002 Borsoi
2002/0178548 A1 12/2002 Freed
2003/0041478 A1 3/2003 Liu
2003/0051374 A1 3/2003 Freed
2003/0079376 A1 5/2003 Oorei et al.
2003/0144620 A1 7/2003 Sieller et al.
2003/0150135 A1 8/2003 Liu
2003/0177662 A1 9/2003 Elkington et al.
2003/0204938 A1 11/2003 Hammerslag
2004/0041452 A1 3/2004 Williams
2004/0159017 A1 8/2004 Martin
2004/0211039 A1 10/2004 Livingston
2005/0054962 A1 3/2005 Bradshaw
2005/0060912 A1 3/2005 Holzer et al.
2005/0081339 A1 4/2005 Sakabayashi
2005/0081403 A1 4/2005 Mathieu
2005/0087115 A1 4/2005 Martin
2005/0098673 A1 5/2005 Huang
2005/0102861 A1 5/2005 Martin
2005/0126043 A1 6/2005 Reagan et al.
2005/0172463 A1 8/2005 Rolla
2005/0178872 A1 8/2005 Hyun
2005/0184186 A1 8/2005 Tsoi et al.
2005/0198866 A1 9/2005 Wiper et al.
2005/0247813 A1 11/2005 Kovacevich et al.
2005/0273025 A1 12/2005 Houser
2006/0015988 A1 1/2006 Philpott et al.
2006/0135901 A1 6/2006 Ingimundarson et al.

(56) References Cited

U.S. PATENT DOCUMENTS

2006/0156517 A1* 7/2006 Hammerslag ..... A43C 11/00 24/68 SK
2006/0179685 A1 8/2006 Borel et al.
2006/0185193 A1 8/2006 Pellegrini
2006/0287627 A1 12/2006 Johnson
2007/0006489 A1 1/2007 Case et al.
2007/0063459 A1 3/2007 Kavarsky
2007/0068040 A1 3/2007 Farys
2007/0084956 A1 4/2007 Chen
2007/0113524 A1 5/2007 Lander
2007/0128959 A1 6/2007 Cooke
2007/0169378 A1 7/2007 Sodeberg et al.
2007/0276306 A1 11/2007 Castillo
2008/0016717 A1 1/2008 Ruban
2008/0060167 A1* 3/2008 Hammerslag ..... A43C 11/165 24/714.6
2008/0060168 A1 3/2008 Hammerslag et al.
2008/0066272 A1 3/2008 Hammerslag et al.
2008/0066345 A1 3/2008 Hammerslag et al.
2008/0066346 A1 3/2008 Hammerslag et al.
2008/0068204 A1 3/2008 Carmen et al.
2008/0083135 A1 4/2008 Hammerslag et al.
2008/0092279 A1 4/2008 Chiang
2008/0172848 A1 7/2008 Chen
2008/0196224 A1 8/2008 Hu
2009/0019734 A1 1/2009 Reagan et al.
2009/0071041 A1 3/2009 Hooper
2009/0090029 A1 4/2009 Kishino
2009/0099562 A1 4/2009 Ingimudarson et al.
2009/0124948 A1 5/2009 Ingimundarson et al.
2009/0172928 A1 7/2009 Messmer et al.
2009/0184189 A1 7/2009 Soderberg et al.
2009/0272007 A1 11/2009 Beers et al.
2009/0277043 A1 11/2009 Graser et al.
2009/0287128 A1 11/2009 Ingimundarson et al.
2010/0064547 A1 3/2010 Kaplan et al.
2010/0081979 A1 4/2010 Ingimundarson et al.
2010/0094189 A1 4/2010 Ingimundarson et al.
2010/0101061 A1 4/2010 Ha
2010/0139057 A1 6/2010 Soderberg et al.
2010/0154254 A1 6/2010 Fletcher
2010/0174221 A1 7/2010 Ingimundarson et al.
2010/0175163 A1 7/2010 Litke
2010/0217169 A1 8/2010 Ingimundarson
2010/0251524 A1 10/2010 Chen
2010/0299959 A1 12/2010 Hammerslag et al.
2010/0319216 A1 12/2010 Grenzke et al.
2010/0331750 A1 12/2010 Ingimundarson
2011/0000173 A1 1/2011 Lander
2011/0004135 A1 1/2011 Kausek
2011/0030244 A1 2/2011 Motawi et al.
2011/0071647 A1 3/2011 Mahon
2011/0098618 A1 4/2011 Fleming
2011/0099843 A1 5/2011 Jung
2011/0144554 A1 6/2011 Weaver, II et al.
2011/0162236 A1 7/2011 Voskuil et al.
2011/0167543 A1 7/2011 Kovacevich et al.
2011/0178448 A1 7/2011 Einarsson
2011/0184326 A1 7/2011 Ingimundarson et al.
2011/0191992 A1 8/2011 Chen
2011/0197362 A1 8/2011 Chella et al.
2011/0218471 A1 9/2011 Ingimundarson et al.
2011/0225843 A1 9/2011 Kerns et al.
2011/0258876 A1 10/2011 Baker et al.
2011/0266384 A1* 11/2011 Goodman ..... B65H 75/4431 29/434
2011/0288461 A1 11/2011 Arnold et al.
2011/0301521 A1 12/2011 Weissenböck et al.
2011/0306911 A1 12/2011 Tran
2012/0000091 A1 1/2012 Cotterman et al.
2012/0004587 A1* 1/2012 Nickel ..... A61F 5/028 602/5
2012/0005995 A1 1/2012 Emery
2012/0010547 A1 1/2012 Hinds
2012/0023717 A1 2/2012 Chen
2012/0029404 A1 2/2012 Weaver, II et al.
2012/0047620 A1 3/2012 Ellis et al.
2012/0101417 A1 4/2012 Joseph
2012/0102783 A1 5/2012 Swigart et al.
2012/0138882 A1 6/2012 Moore et al.
2012/0157902 A1 6/2012 Castillo et al.
2012/0167290 A1 7/2012 Kovacevich et al.
2012/0174437 A1 7/2012 Heard
2012/0228419 A1* 9/2012 Chen ..... A43C 11/165 242/395
2012/0246974 A1 10/2012 Hammerslag et al.
2012/0291242 A1 11/2012 Donnadieu
2012/0310273 A1 12/2012 Thorpe
2013/0012856 A1 1/2013 Hammerslag et al.
2013/0014359 A1 1/2013 Chen
2013/0019501 A1 1/2013 Gerber
2013/0025100 A1 1/2013 Ha
2013/0091667 A1 4/2013 Zerfas et al.
2013/0091674 A1 4/2013 Chen
2013/0092780 A1 4/2013 Soderberg et al.
2013/0205622 A1 8/2013 Harald
2013/0239303 A1 9/2013 Cotterman et al.
2013/0269219 A1 10/2013 Burns et al.
2013/0277485 A1 10/2013 Soderberg et al.
2013/0340283 A1 12/2013 Bell et al.
2013/0345612 A1 12/2013 Bannister et al.
2014/0082963 A1 3/2014 Beers
2014/0094728 A1 4/2014 Soderberg et al.
2014/0117140 A1 5/2014 Goodman et al.
2014/0123440 A1 5/2014 Capra et al.
2014/0123449 A1 5/2014 Soderberg et al.
2014/0208550 A1 7/2014 Neiley
2014/0221889 A1 8/2014 Burns et al.
2014/0257156 A1 9/2014 Capra et al.
2014/0259301 A1 9/2014 Berns et al.
2014/0290016 A1 10/2014 Lovett et al.
2014/0359981 A1 12/2014 Cotterman et al.
2015/0007422 A1 1/2015 Cavanagh et al.
2015/0014463 A1 1/2015 Converse et al.
2015/0026936 A1 1/2015 Kerns et al.
2015/0033519 A1 2/2015 Hammerslag et al.
2015/0059206 A1 3/2015 Lovett et al.
2015/0076272 A1 3/2015 Trudel et al.
2015/0089779 A1 4/2015 Lawrence et al.
2015/0089835 A1 4/2015 Hammerslag et al.
2015/0101160 A1 4/2015 Soderberg et al.
2015/0150705 A1 6/2015 Capra et al.
2015/0151070 A1 6/2015 Capra et al.
2015/0190262 A1 7/2015 Capra et al.
2015/0223608 A1 8/2015 Capra et al.
2015/0237962 A1 8/2015 Soderberg et al.
2015/0335458 A1 11/2015 Romo
2015/0342302 A1 12/2015 Hahnenberger et al.
2015/0359296 A1 12/2015 Gulla
2016/0120267 A1 5/2016 Burns et al.
2017/0105489 A1 4/2017 Lovett
2017/0202297 A1 7/2017 Parisotto
2017/0202316 A1 7/2017 Lovett et al.
2017/0208892 A1 7/2017 Neiley
2017/0303643 A1 10/2017 Converse et al.
2017/0325548 A1 11/2017 Ha
2018/0035759 A1 2/2018 Pollack et al.
2018/0255878 A1 9/2018 Harris
2018/0257276 A1 9/2018 Hipwood et al.
2019/0008236 A1 1/2019 Ha et al.
2020/0085144 A1 3/2020 Chiou et al.
2020/0245711 A1 8/2020 Trudel et al.
2021/0186159 A1 6/2021 Hu
2022/0022607 A1 1/2022 Burns et al.

FOREIGN PATENT DOCUMENTS

AT 517092 B1 11/2016
AT 517582 B1 3/2017
CA 2112789 A 3/1938
CA 2113149 A1 7/1994
CA 2112789 A1 8/1994
CA 2114387 A1 8/1994
CH 41765 A 11/1908

(56) References Cited

FOREIGN PATENT DOCUMENTS

| | | | |
|---|---|---|---|
| CH | 111341 | A | 11/1925 |
| CH | 199766 | A | 9/1938 |
| CH | 204834 | A | 5/1939 |
| CH | 471553 | A | 4/1969 |
| CH | 537164 | A | 5/1973 |
| CH | 562015 | A5 | 5/1975 |
| CH | 577282 | A5 | 7/1976 |
| CH | 612076 | A5 | 7/1979 |
| CH | 624001 | A5 | 7/1981 |
| CN | 2613167 | Y | 4/2004 |
| CN | 201015448 | Y | 2/2008 |
| DE | 555211 | C | 7/1932 |
| DE | 641976 | C | 2/1937 |
| DE | 1661668 | U | 8/1953 |
| DE | 7045778 | U | 3/1971 |
| DE | 1785220 | A1 | 5/1971 |
| DE | 2062795 | A1 | 6/1972 |
| DE | 7047038 | U | 1/1974 |
| DE | 2341658 | A1 | 3/1974 |
| DE | 241 4439 | A1 | 10/1975 |
| DE | 2900077 | A1 | 7/1980 |
| DE | 2914280 | A1 | 10/1980 |
| DE | 3101952 | A1 | 9/1982 |
| DE | 8101488 | U1 | 7/1984 |
| DE | 3813470 | A1 | 11/1989 |
| DE | 9005496 | U1 | 10/1991 |
| DE | 4302401 | A1 | 8/1994 |
| DE | 4305671 | A1 | 9/1994 |
| DE | 9308037 | U1 | 10/1994 |
| DE | 9413147 | U1 | 10/1994 |
| DE | 3822113 | C2 | 2/1995 |
| DE | 4326049 | A1 | 2/1995 |
| DE | 9315776 | U1 | 2/1995 |
| DE | 29503552 | U1 | 4/1995 |
| DE | 19624553 | A1 | 1/1998 |
| DE | 19945045 | A1 | 3/2001 |
| DE | 20116755 | U1 | 1/2002 |
| DE | 202010000354 | U1 | 6/2010 |
| DE | 112013005273 | T5 | 9/2015 |
| EP | 0056953 | A2 | 8/1982 |
| EP | 0099504 | A1 | 2/1984 |
| EP | 0123050 | | 10/1984 |
| EP | 0123050 | A1 | 10/1984 |
| EP | 0155596 | A1 | 9/1985 |
| EP | 0201051 | A1 | 11/1986 |
| EP | 0255869 | A2 | 2/1988 |
| EP | 0297342 | A2 | 1/1989 |
| EP | 0393380 | A1 | 10/1990 |
| EP | 0589232 | A1 | 3/1994 |
| EP | 0589233 | A1 | 3/1994 |
| EP | 0614624 | A1 | 9/1994 |
| EP | 0614625 | A1 | 9/1994 |
| EP | 0651954 | A1 | 5/1995 |
| EP | 0679346 | A1 | 11/1995 |
| EP | 0693260 | A2 | 1/1996 |
| EP | 0734662 | A1 | 10/1996 |
| EP | 0848917 | A1 | 6/1998 |
| EP | 0923965 | A1 | 6/1999 |
| EP | 0937467 | A1 | 8/1999 |
| EP | 1163860 | A1 | 12/2001 |
| EP | 1219195 | A1 | 7/2002 |
| EP | 1236412 | A1 | 9/2002 |
| EP | 2052636 | A1 | 4/2009 |
| EP | 2298107 | B1 | 3/2011 |
| EP | 2359708 | A1 | 8/2011 |
| EP | 2881005 | A1 | 6/2015 |
| EP | 3003087 | | 4/2016 |
| EP | 3192386 | A1 | 7/2017 |
| EP | 3266327 | A1 | 1/2018 |
| EP | 3725175 | A1 | 10/2020 |
| EP | 3847919 | A1 | 7/2021 |
| FR | 1349832 | A | 1/1964 |
| FR | 1374110 | A | 10/1964 |
| FR | 1404799 | A | 7/1965 |
| FR | 2019991 | A1 | 7/1970 |
| FR | 2108428 | A5 | 5/1972 |
| FR | 2173451 | A5 | 10/1973 |
| FR | 2175684 | A1 | 10/1973 |
| FR | 2399811 | A1 | 9/1979 |
| FR | 2565795 | A1 | 12/1985 |
| FR | 2598292 | A1 | 11/1987 |
| FR | 2726440 | A1 | 5/1996 |
| FR | 2770379 | A1 | 5/1999 |
| FR | 2814919 | A1 | 4/2002 |
| GB | 189911673 | A | 7/1899 |
| GB | 216400 | A | 5/1924 |
| GB | 2449722 | A | 12/2008 |
| IT | 1220811 | B | 6/1990 |
| IT | 20110013 | A1 | 8/2012 |
| JP | 89202 | | 6/1933 |
| JP | 512776 | Y1 | 1/1976 |
| JP | 51121375 | U | 10/1976 |
| JP | 51131978 | U | 10/1976 |
| JP | 53124987 | U | 10/1978 |
| JP | 54108125 | U | 7/1979 |
| JP | 02236025 | A | 9/1990 |
| JP | 03155801 | A | 7/1991 |
| JP | 06237802 | A | 8/1994 |
| JP | 07208 | A | 6/1995 |
| JP | 6-284906 | | 2/1996 |
| JP | 3030988 | U | 11/1996 |
| JP | 08308608 | A | 11/1996 |
| JP | 3031760 | U | 12/1996 |
| JP | 10199366 | A | 7/1998 |
| JP | 3160564 | B2 | 4/2001 |
| JP | 2003231391 | A | 8/2003 |
| JP | 2004016732 | A | 1/2004 |
| JP | 2004041666 | A | 2/2004 |
| JP | 2009504210 | A | 2/2009 |
| JP | 4928618 | B2 | 2/2012 |
| JP | 6257346 | B2 | 12/2017 |
| JP | 6380736 | B2 | 8/2018 |
| KR | 200367882 | Y1 | 11/2004 |
| KR | 200400568 | Y1 | 11/2005 |
| KR | 100598627 | B1 | 7/2006 |
| KR | 100953398 | B1 | 4/2010 |
| KR | 100986674 | B1 | 10/2010 |
| KR | 101025134 | B1 | 3/2011 |
| KR | 101028468 | B1 | 4/2011 |
| KR | 101053551 | B1 | 7/2011 |
| KR | 20130040141 | A | 4/2013 |
| KR | 20150105341 | A | 9/2015 |
| KR | 101875716 | B1 | 7/2018 |
| KR | 20200144161 | A | 12/2020 |
| WO | 9427456 | A1 | 12/1994 |
| WO | 9503720 | A2 | 2/1995 |
| WO | 9511602 | A1 | 5/1995 |
| WO | 9833408 | A1 | 8/1998 |
| WO | 9837782 | A1 | 9/1998 |
| WO | 9909850 | A1 | 3/1999 |
| WO | 9915043 | A1 | 4/1999 |
| WO | 9943231 | A1 | 9/1999 |
| WO | 0053045 | A1 | 9/2000 |
| WO | 0076337 | A1 | 12/2000 |
| WO | 0108525 | A1 | 2/2001 |
| WO | 0115559 | A1 | 3/2001 |
| WO | 02051511 | A1 | 7/2002 |
| WO | 2004093569 | A1 | 11/2004 |
| WO | 2005013748 | A1 | 2/2005 |
| WO | 2005108260 | A1 | 11/2005 |
| WO | 2007016983 | A1 | 2/2007 |
| WO | 2008015214 | A1 | 2/2008 |
| WO | 2008033963 | A2 | 3/2008 |
| WO | 2009134858 | A1 | 11/2009 |
| WO | 2010059989 | A2 | 5/2010 |
| WO | 2011137405 | A2 | 11/2011 |
| WO | 2012165803 | A2 | 12/2012 |
| WO | 2014093913 | A1 | 6/2014 |
| WO | 2014197721 | A2 | 12/2014 |
| WO | 2014197721 | A3 | 2/2015 |
| WO | 2015035885 | A1 | 3/2015 |
| WO | 2015179332 | A1 | 11/2015 |

(56) References Cited

FOREIGN PATENT DOCUMENTS

| | | | |
|---|---|---|---|
| WO | 2015181928 | A1 | 12/2015 |
| WO | 2019075799 | A1 | 4/2019 |
| WO | 2020160421 | A1 | 8/2020 |

OTHER PUBLICATIONS

"Boot Brochure Catalog upon Information and Belief Date", ASOLO®, Aug. 22, 1997, 12 pages.
"Save Tourniquet", Available online at: http://www.savetourniquet.com/, Accessed from Internet on Dec. 11, 2015, 3 pages.
"Shore Durometer", Wikipedia, The Free Encyclopedia, XP002747470, Available online at: https://en.wikipedia.org/w/index.php?title=Shore_durometer&oldid=481128180, Mar. 10, 2012, pp. 1-6.
"Strength of Materials Used to Make My Safety Harnesses", Elaine, Inc., Available Online at: https://web.archive.org/web/20120709002720/http://www.childharness.ca/strength_data.html, Accessed from Internet on Mar. 17, 2014, 2 pages.
"Strength of Materials Used to Make My Safety Harnesses", Elaine, Inc., Available Online at https://web.archive.org/web/20120709002720/http://www.childharness.ca/strength_data.html, Jul. 9, 2012, 3 pages.
U.S. Appl. No. 09/956,601 , "U.S. Patent Application No.", Footwear Lacing System, Sep. 18, 2001, 62 pages.
U.S. Appl. No. 14/297,047 , Advisory Action, Mailed On Feb. 13, 2017, 3 pages.
U.S. Appl. No. 14/297,047 , Final Office Action, Mailed On Nov. 29, 2016, 7 pages.
U.S. Appl. No. 14/297,047 , Non-Final Office Action, Mailed On May 19, 2016, 9 pages.
U.S. Appl. No. 14/297,047 , "Notice Of Allowance", Mar. 10, 2017, 10 pages.
U.S. Appl. No. 14/297,047 , "Restriction Requirement", Dec. 30, 2015, 7 pages.
U.S. Appl. No. 14/991,788 , Advisory Action, Mailed On Aug. 15, 2017, 3 pages.
U.S. Appl. No. 14/991,788 , Final Office Action, Mailed On Jun. 2, 2017, 9 pages.
U.S. Appl. No. 14/991,788 , Non-Final Office Action, Mailed On Sep. 20, 2017, 8 pages.
U.S. Appl. No. 14/991,788 , Non-Final Office Action, Mailed On Nov. 17, 2016, 9 pages.
U.S. Appl. No. 14/991,788 , Notice of Allowance, Mailed On May 15, 2018, 11 pages.
U.S. Appl. No. 14/991,788 , "Restriction Requirement", Aug. 11, 2016, 10 pages.
U.S. Appl. No. 16/103,761 , Notice of Allowance, Mailed On May 18, 2020, 8 pages.
U.S. Appl. No. 16/778,830 , Final Office Action, Mailed On Aug. 15, 2022, 10 pages.
U.S. Appl. No. 16/778,830 , Final Office Action, Mailed On Sep. 12, 2023, 11 pages.
U.S. Appl. No. 16/778,830 , Non-Final Office Action, Mailed On Feb. 28, 2023, 10 pages.
U.S. Appl. No. 16/778,830 , Non-Final Office Action, Mailed On Dec. 24, 2021, 9 pages.
U.S. Appl. No. 17/006,171 , Notice of Allowance, Mailed On Feb. 16, 2022, 8 pages.
U.S. Appl. No. 17/006,171 , Notice of Allowance, Mailed On May 25, 2022, 8 pages.
U.S. Appl. No. 17/450,263 , "Corrected Notice of Allowability", Mar. 9, 2023, 5 pages.
U.S. Appl. No. 17/450,263 , Non-Final Office Action, Mailed On Oct. 5, 2022, 7 pages.
U.S. Appl. No. 17/450,263 , Notice of Allowance, Mailed On Feb. 21, 2023, 8 pages.
U.S. Appl. No. 18/186,779 , Notice of Allowance, Mailed On Aug. 7, 2023, 8 pages.
Application No. DE402015100191.2 , Office Action, Mailed On Oct. 6, 2015, 2 pages.
Application No. DE402015100191.2 , Office Action, Mailed On Oct. 8, 2015, 2 pages.
Application No. EP13761841.9 , Extended European Search Report, Mailed On Nov. 4, 2015, 8 pages.
Application No. EP14168875.4 , Extended European Search Report, Mailed On Oct. 29, 2014, 9 pages.
Application No. EP14806796 , Extended European Search Report, Mailed On Apr. 19, 2017, 9 pages.
Application No. EP14806796.0 , Extended European Search Report, Mailed On Apr. 26, 2017, 9 pages.
Application No. EP14806796.0 , Notice of Decision to Grant, Mailed On Jun. 5, 2020, 2 pages.
Application No. EP14806796.0 , Office Action, Mailed On Oct. 15, 2018, 6 pages.
Application No. EP20178006.1 , Extended European Search Report, Mailed On Dec. 15, 2020, 7 pages.
EP20178006.1 , "Intention to Grant", Jan. 31, 2024, 9 pages.
EP20178006.1 , "Intention to Grant", Mar. 13, 2023, 9 pages.
Application No. EP20178006.1 , Office Action, Mailed On Aug. 3, 2023, 4 pages.
Application No. EP20178006.1 , Office Action, Mailed On Sep. 24, 2021, 5 pages.
Application No. EP20749190.3 , Extended European Search Report, Mailed On Sep. 7, 2022, 7 pages.
Application No. JP2014-015570 , Office Action, Mailed On Feb. 26, 2015, 4 pages.
JP2014-015570 , "Receipt of Certificate of Design Registration No. 1529678", Jun. 26, 2015, 1 page.
Application No. JP2015-004923 , Office Action, Mailed On Oct. 5, 2015, 4 pages.
Application No. JP2016-518004 , Notice of Decision to Grant, Mailed On Sep. 11, 2020, 2 pages.
Application No. JP2016-518004 , Office Action, Mailed On Oct. 1, 2019, 26 pages.
Application No. JP2016-518004 , Office Action, Mailed On Jul. 6, 2018, 8 pages.
Application No. JP2016-518004 , Office Action, Mailed On Jan. 27, 2017, 9 pages.
Application No. JP2016-518004 , Office Action, Mailed On Oct. 2, 2017, 9 pages.
Application No. JP2018-209172 , Notice of Allowance, Mailed On Aug. 14, 2020, 3 pages.
Application No. JP2018-209172 , Office Action, Mailed On Jan. 14, 2020, 9 pages.
Application No. JP2020-154179 , Notice of Allowance, Mailed On Jan. 4, 2022, 3 pages.
Application No. JP2020-154179 , Office Action, Mailed On Sep. 3, 2021, 4 pages.
Application No. JP2022-015275 , Notice of Allowance, Mailed On Oct. 20, 2023, 3 pages.
Application No. JP2022-015275 , Office Action, Mailed On Jan. 30, 2023, 14 pages.
Application No. KR10-2015-7037205 , Notice of Decision to Grant, Mailed On Apr. 6, 2018,.
Application No. KR10-2015-7037205 , Office Action, Mailed On Jun. 6, 2017, 16 pages.
Application No. KR10-2018-7018789 , Notice of Decision to Grant, Mailed On Sep. 24, 2020, 1 page.
Application No. KR10-2018-7018789 , Office Action, Mailed On Mar. 26, 2020, 4 pages.
Application No. KR10-2018-7018789 , Office Action, Mailed On Jul. 9, 2019, 5 pages.
Application No. KR10-2020-7036659 , Notice of Decision to Grant, Mailed On Jan. 18, 2023, 5 pages.
Application No. KR10-2020-7036659 , Office Action, Mailed On Apr. 14, 2021, 6 pages.
Application No. KR10-2020-7036659 , Office Action, Mailed On Mar. 28, 2022, 7 pages.
Application No. KR10-2023-7013121 , Office Action, Mailed On Sep. 19, 2023, 7 pages.
Application No. KR30-2014-0034959 , Office Action, Mailed On Jul. 14, 2015, 6 pages.

(56) References Cited

OTHER PUBLICATIONS

Application No. KR30-2014-0034959 , Office Action, Mailed On Mar. 20, 2015, 6 pages.
Application No. KR30-2014-34959 , Office Action, Mailed On Apr. 7, 2015, 5 pages.
Application No. KR30-2014-34959 , Office Action, Mailed On Aug. 7, 2015, 5 pages.
KR30-2015-11475 , "Certificate of Design Registration No. 30-809409", Aug. 3, 2015, 2 pages.
KR30-2015-11476 , "Certificate of Design Registration No. 30-809410", Aug. 3, 2015, 2 pages.
Application No. PCT/US2013/032326 , International Preliminary Report on Patentability, Mailed On Sep. 25, 2014, 6 pages.
Application No. PCT/US2013/032326 , International Search Report & Written Opinion, Mailed On Jun. 14, 2013, 8 pages.
Application No. PCT/US2013/057637 , International Preliminary Report on Patentability, Mailed On Mar. 3, 2015, 8 pages.
Application No. PCT/US2013/057637 , International Preliminary Report on Patentability, Mailed On Mar. 12, 2015, 9 pages.
Application No. PCT/US2013/057637 , International Search Report and Written Opinion, Mailed On Apr. 7, 2014, 13 pages.
Application No. PCT/US2013/068342 , International Preliminary Report on Patentability, Mailed On May 14, 2015, 10 pages.
Application No. PCT/US2013/068342 , International Search Report and Written Opinion, Mailed On Apr. 7, 2014, 10 pages.
Application No. PCT/US2013/068814 , International Preliminary Report on Patentability, Mailed On May 21, 2015, 11 pages.
Application No. PCT/US2013/068814 , International Search Report and Written Opinion, Mailed On Jun. 9, 2014, 13 pages.
Application No. PCT/US2014/013458 , International Preliminary Report on Patentability, Mailed On Aug. 6, 2015, 7 pages.
Application No. PCT/US2014/013458 , International Search Report and Written Opinion, Mailed On May 19, 2014, 7 pages.
Application No. PCT/US2014/014952 , International Preliminary Report on Patentability, Mailed On Aug. 11, 2015, 8 pages.
Application No. PCT/US2014/014952 , International Preliminary Report on Patentability, Mailed On Aug. 20, 2015, 9 pages.
Application No. PCT/US2014/014952 , International Search Report and Written Opinion, Mailed On Apr. 25, 2014, 17 pages.
Application No. PCT/US2014/020894 , International Preliminary Report on Patentability, Mailed On Jun. 20, 2014, 7 pages.
Application No. PCT/US2014/020894 , International Preliminary Report on Patentability, Mailed On Sep. 17, 2015, 8 pages.
Application No. PCT/US2014/020894 , International Search Report and Written Opinion, Mailed On Jun. 20, 2014, 12 pages.
Application No. PCT/US2014/032574 , International Preliminary Report on Patentability, Mailed On Oct. 15, 2015, 12 pages.
Application No. PCT/US2014/032574 , International Search Report and Written Opinion, Mailed On Oct. 31, 2014, 16 pages.
Application No. PCT/US2014/041144 , International Preliminary Report on Patentability, Mailed On Dec. 17, 2015, 10 pages.
Application No. PCT/US2014/041144 , International Search Report and Written Opinion, Mailed On Dec. 10, 2014, 13 pages.
Application No. PCT/US2014/045291 , International Search Report and Written Opinion, Mailed On Nov. 6, 2014, 6 pages.
Application No. PCT/US2014/046238 , International Search Report and Written Opinion, Mailed On Nov. 21, 2014, 17 pages.
Application No. PCT/US2014/054420 , International Search Report and Written Opinion, Mailed On Jul. 6, 2015, 21 pages.
Application No. PCT/US2014/055710 , International Search Report and Written Opinion, Mailed On Jul. 6, 2015, 18 pages.
Application No. PCT/US2014/066212 , International Search Report and Written Opinion, Mailed On Apr. 22, 2015, 16 pages.
Application No. PCT/US2020/016130 , International Preliminary Report on Patentability, Mailed On Aug. 12, 2021, 10 pages.
Application No. PCT/US2020/016130 , International Search Report and Written Opinion, Mailed On Apr. 14, 2020, 11 pages.
Application No. PCT/US2020/031022 , International Search Report and Written Opinion, Mailed On Aug. 24, 2020, 21 pages.
Application No. PCT/US2021/061861 , International Preliminary Report on Patentability, Mailed On Jun. 15, 2023, 9 pages.
Application No. PCT/US2021/061861 , International Search Report and Written Opinion, Mailed On Apr. 1, 2022, 12 pages.
PCT/US2021/061861 , "Invitation to Pay Additional Fees and, Where Applicable, Protest Fee", Feb. 2, 2022, 2 pages.
Application No. PCT/US2022/054364 , International Search Report and Written Opinion, Mailed On May 9, 2023, 14 pages.
PCT/US2023/021740 , "Invitation to Pay Additional Fees and, Where Applicable, Protest Fee", Aug. 14, 2023, 4 pages.
PD2003A000197 , "Italian Application No.", Apr. 9, 2003, 20 pages.
PD2003A000198 , "Italian Application No.", Mar. 5, 2005, 15 pages.

* cited by examiner

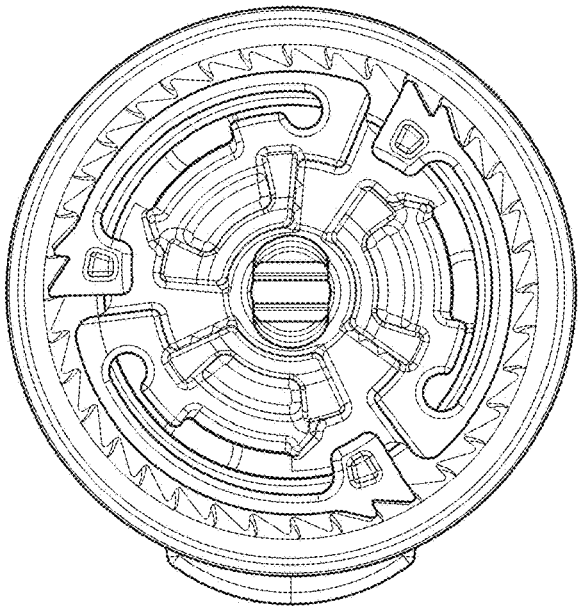
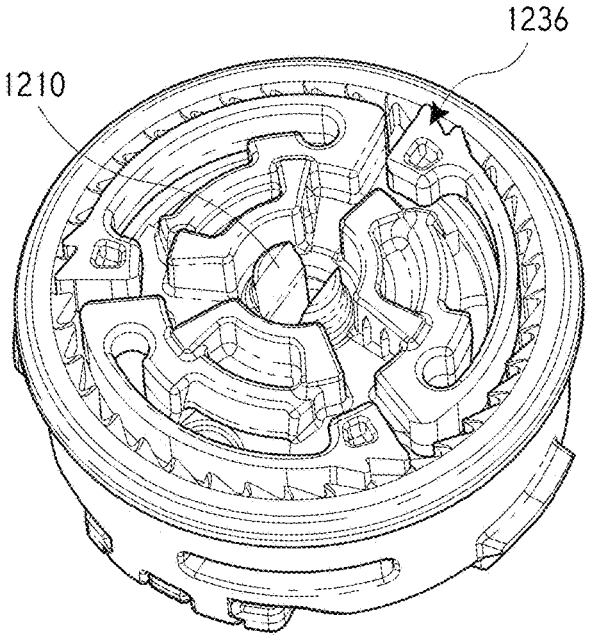
FIG. 12N

INTEGRATED CLOSURE DEVICE COMPONENTS AND METHODS

CROSS-REFERENCES TO RELATED APPLICATIONS

This application is a continuation of U.S. patent application Ser. No. 18/186,779 by Burns et al., entitled "INTEGRATED CLOSURE DEVICE COMPONENTS AND METHODS," filed Mar. 20, 2023, which is a continuation of U.S. application Ser. No. 17/450,263 by Burns et al., entitled "INTEGRATED CLOSURE DEVICE COMPONENTS AND METHODS," filed Oct. 7, 2021, now issued U.S. Pat. No. 11,633,020, which is a continuation of U.S. application Ser. No. 17/006,171 by Burns et al., entitled "INTEGRATED CLOSURE DEVICE COMPONENTS AND METHODS," filed Aug. 28, 2020, now issued U.S. Pat. No. 11,457,698, which is a continuation of U.S. patent application Ser. No. 16/103,761 by Burns et al., entitled "INTEGRATED CLOSURE DEVICE COMPONENTS AND METHODS," filed Aug. 14, 2018, now issued U.S. Issued U.S. Pat. No. 10,772,388, which is a continuation of U.S. patent application Ser. No. 14/991,788 by Burns et al., entitled "INTEGRATED CLOSURE DEVICE COMPONENTS AND METHODS," filed Jan. 8, 2016, now issued U.S. Pat. No. 10,076,160, which is a continuation-in-part of U.S. patent application Ser. No. 14/297,047 by Cotterman et al., entitled "INTEGRATED CLOSURE DEVICE COMPONENTS AND METHODS," filed Jun. 5, 2014, now issued U.S. Pat. No. 9,770,070, which claims priority to U.S. Patent Application No. 61/831,259 by Cotterman et al., entitled "INTEGRATED CLOSURE DEVICE COMPONENTS AND METHODS," filed Jun. 5, 2013. U.S. patent application Ser. No. 14/991,788 also claims priority to U.S. Patent Application No. 62/101,283 by Burns et al., entitled "CLOSURE SYSTEM COMPONENTS FOR ENABLING EASY ATTACHMENT OF LACE," filed Jan. 8, 2015. The entire disclosure of all above reference applications are hereby incorporated by reference, for all purposes, as if fully set forth herein.

BACKGROUND OF THE INVENTION

The present invention is related to closure devices for various articles, such as braces, medical devices, shoes, clothing, apparel, and the like. Such articles typically include closure devices that allow the article to be placed and closed about a body part. The closure devices are typically used to maintain or secure the article to the body part. For example, shoes are typically placed over an individual's foot and lace is tensioned and tied to close the shoe about the foot and secure the shoe to the foot. Conventional closure devices have been modified in an effort to increase the fit and/or comfort of the article about the body part. For example, shoe lacing configurations and/or patterns have been modified in an attempt to increase the fit and/or comfort of wearing shoes. Conventional closure devices have also been modified in an effort to decrease the time in which an article may be closed and secured about the body part. These modifications have resulted in the use of various pull cords, straps, and tensioning devices that enable the article to be quickly closed and secured to the foot.

BRIEF SUMMARY OF THE INVENTION

The embodiments described herein provide closure systems having a reduced overall part and/or component count.

The closure systems may be used to close and/or tighten a variety of articles, such as shoes, braces, apparel, sporting equipment, and the like. The reduced part or component count reduces the overall cost of the system and/or enable simple assembly of the system. According to one aspect, a reel assembly for tightening an article is provided. The reel assembly includes a housing component that includes an interior region. A spool component is rotatably positioned within the interior region of the housing component. The spool includes an annular channel around which a tension member is gathered to tighten the article. A drive component is positioned axially above the spool component and operably coupled therewith. The drive component allows the spool component to rotate in a first direction within the housing component's interior region while preventing rotation of the spool component in a second direction.

A tightening component is rotatably coupled within the housing and positioned axially above the drive component and coupled therewith. Operation of the tightening component causes the spool component to rotate within the housing component's interior region in the first direction to gather the tension member around the spool component's annular channel and thereby tighten the article. An attachment component is positioned axially below the spool component. The attachment component includes a coupling member that protrudes axially upward into the interior region of the housing component to couple the attachment component with the drive component. The reel assembly includes no more than six separate components. In some embodiments, the reel assembly includes no more than five separate components. One or more of the reel assembly's components may assemble by snapping together so that the reel assembly is free of a screw, rivet, or other rigid fastener.

In some embodiments, the tightening component includes a main body and a grip body that is positioned on a circumferential edge of the main body. The grip body has a coefficient of friction that is greater than the main body to enable a user to easily grip and operate the tightening component. In some embodiments, the tightening component is axially moveable relative to the housing component to disengage the drive component and spool component and thereby allow the spool component to rotate in the second direction and thereby loosen the article. In some embodiments, the reel assembly may also include a mounting component that is couplable with the article and releasably couplable with the reel assembly. The mounting component may include a mounting feature that is configured for releasably coupling with the reel assembly and an attachment feature that is configured for coupling with the article. The mounting feature may be made of a first material and the attachment feature may be made of a second material that is softer than the first material.

In some embodiments, the drive component includes teeth that engage with corresponding teeth of the housing component or a clutch component (e.g., a separate disc or component) to allow the spool component to rotate in the first direction while preventing rotation in the second direction. The drive component includes one or more tabs that are positioned over a top surface of the drive component. The one or more tabs are configured to move the drive component's teeth axially upward as the drive component is moved axially upward to disengage the drive component's teeth from the corresponding teeth of the housing component or clutch component. The clutch component may be a component that mates with the spool component, housing component, or tightening component and includes teeth that axially or radially engage with the drive component's teeth. The drive component may be moved axially upward via a user pulling axially upward on the tightening component (e.g., knob), by a user operating the tightening component (e.g., rotating a knob counterclockwise), by a user pressing or selecting a button, and the like.

According to another embodiment, a reel assembly for tightening an article is provided. The reel assembly includes a housing having: an interior region, an open top end, and an open bottom end. A spool is rotatably positioned within the interior region of the housing. The spool is configured for gathering a tension member there around to tighten the article. A drive component is positioned axially above the spool and operably coupled therewith to allow the spool to rotate in a first direction within the housing's interior region while preventing rotation of the spool in a second direction. A tightening component is positioned axially above the drive component and coupled therewith such that operation of the tightening component causes the spool to rotate within the housing's interior region in the first direction to gather the tension member around the spool and thereby tighten the article. When the reel assembly is assembled, the spool is substantially positioned within the interior region and is accessible from the open bottom end of the housing to allow a user to couple the tension member with the spool.

In some embodiments, the reel assembly also includes an attachment component that is positioned axially below the spool. The attachment component includes a coupling member that protrudes axially upward into the housing's interior region and couples with the drive component. In some embodiments, the housing may also include a partition that is configured to contact a top surface of the spool to prevent the spool from being moved axially upward within the housing.

In some embodiments, the drive component may be axially moveable to disengage from the spool component and thereby allow the spool component to rotate in the second direction. The drive component may be axially moveable via a rotation of the tightening component in the second direction, or may be axially moveable via axial movement of the tightening component relative to the housing. In some embodiments, the tension member may be integrally formed from the housing by elongating and deforming a material of the housing.

According to another embodiment, a method of assembling a reel assembly is provided. The method includes coupling a drive component with a tightening component and coupling the tightening component with a top end of a housing so that the drive component faces an interior region of the housing. The method also includes inserting a spool component within a bottom end of the housing so that the spool component is positioned within the interior region of the housing and so that a top end of the spool component faces a bottom surface of the drive component. The method further includes coupling an attachment component with the bottom end of the housing. The attachment component includes a coupling member that couples with the drive component. Coupling of the coupling member with the drive component operationally couples the drive component and the spool component so that operation of the tightening component causes the spool component to rotate within the housing in a first direction while preventing rotation of the spool component in a second direction.

In some embodiments, assembling the reel assembly includes coupling the components such that the reel assembly is free of a screw or other rigid fastener. In some embodiments, coupling the drive component with the tightening component includes snapping the drive component into a recessed portion of the tightening component. In some embodiments, coupling the tightening component with the top end of the housing includes snapping a lip of the tightening component over a corresponding lip of the housing. In some embodiments, coupling the attachment component with the bottom end of the housing includes snapping a flange of the attachment component within an aperture of the housing. In some embodiments, the method further includes snapping the attachment component's coupling member within an aperture of the drive component to couple said components together. In some embodiments, the assembled reel assembly may be coupled with a mounting component that is positioned on an article to be tightened with the reel assembly.

According to another embodiment, a reel assembly for tightening an article is provided. The reel assembly includes a housing having an interior region and a partition that divides the interior region into an upper portion and a lower portion. A spool is rotatably positioned within the lower portion of the housing's interior region axially below the partition. The partition prevents the spool from axially moving upward into the upper portion. A drive component is positioned within the upper portion of the housing's interior region. The drive component is axially moveable relative to the spool between an engaged state and a disengaged state. In the engaged state, the drive component allows the spool to rotate in a first direction within the housing's interior region while preventing rotation of the spool component in a second direction. In the disengaged state, the drive component allows the spool to rotate in the second direction within the housing's interior region.

A tightening component is positioned axially above the drive component and coupled therewith so that operation of the tightening component causes the spool to rotate within the housing's interior region in the first direction. An attachment component is positioned axially below the spool. The attachment component includes a coupling member that protrudes axially upward into the interior region of the housing and couples with the drive component.

According to another embodiment, an integrated tightening device and lacing system is provided. The integrated device and system includes a base portion and a tension member that has a proximal end integrally formed with the base portion and a distal end opposite the proximal end. The tension member is formed by elongating and deforming a material of the base portion. The integrated device and system also includes a spool that is coupled with the distal end of the tension member. The spool is configured for gathering the tension member to tighten an article. The integrated device and system further includes a tightening component that is operationally coupled with the spool so that operation of the tightening component causes the spool to gather the tension member and thereby tighten the article.

In some embodiments, the distal end of the tension member includes a grip feature that facilitates in elongating the material of the base portion. In some embodiments, the material of the base portion is deformable only while the material is above a threshold temperature.

According to another embodiment, a method of forming a lacing system is provided. The method includes securing a material of a base portion and elongating the material of the base portion to form a tension member having a proximal end that is integrally attached to the base portion and a distal end opposite the proximal end. The method also includes coupling the distal end of the tension member with a spool. The spool is configured for gathering the tension member to tighten an article. The method further includes operationally coupling the spool with a tightening component so that operation of the tightening component causes the spool to gather the tension member and thereby tighten the article.

In some embodiments, securing the material of the base portion includes gripping a grip feature of the base portion. The grip feature facilitates elongation of the base portion's material. In some embodiments, the method additionally includes elongating the material of the base portion while the material is above a threshold temperature.

BRIEF DESCRIPTION OF THE DRAWINGS

The present invention is described in conjunction with the appended figures:

FIGS. 8A-L illustrate yet another embodiment of a reel assembly having several integrated components.

FIGS. 12A-0 illustrate another embodiment of a reel assembly having various integrated components.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

Embodiments of the invention provide closure devices (hereinafter reel assemblies) with a reduced component count compared with conventional closure devices. The component count reduction may be provided by integrating one or more of the reel assembly components into a single component. The integrated components may perform multiple operations, such as functioning as a lace winding spool while simultaneously functioning as a ratchet winding mechanism. The reduced component count of the reel assembly simplifies the overall system, thereby reducing the cost and/or complexity of the system. The reduced component count may also reduce the risk of component or system breakage and/or malfunction.

Generally, the described reel assemblies may be used to close a variety of items, such as items of clothing (i.e., hats, gloves, and the like), sports apparel (boots, snowboard boots, ski boots, and the like), medical braces (i.e., back braces, knee braces, and the like), and various other items or apparel. A specific embodiment in which the closure devices may be used involves shoes, boots, and other footwear. For ease in describing the embodiments herein, the disclosure will be directed mainly to shoes although it should be realized that the closure devices may be used for the various other items.

Figure 1:
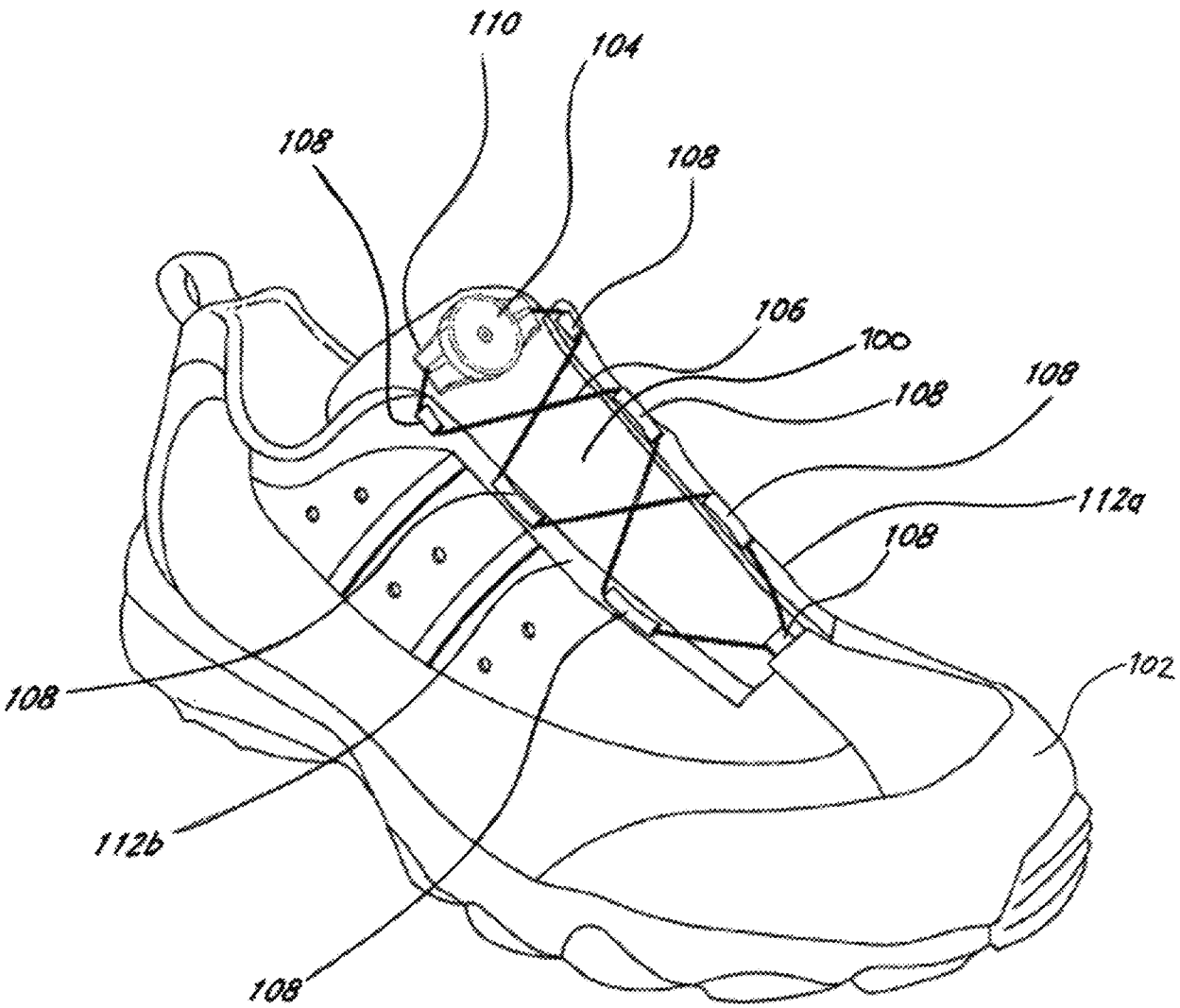
FIG. 1 illustrates a perspective view of a lacing system that may be used for tightening a shoe or other article.

Referring now to FIG. 1, illustrated is a perspective view of an embodiment of lacing system 100 used for tightening a shoe 102. The shoe can be any suitable footwear that can be tightened around a wearer's foot. The lacing system 100 can be used to close or tighten various other articles as described herein, such as, for example, a belt, a hat, a glove, snowboard bindings, a medical brace, or a bag. The lacing system can include a reel assembly 104, a lace 106, and one or more lace guides 108. In the illustrated embodiment, the reel assembly 104 can be attached to the tongue 110 of the shoe. Various other configurations are also possible. For example, the reel assembly 104 can be attached to a side of the shoe 102, which can be advantageous for shoes in which the shoe sides 112*a-b* are designed to be drawn closely together when tightened leaving only a small portion of the tongue 110 exposed. The reel assembly 104 can also be attached to the back of the shoe 102, and a portion of the lace 106 can pass through the shoe 102, sometimes using tubing for the lace to travel through, on either side of the wearer's ankle such that the lace 106 can be engaged with the reel assembly 104 when back-mounted.

Figure 2:
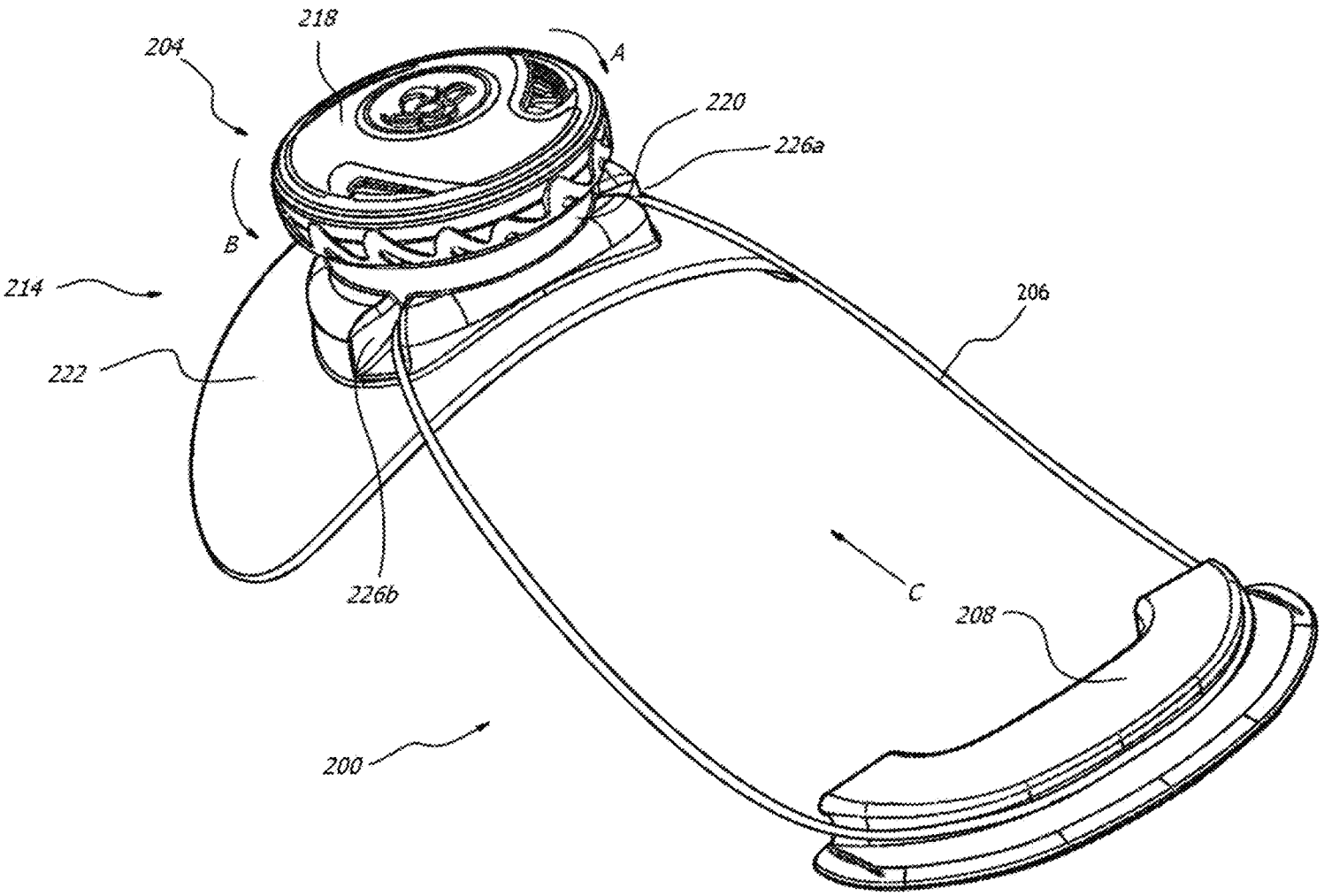
FIG. 2 illustrates a perspective view of another lacing system that can be used for tightening a shoe or other article.
Figure 3:
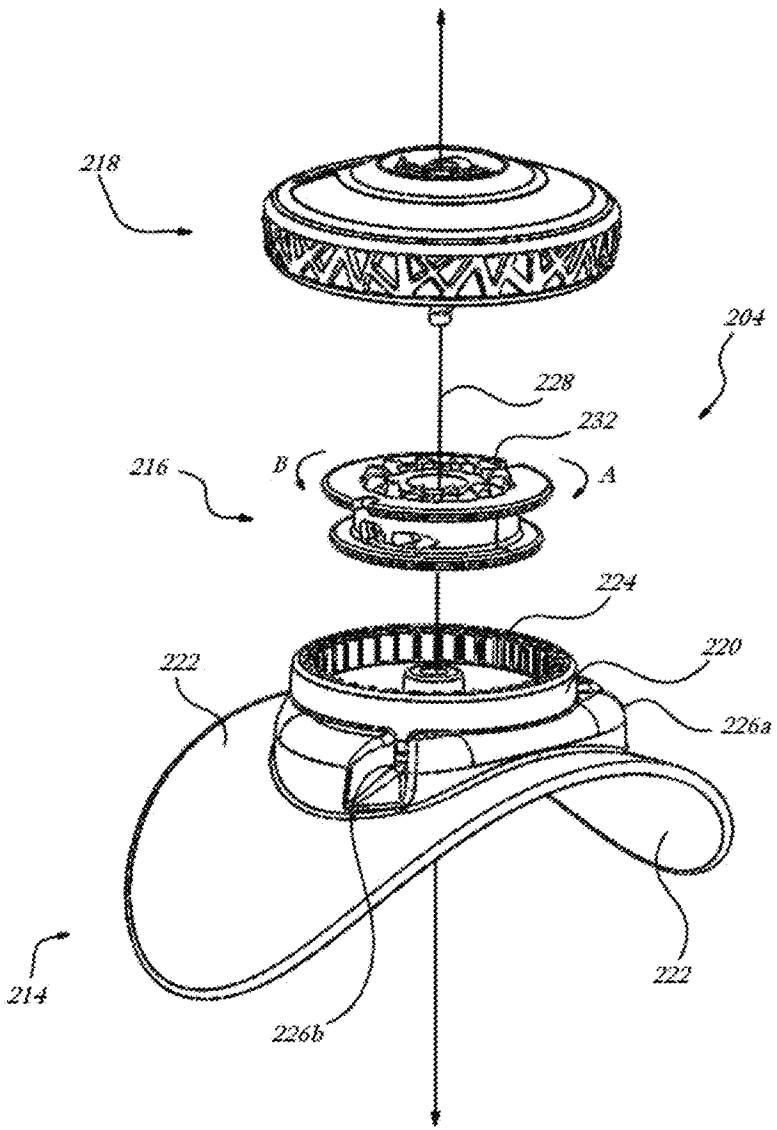
FIGS. 3 & 4 illustrate exploded perspective views of the lacing system of FIG. 2.
Figure 4:
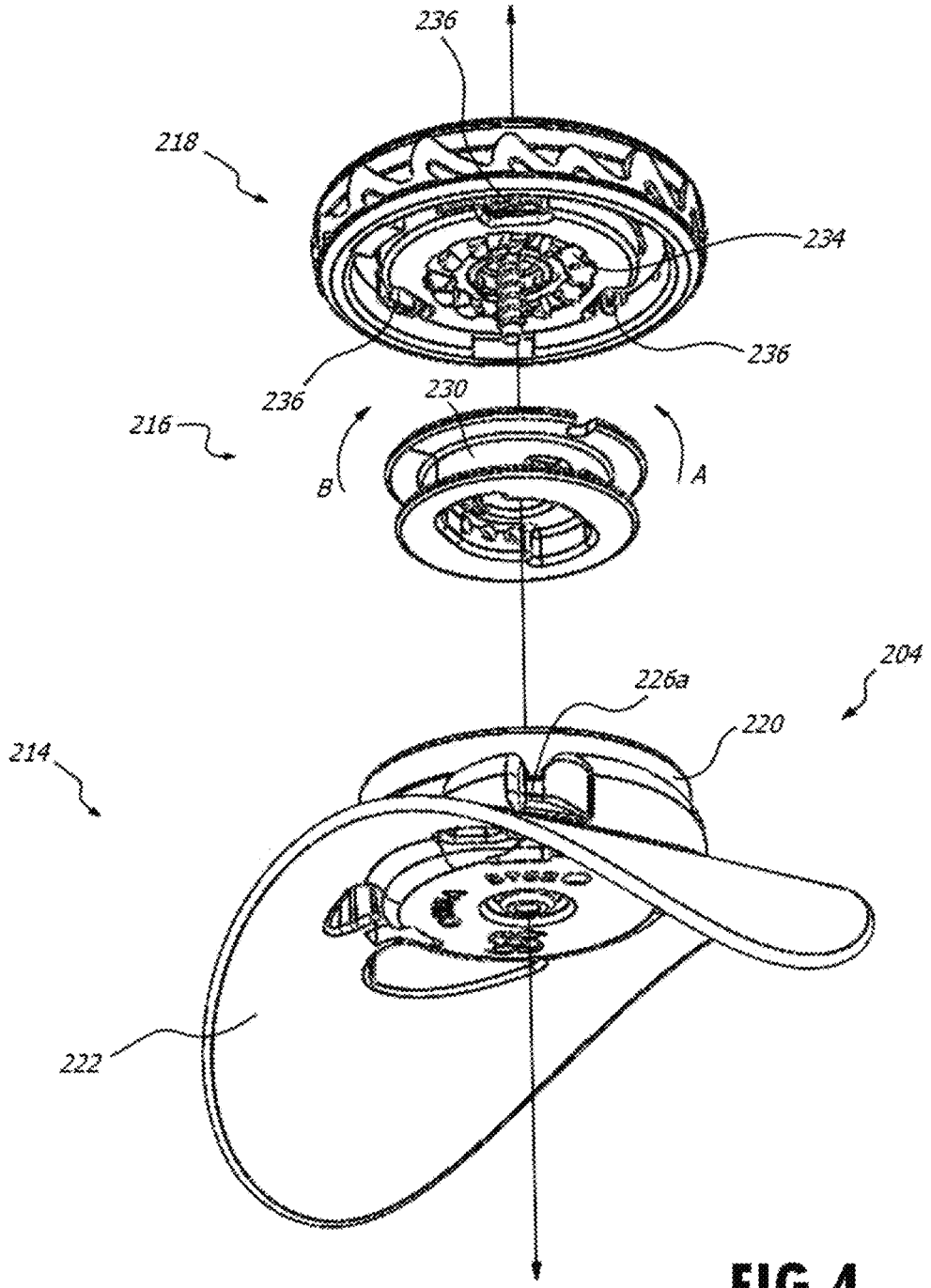

FIG. 2 is a perspective view of an embodiment of lacing system 200 that can be similar to the lacing system 100, or any other lacing system described herein. The lacing system can include a reel assembly 204 which can be similar to the reel assembly 104, or any other reel described herein. FIG. 3 is an exploded perspective view of the reel assembly 204. FIG. 4 is another exploded perspective view of the reel assembly 204.

With reference to FIGS. 2-4, the reel assembly 204 can include a base member 214, a spool member 216, and a knob 218. The base member can include a spool housing 220 and a mounting flange 222. The spool housing 220 can include a plurality of ratchet teeth 224, which can extend radially inwardly. The base member 214 can include lace holes 226*a-b* that allow the lace 206 to enter the spool housing 220.

The spool member 216 can be disposed within the spool housing 220 such that the spool member 216 is rotatable about an axis 228 with respect to the spool housing 220. The lace 206 can be secured to the spool member 216 such that when the spool member 216 rotates in a tightening direction (shown by arrow A) the lace 206 is drawn into the spool housing 220 and is wound around the channel 230 formed in the spool member 216, and when the spool member 216 rotates in a loosening direction (shown by arrow B) the lace 206 unwinds from the channel 230 of the spool member 216 and exits the spool housing 220 via the lace holes 226*a-b*. The spool member 216 can also include spool teeth 232 formed thereon. It will be understood that the embodiments disclosed herein can be modified such that rotation in the direction shown by arrow B will tighten the lacing. In this particular embodiment, the knob 236 may be raised axially to disengage from spool 230 to allow the spool to freewheel in direction B in order to release the lace. In other embodiments, rotation of the knob in the direction shown by arrow B (or A) may loosen the lacing system.

The knob 218 can be attached to the spool housing 220 such that the knob 218 can rotate about the axis 228 with respect to the spool housing 220. The knob 218 can include knob teeth 234 that can be configured to mate with the spool teeth 232 to couple the knob 218 to the spool member 216 such that rotation of the knob 218 in the tightening direction causes the spool member 216 to also rotate in the tightening direction. In some embodiments, the rotation of the knob 218 in the loosening direction can also cause the spool member 216 to rotate in the loosening direction. The knob 218 can also include one or more pawl teeth 236 which can be biased radially outwardly so as to mate with the ratchet teeth. The pawl teeth 236 and ratchet teeth 224 can be configured so that the ratchet teeth 224 can displace the pawl teeth 236 radially inwardly when the knob 218 is rotated in the tightening direction, thereby allowing the knob 218 to rotate in the tightening direction. The pawl teeth 236 and the ratchet teeth 224 can also be configured so that they engage one another when force is applied to twist the knob 218 in the loosening direction, thereby preventing the knob 218 from rotating in the loosening direction.

Thus, the reel assembly 204 can provide a one-way tightening system configured to allow the user to rotate the knob 218 in the tightening direction, which causes the spool member 216 to rotate in the tightening direction, which in turn causes the lace 206 to be drawn into the spool housing 220 via the lace holes 226*a-b*. As the lace 206 is drawn into the spool housing 220 the lacing system 200 can tighten, causing the lace guide 208 to be drawn in the direction toward the reel assembly 204 (shown by arrow C in FIG. 2). Although the lacing system 200 is shown with a single lace guide 208, any other suitable number of lace guides can be used. Other features of the reel and lacing system are described in U.S. Patent Application No. 2011/0266384, filed Apr. 29, 2011, and Titled "Reel Based Lacing System", the entire disclosure of which is incorporated herein by reference.

As described previously, embodiments described herein integrate one or more of the reel assembly components into a single component to reduce the component count—i.e., number of components—of the reel assembly. For example, one or more of the components described in FIGS. 2-4 may be integrated or consolidated into a single component. Integrating or consolidating the components to reduce the overall component count simplifies the system and/or reduces cost. In some embodiments, the reel assembly may be assembled without the use of a screw or other rigid fastener, which may increase the durability and/or impact resistance of the reel assembly. For example, individual components of the reel assembly may be configured to snap into engagement with each other, thereby reducing or eliminating the need for rigid fasteners, such as screws, rivets, bolts, and the like. These and other features of the reel assemblies will be more evident with reference to the embodiments described herein below.

Figure 5A:
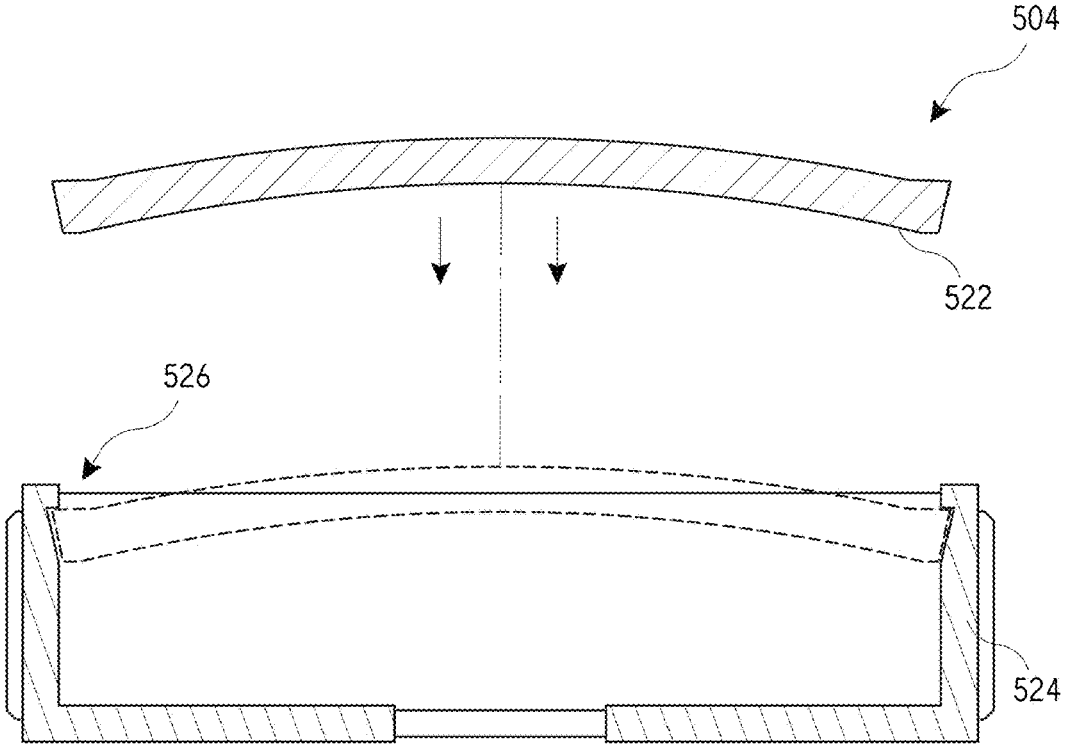
FIGS. 5A-B illustrate a cover with grip and a core of a reel assembly being fit together into an assembly.
Figure 5B:
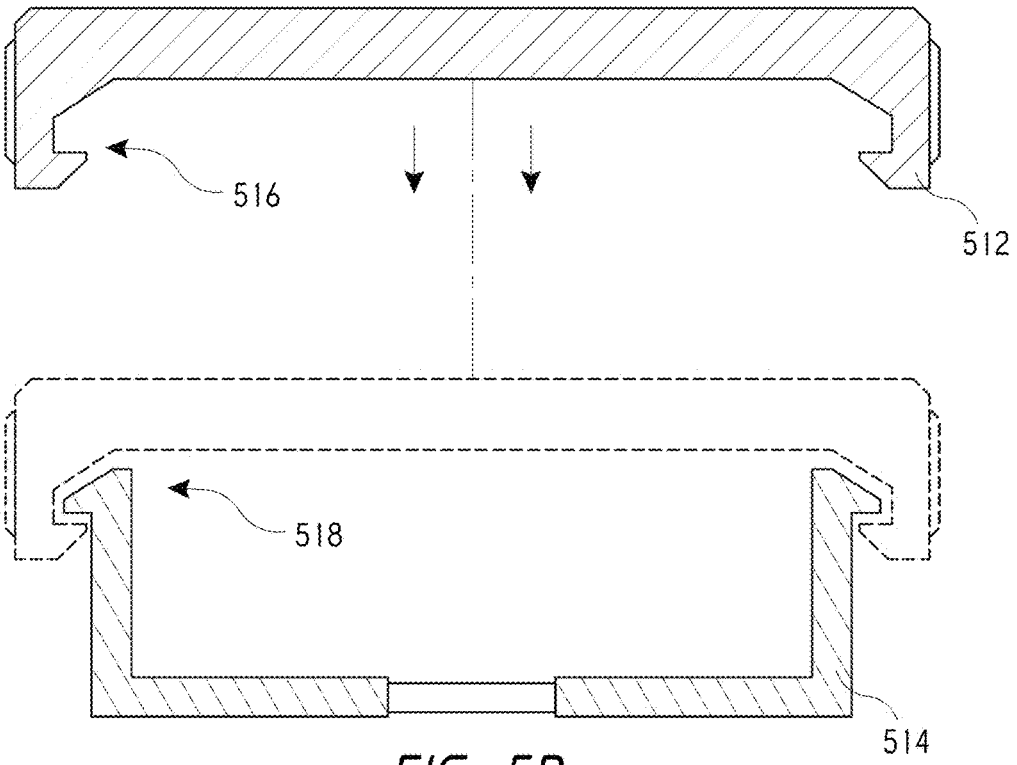

FIGS. 5A-B illustrate embodiments showing how an upper portion or cover with grip 512 and a lower portion or core 514 of a reel assembly's knob may be fit together into an assembly. Specifically, the cover with grip 512 may be snap fit over the core 514. The cover with grip 512 may have an inwardly extending flange portion 516 that snaps over an outwardly extending flange 518 of the core 514. In fitting the components together, the bottom portion of the cover with grip 512 typically deflects outward as flange 516 is fit over flange 518. The bottom portion of the cover with grip 512 then resiliently snaps back into place to lock the cover with grip 512 about the core 514. Since the cover with grip 512 is fit over the core 514, the cover's flange 516 is exposed to external objects. In some situations, the flange 516 may be hit or impacted at an angle by an external object, which may cause the cover with grip 512 to become uncoupled from the core 514. To prevent uncoupling of the components, the core 514 and/or cover with grip 512 is typically made of a robust material, such as glass filled nylon, which may be relatively expensive.

Figure 5C:
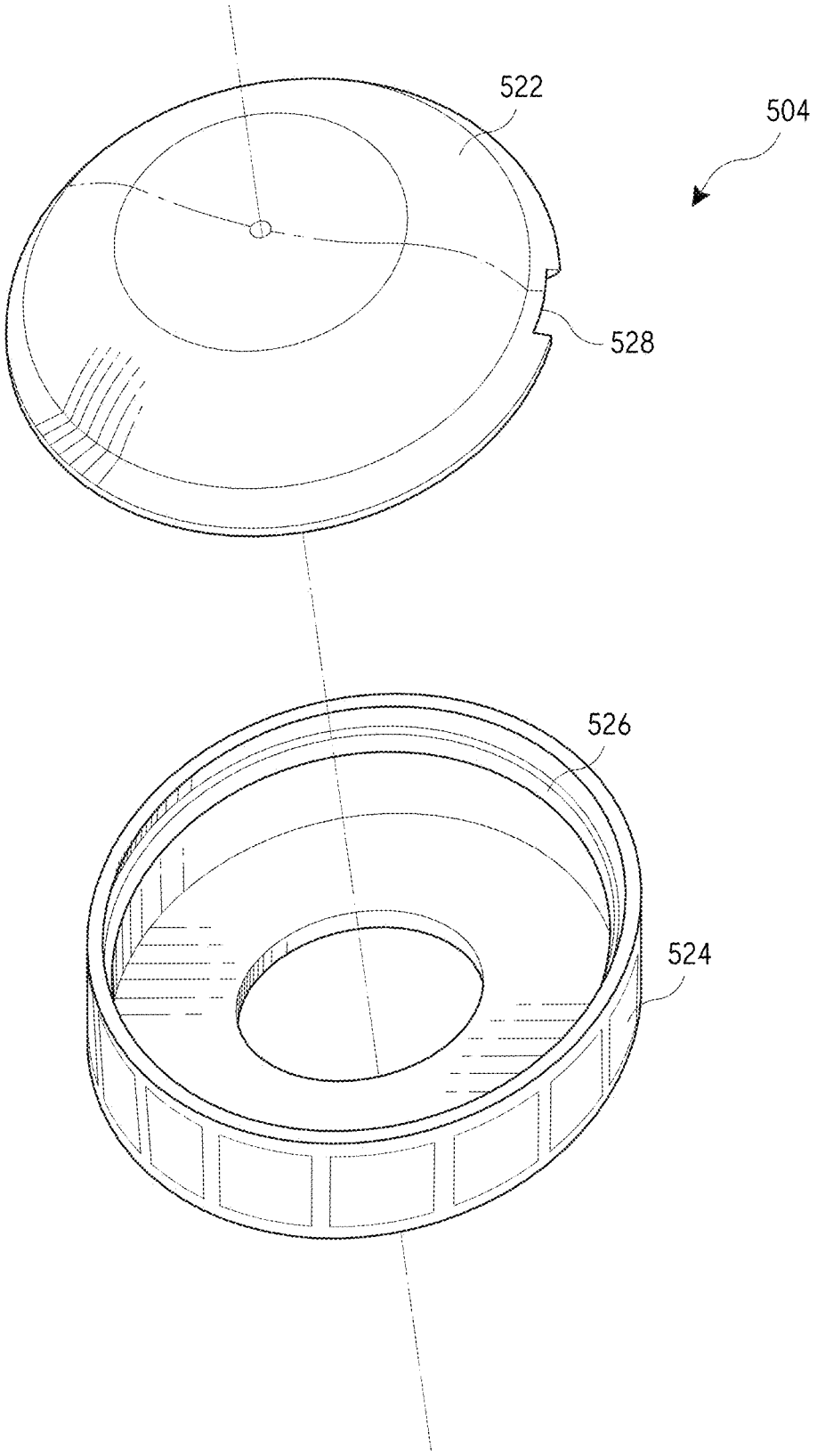
FIG. 5C illustrates an exploded perspective view of the cover with grip and core of FIG. 5A.

In some embodiments, impact strength can be improved by inverting the coupling configuration. For example, uncoupling of the cover with grip from the core may be prevented or hindered by inverting the coupling configuration between the components. For example, knob 504 shows a core with grip 524 having a circumferential groove 526 within which an edge of the cover 522 fits. This knob 504 configuration is further shown in FIG. 5C. The cover 522 may deflect inward or the core with grip 524 may deflect outward as the cover is pressed onto the core with grip 524. The edge of the cover 522 may snap into the circumferential groove 526 to couple the components together. Since the connection between the components is within the core with grip 524, the knob 504 is less susceptible to side or angled impacts that may otherwise uncouple the cover from the core. This configuration may allow for cheaper material to be used, such as ABS, nylon, or other materials. In some embodiments, the cover 522 may include a slot 528 that allows the cover 522 to be uncoupled from the core with grip 524, such by using a flat head screw driver for leverage. In some embodiments, one or more of the components described herein (i.e., pawls, teeth, spool, and the like) may be housed within an interior of the coupled cover and core.

Figure 6A:
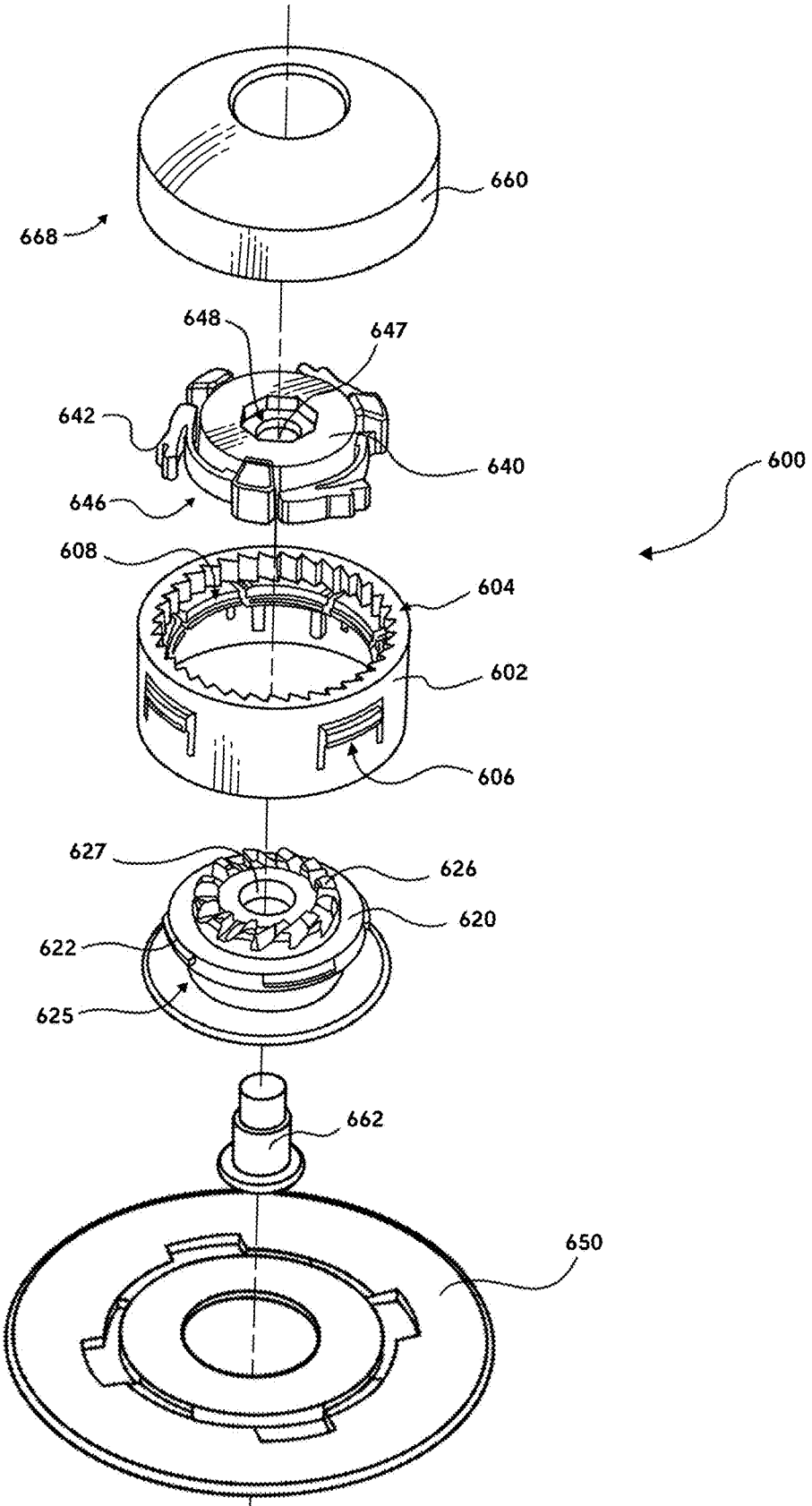
FIGS. 6A-K illustrate an embodiment of a reel assembly having several integrated components.

Referring now to FIGS. 6A-K, illustrated is a reel assembly 600 having several integrated components. FIG. 6A illustrates an exploded perspective view of the reel assembly 600. As shown, reel assembly 600 includes a spool housing 602 having an interior portion or chamber within which most of the other components fit, such as spool 620 and pawl or drive disc 640 (hereinafter pawl disc 640). Spool housing 602 includes a plurality of circumferentially positioned and radially inward facing ratchet teeth 604 that are configured to engage with pawl teeth 642 of pawl disc 640 as the reel assembly 600 is operated to allow lace to be wound around spool 620.

The pawl teeth 642 of pawl disc 640 and ratchet teeth 604 of spool housing 602 function as a ratchet mechanism that provides the one-way winding motion of the spool 620 to allow the lace to be wound around the spool. To provide the one-way ratchet mechanism, the pawl teeth 642 are configured to deflect radially inward relative to pawl disc 640 as the pawl teeth 642 rotate clockwise relative to ratchet teeth 604. The pawl teeth 642 are biased radially outward so as to engage and lock with the ratchet teeth 604 to prevent counterclockwise rotation of the pawl disc 640 relative to spool housing 602. As the pawl disc 640 and pawl teeth 642 are rotated relative to ratchet teeth 604, the pawl teeth snap into position within corresponding housing teeth 604 due to the inward and outward deflection of cantilevered pawl arms, which produces an audible "click" sound. This sound may be tailored by adjusting a thickness of the material of pawl disc 640.

Pawl disc 640 also includes a plurality of axially oriented teeth 646 (see FIG. 6B) that are configured to engage with axially oriented teeth 626 of spool 620. The teeth, 646 and 626, engage so that the pawl disc 640 drives, or in other words causes, clockwise rotation of the spool 620 as the pawl disc 640 is rotated clockwise (or counterclockwise) relative to spool housing 602. As the spool 620 is rotated in this manner, lace (not shown) that is attached to the spool 620 is wound around a central portion or channel 625 of the spool 620. To drive pawl disc 640 and spool 620 clockwise, a knob 660 is attached to the pawl disc 640 via a shaft 662 as described in more detail below. In some embodiments, the pawl disc 640 may include a keyed recess 648 into which a corresponding shaped extension or member (not shown) of the knob 660 is positioned. The keyed recess 648 and extension may function similar to teeth, 646 and 626, to transfer rotational motion applied to the knob 660 by a user to the pawl disc 640 and spool 620. To couple the components together (e.g., the spool 620, pawl disc 640, and knob 660), shaft 662 may be inserted through a centrally located aperture 627 of spool 620 and a centrally located aperture 647 of pawl disc 640 and coupled with knob 660. In some embodiments, the shaft 662 may be sonically welded with knob 660, although other shaft-knob coupling arrangements are contemplated herein, such as via interference fit, adhesive bonding, heat welding, riveting, and the like.

Pawl disc 640 provides several advantages over pawl discs of other reel assemblies. For example, the arrangement of the curved cantilever portion or member of pawl teeth 642 deflects radially outward against the ratchet teeth 604 of spool housing 602 as the lace is tensioned and/or the knob 660 is rotated backward. In this manner, the spool housing 602 supports the pawl teeth 642 as the curved cantilever portion or member presses outwardly against the spool housing 602. Further, this configuration allows the location and orientation of the pawl teeth 642 to have a more defined and precise location relative to pawl disc 640, which increases the synchronized engagement of the pawl teeth 642 with ratchet teeth 604.

In some embodiments, the spool housing 602 may include a plurality of circumferentially arranged spool housing fingers 606 or fingers that are configured to engage with an inwardly oriented flanged portion 668 of knob 660 (see FIG. 6J) to allow the teeth, 626 and 646, of the spool 620 and pawl disc 640 to be disengaged and thereby allow the lace to be unwound from spool 620. Specifically, during a winding operation of reel assembly 600, such as that described above, the flanged portion 668 of knob 660 may be positioned axially below the spool housing fingers 606. A plurality of spool housing fingers 622 that extend radially outward from a top flanged end of spool 620 may slidingly rest on a stepped inner tab or ledge 608 of spool housing 602. The stepped inner tab or ledge 608 of spool housing 602 prevents axially upward movement of the spool 620, pawl disc 640, and knob 660 relative to spool housing 602. The spool housing fingers 606 described herein provide several advantages over other reel assembly designs. For example, the spool housing fingers 606 may include relative long preload ramps that provide improved resistance to accidental opening without increasing the overall height of the reel assembly.

In an alternative embodiment, the spool 620 may be inserted within the spool housing 602 from a position axially below the spool housing 602. The spool 620 may be retained within the spool housing 602 via a lower or upper flange portion (not shown). In some embodiments, the shaft 662 may be relatively short component in the axial direction so that a space is provided in a central portion of the spool 620 to allow lace attachment with the spool 620 at or near the central portion.

As described briefly above, to unwind the lace, the teeth, 626 and 646, of spool 620 and pawl disc 640 may be disengaged to allow the spool to freely spin or rotate counterclockwise (or clockwise in some embodiments). Disengagement of the teeth, 626 and 646, of spool 620 and pawl disc 640 is achieved by positioning a lip 641 of pawl disc 640 axially above a ledge 663 of shaft 662 (see FIG. 61). The lip 641 has an inner diameter that is smaller than an outer diameter of ledge 663. The shaft 662 may axially slide within a central housing of spool 620 without causing the spool to move axially upward. Accordingly, as the knob 660 is pulled axially upward, the ledge 663 of shaft 662 engages with lip 641 to force the pawl disc 640 axially upward. Axially upward movement of the pawl disc 640 disengages the pawl teeth 642 from the ratchet teeth 604 of spool housing 602 and also disengages the teeth, 626 and 646, of the spool 620 and pawl disc 640, thereby allowing counterclockwise rotation of the knob 660, pawl disc 640, and/or spool 620 relative to spool housing 602. This disengaged configuration also allows spool 620 to rotate relative to knob 660 without causing rotation of the cap. This allows the lace (not shown) to be unwound from spool 620.

As the knob 660 is moved axially upward, the inwardly oriented flanged portion 668 of knob 660 press against the spool housing fingers 606 and causes the tabs to deflect radially inward. Axially upward movement of the flanged portion 668 beyond a top surface of the spool housing fingers 606 allows the spool housing fingers 606 to resiliently return to their un-deflected position or with a slight preload for a quality feel. In this arrangement, a bottom surface of the flanged portion 668 may rest on the top surface of the spool housing fingers 606 so as to maintain the disengaged configuration or relationship of knob 660 and pawl disc 640 from spool 620. Because the flanged portion 668 may rest on the spool housing fingers 606 in this manner, the user is not required to hold the knob 660 and pawl disc 640 in the disengaged configuration. Rather, the user may pull the knob 660 axially upward so that the flanged portion 668 rests on the tab, release the knob 660, unwind the lace from spool 620, and then press the knob 660 downward to re-engage the pawl teeth 642 with the ratchet teeth 604 of spool housing 602 and to re-engage the teeth, 626 and 646, of the spool 620 and pawl disc 640 so that winding of the lace may be subsequently performed as describe above. To facilitate re-engagement of the ratchet teeth and pawl teeth, each of these components may have a chamfered or angle edge that biases the ratchet teeth and pawl teeth into an engaged orientation.

Figure 6B:
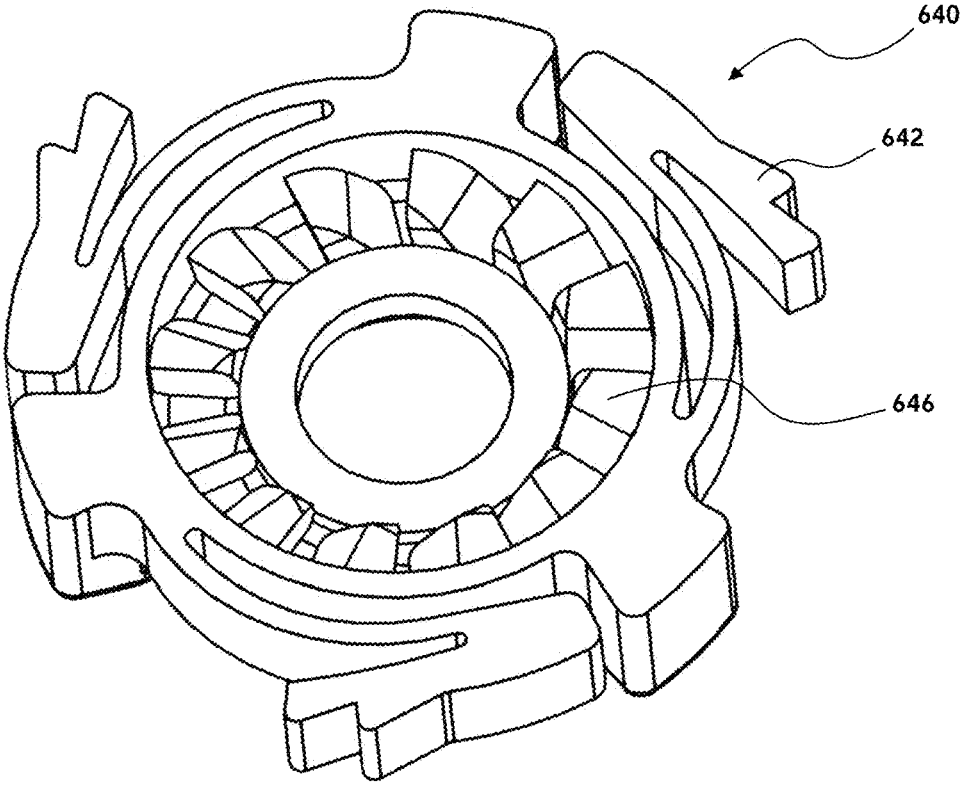
Figure 6C:
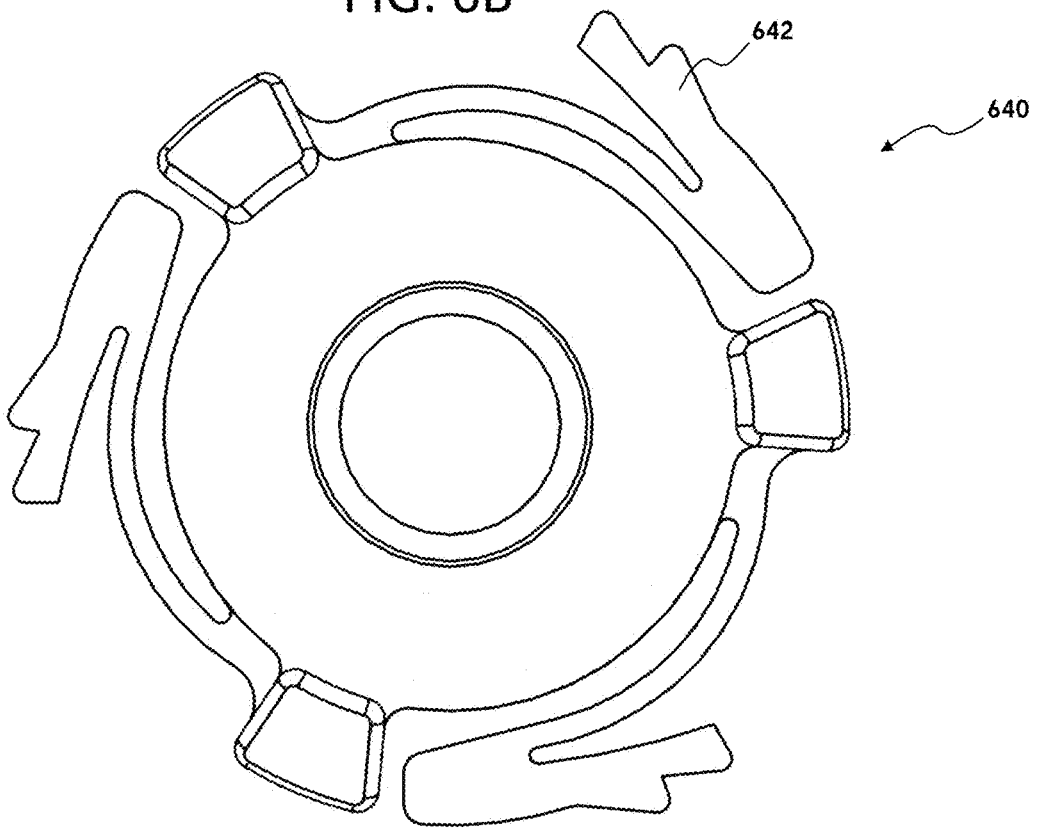
Figure 6D:
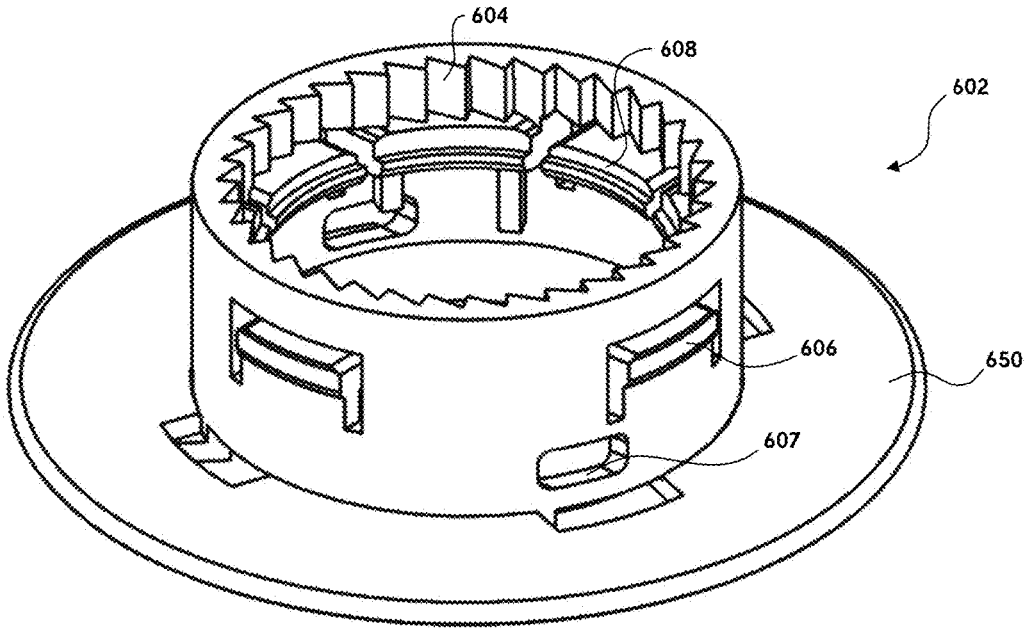
Figure 6E:
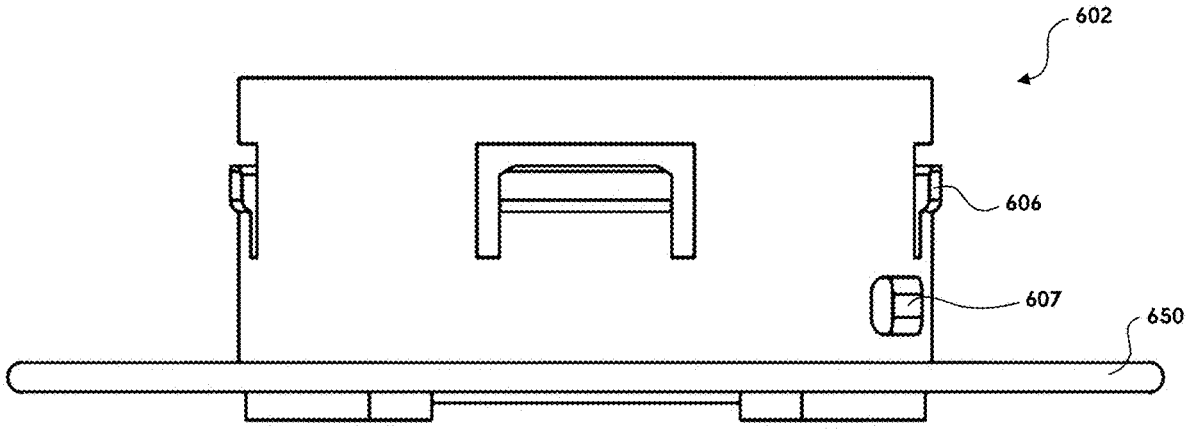
Figure 6F:
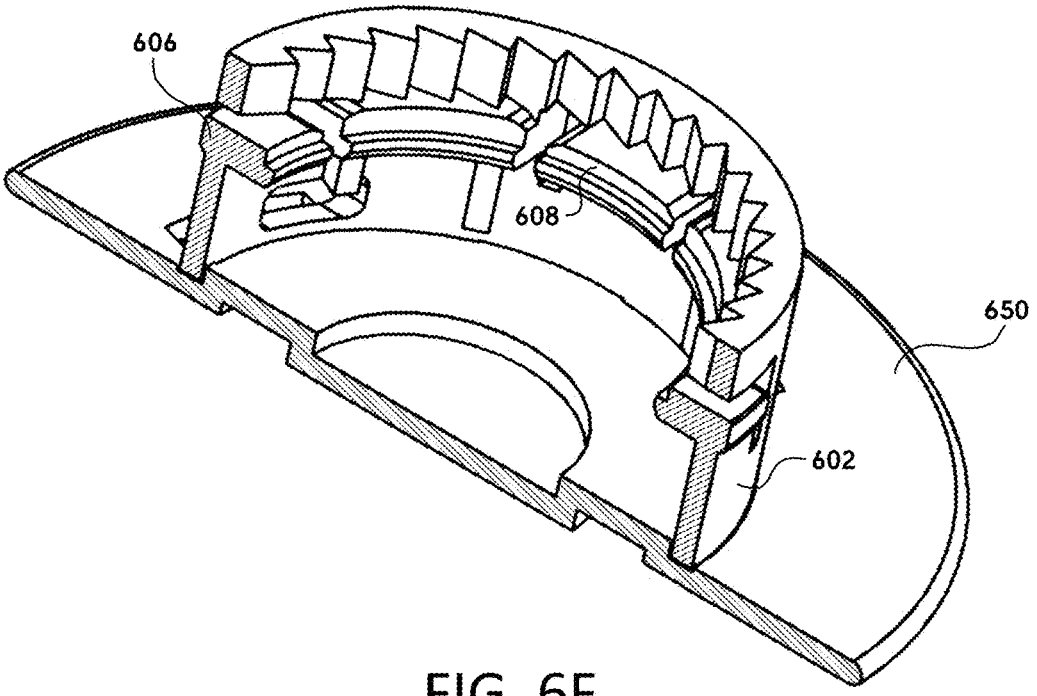
Figure 6G:
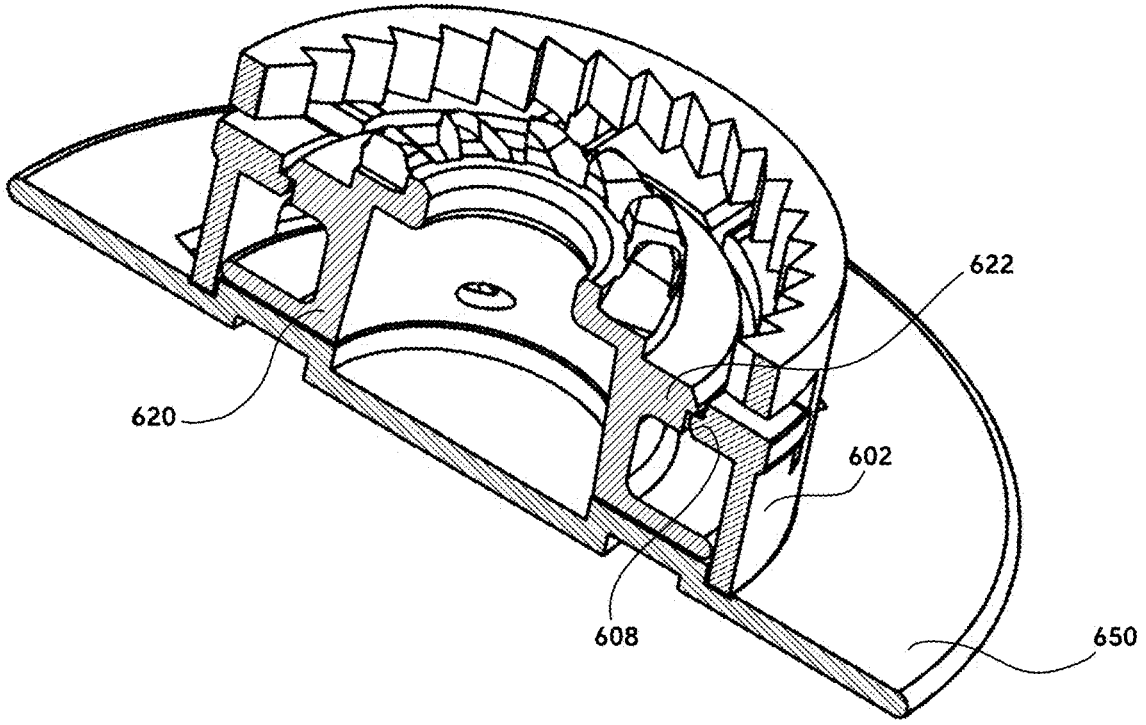
Figure 6H:
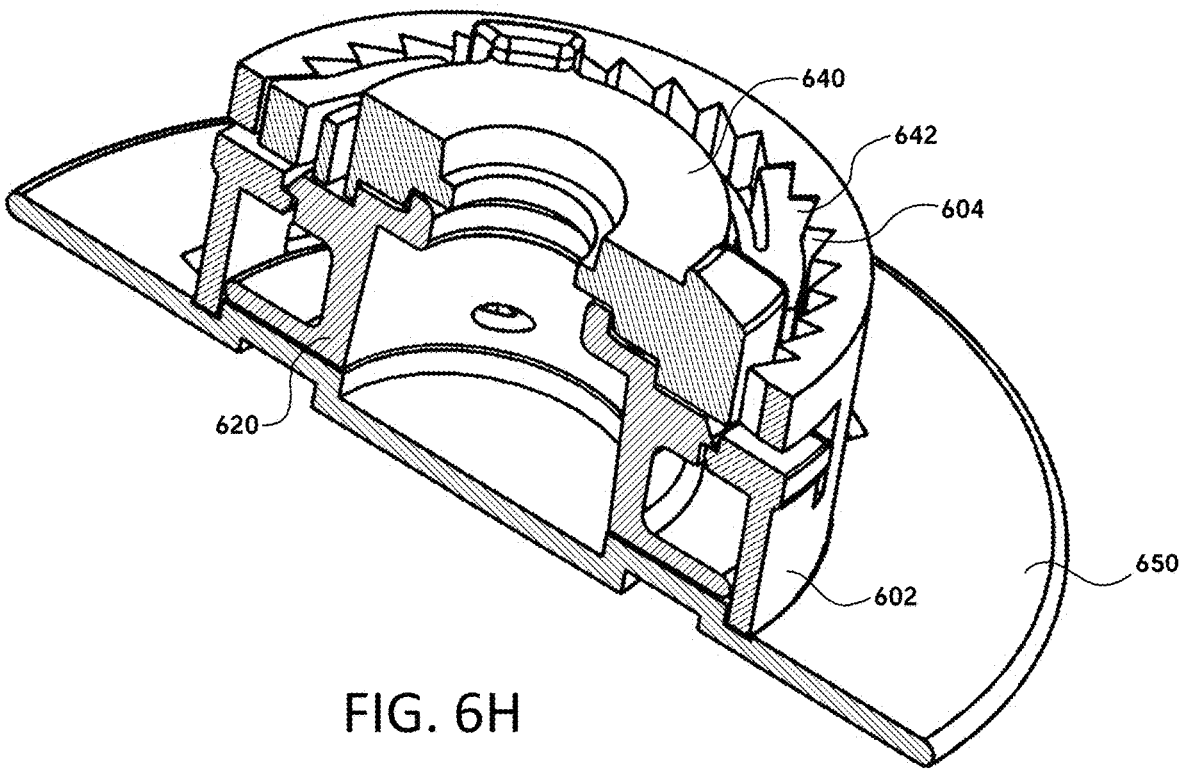
Figure 6I:
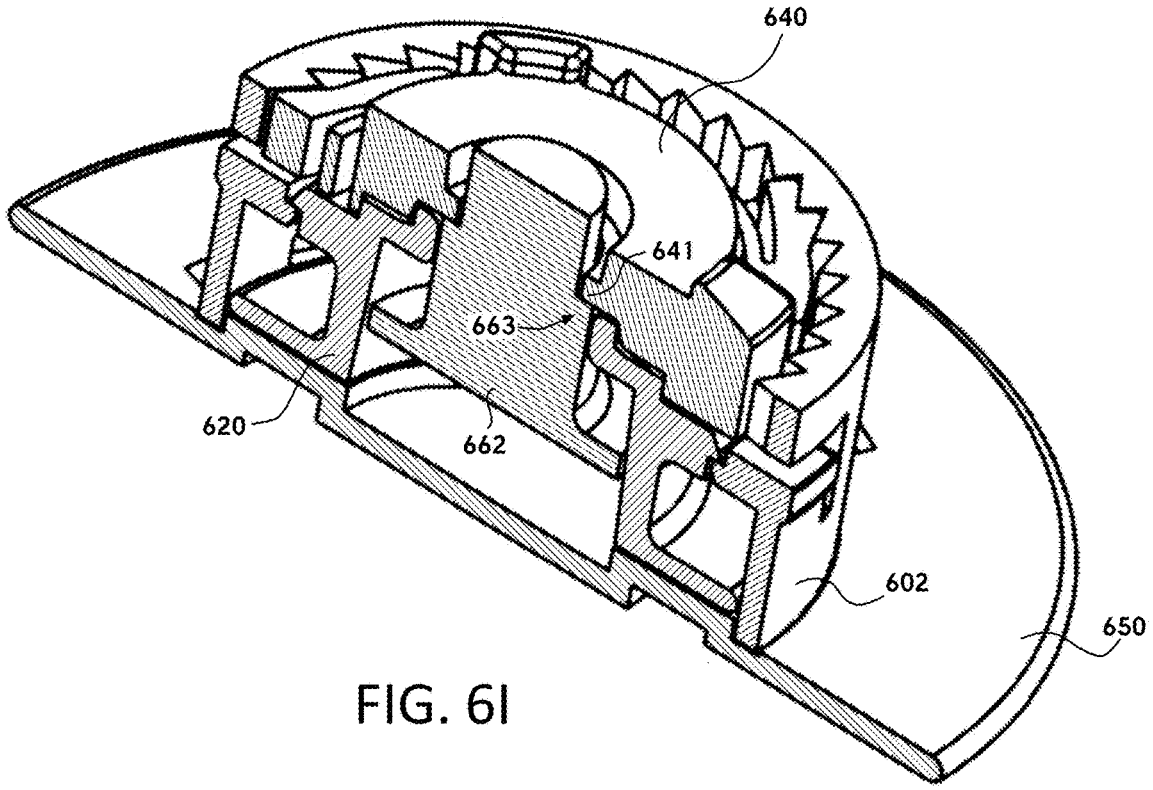
Figure 6J:
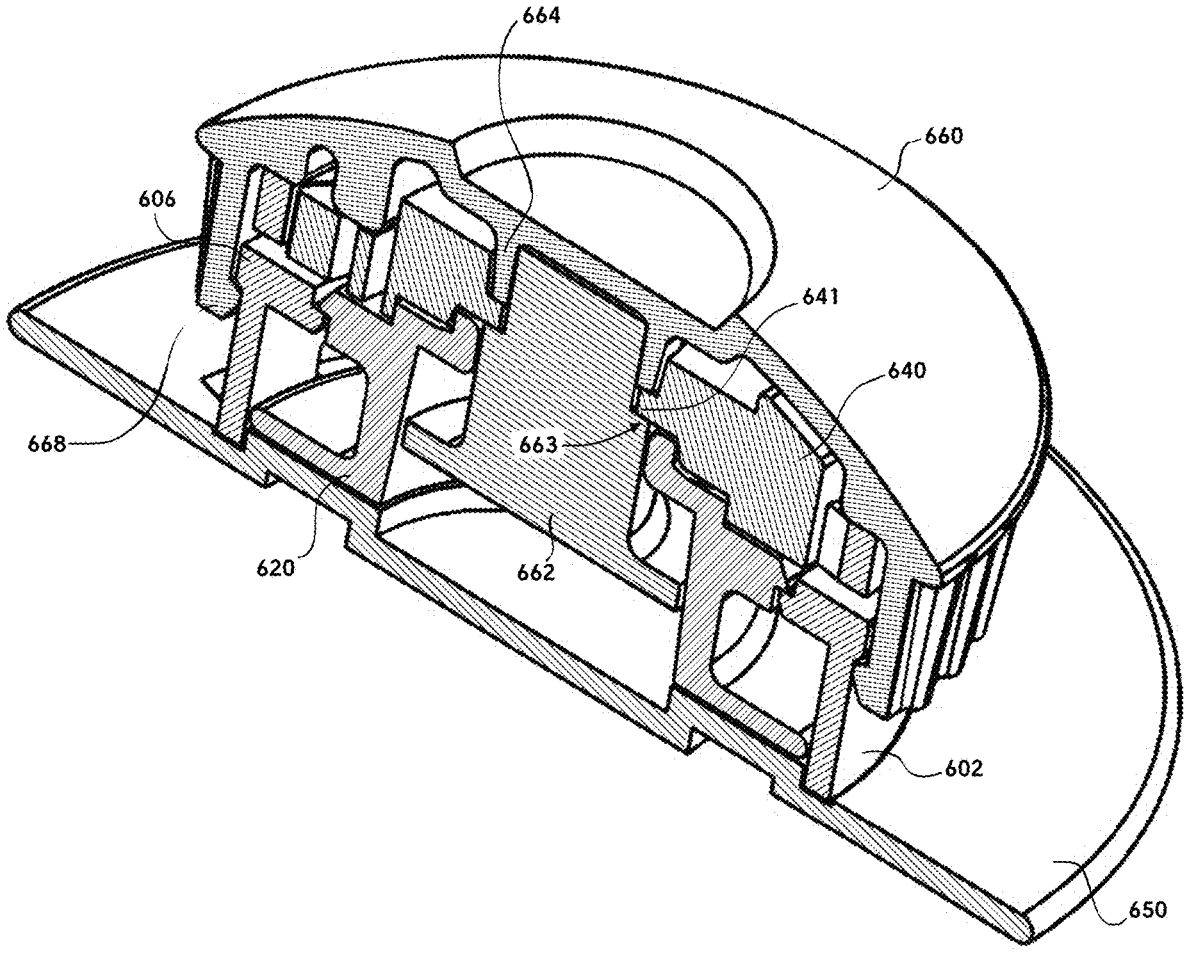
Figure 6K:
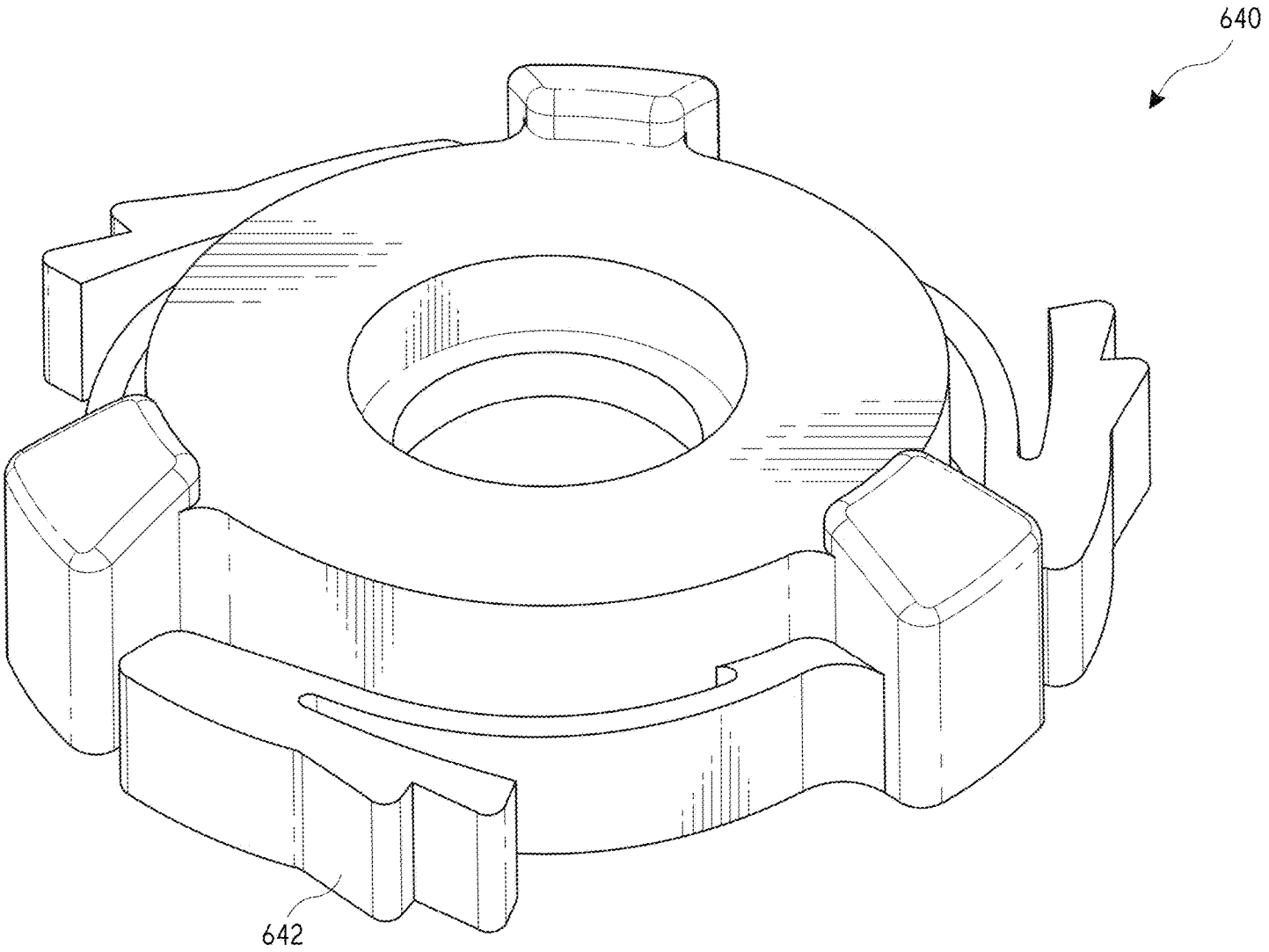

FIGS. 6B and 6C illustrate a bottom perspective view and top view of the pawl disc 640 respectively. To facilitate re-engagement of the teeth 646 with the teeth 626 of spool 620, the teeth 646 (and teeth 626) may have an angled configuration on one side as shown. FIGS. 6D and 6E show a perspective view and a side view, respectively, of spool housing 602. The figures also show the spool housing 602 coupled with a bayonet 650, which may be stitched or otherwise attached (e.g., welded, riveted, adhesively bonded, and the like) into the fabric of a shoe, brace, or other apparel or device. The spool housing 602 may be removably coupled with the bayonet to allow the reel assembly 600 to be removed and/or replaced. FIGS. 6D and 6E further illustrate an aperture 607 through which lace (not shown) may be threaded and coupled with the spool 620. FIGS. 6F-J illustrate perspective cross-sectional views of the components of reel assembly 600 coupled together.

Figure 7A:
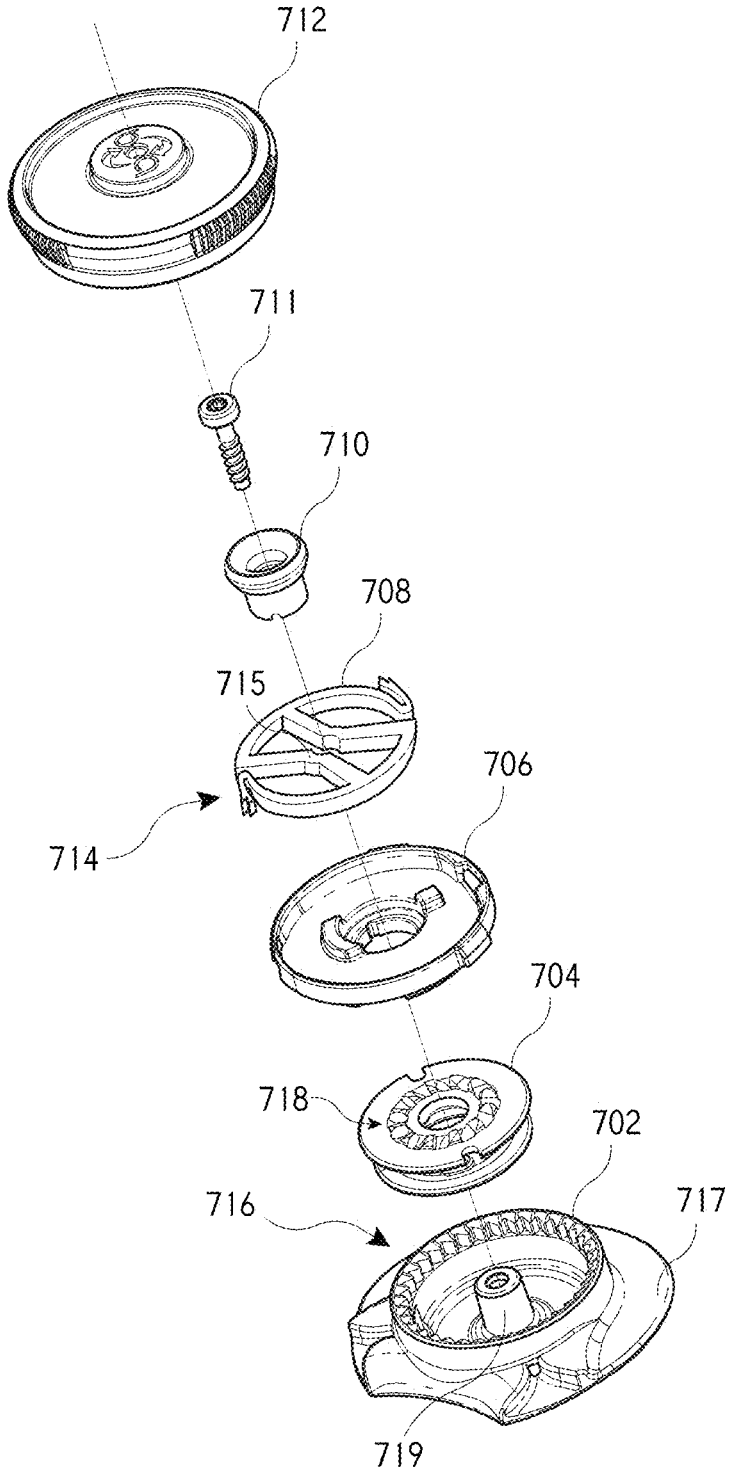
FIGS. 7A-C illustrate another embodiment of a reel assembly having several integrated components.
Figure 7B:
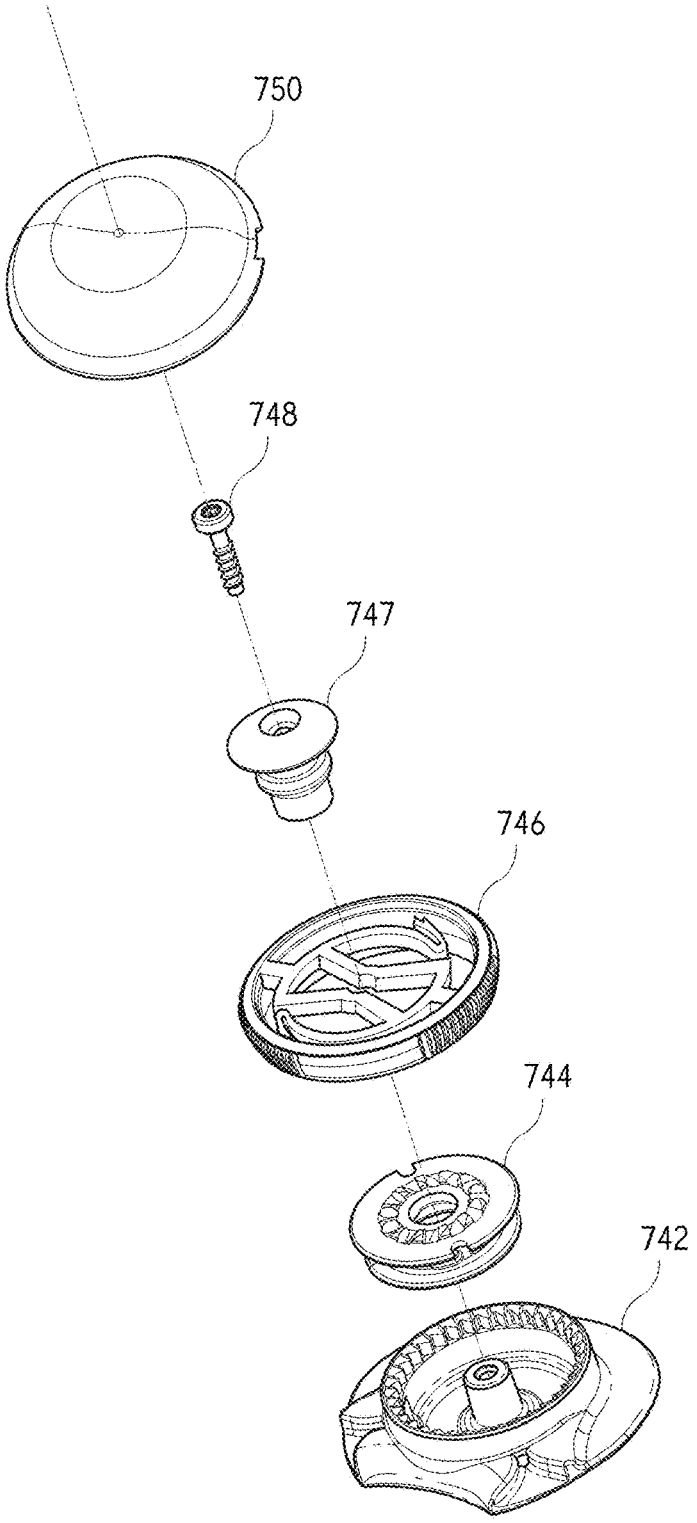
Figure 7C:
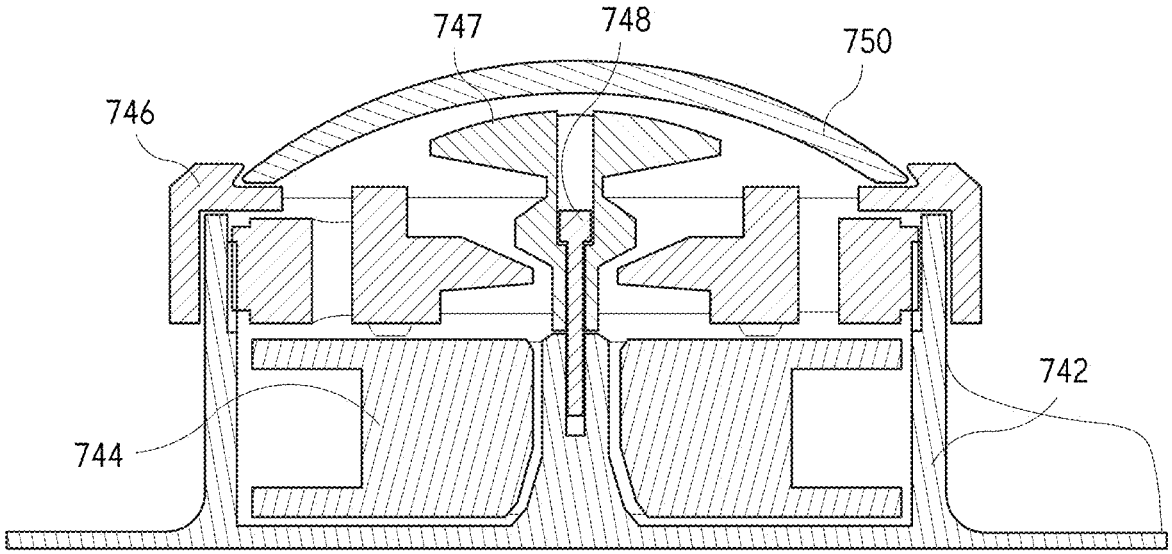

Referring now to FIGS. 7A-C, illustrated is another embodiment of a reel assembly. FIG. 7A illustrates a reel assembly 700 that includes a base member 702, a spool 704, a core 706, a pawl disc with spring 708, a cover with grip 712, and a coupling mechanism 711 (e.g., a screw) that couples the pawl disc with spring 708, core 706, spool 704, and base member 702 together. Base member 702 may be similar to spool housing 602 in that base member 702 includes teeth 716 that couple with the pawl teeth 714 of pawl disc with spring 708 as previously described to allow the one-way ratchet motion. Base member may also include a flange 717 that is stitched into fabric of a shoe, brace, or other apparel or device. In some embodiments, base member 702 may be releasably coupled with a bayonet. Base member 702 may also include a central shaft 719 about which the spool 704 and/or core 706 rotate and/or with which the coupling mechanism 711 attaches, such as by threading a screw 711 into the shaft 719.

Lace (not shown) may be wound around the spool 704 as previously described and the spool 704 may include teeth 718 that couple with corresponding teeth of pawl disc with spring 708 or core 706. In some embodiments, pawl disc with spring 708 may include a centrally located spring 715 that couples with a bushing 710. In some embodiments the central spring may be formed of a compliant or resilient material that deflects as the bushing 710 is pushed through a central lumen of the pawl disc with spring 708. After the bushing 710 is inserted through the central lumen, the resilient material of pawl disc with spring 708 may press against the bushing 710 to couple the components together. The screw 711 may be inserted through the bushing 710 and coupled through the spool 704 to base member 702. Cover with grip 712 fits over the assembly and couples with the base member 702 to cover the assembly and provide a component that the user can grip and rotate to wind the lace.

Referring now to FIGS. 7B and 7C, illustrated is another embodiment of a reel assembly. The reel assembly of FIGS. 7B and 7C is similar to that described in FIG. 7A in that the reel assembly includes a base member 742, a spool 744, a cover 750 and a coupling mechanism, such as a screw 748 and bushing 747. The reel assembly of FIGS. 7B and 7C differs from reel assembly 700 in that the system includes an integrated spool housing with pawl disc 746. The outer cylindrical body portion of the spool housing with pawl disc 746 fits over the outer cylindrical wall of base member 742 and is rotatable relative thereto by a user grasping the outer cylindrical body. The pawl disc portion of the spool housing with pawl disc 746 fits within the inner cylindrical wall of base member 742 such that the pawl teeth are able to engage with the ratchet teeth of base member 742 to wind and unwind lace from the spool 744 as described herein. The cover 750 may be similar to those described in FIG. 5A, and is coupled with an interior portion of cylindrical body of spool housing with pawl disc 746.

Referring now to FIGS. 8A-L, illustrated is another embodiment of a reel assembly 800 with integrated components. Similar to some of the other reel assemblies described herein, reel assembly 800 includes a spool housing 802 that releasably couples with a bayonet 804, which may be coupled with a shoe, brace, or other apparel or device via stitching, adhesive bonding, molding, and the like. In some embodiments, to releasably couple the spool housing 802 and bayonet 804, the bayonet 804 may include a tab 803 having a hooked portion facing inward or outward that fits within a recess 811 of a bottom flanged portion of the spool housing 802. The tab 803 may be pulled or pushed to remove the hooked portion from the recess to allow the spool housing and other components of the reel assembly 800 to be released from the bayonet. Uncoupling of the reel assembly 800 may be performed to replace the reel assembly, to replace the lace of the reel assembly, or for maintenance or other purposes.

Reel assembly 800 also includes a spool with pawls 806 that fits within the spool housing 802. Unlike the other reel assemblies described herein, reel assembly 800 does not include a separate pawl disc. Rather, the pawl teeth 805 are integrated with the spool with pawls 806 into a single component, thereby reducing the component count of reel assembly 800. As previously described, the pawl teeth 805 are biased radially outward with curved spring elements to cause the pawl teeth 805 to engage with ratchet teeth 807 of the spool housing to provide the one-way ratchet motion previously described.

Reel assembly 800 also includes a cover with grip 808 as previously described. The spool housing 802 includes spool housing fingers 801 that are spaced circumferentially around the body of the spool housing 802. In some embodiments, the fingers 801 may be an annular flange that partially or fully surrounds the spool housing 802. The fingers 801 will be referred to hereinafter as flange 801. The spool housing flange 801 interacts with a corresponding flange or grooved interior channel (see FIGS. 8D-I) of the cover with grip 808 as previously described to allow the cover with grip to be pulled axially upward and maintained in an axially raised orientation relative to the spool with pawls to disengage the pawl teeth 805 and ratchet teeth 807 and thereby allow lace 820 (see FIGS. 8C-E) to be unwound from the spool with pawls 806. To couple the components together, a shaft 810 may be attached to a central cylindrical element (see FIGS. 8D-I) of the cover with grip 808 via sonic welding, adhesive bonding, press fitting, and the like.

Figure 8A:
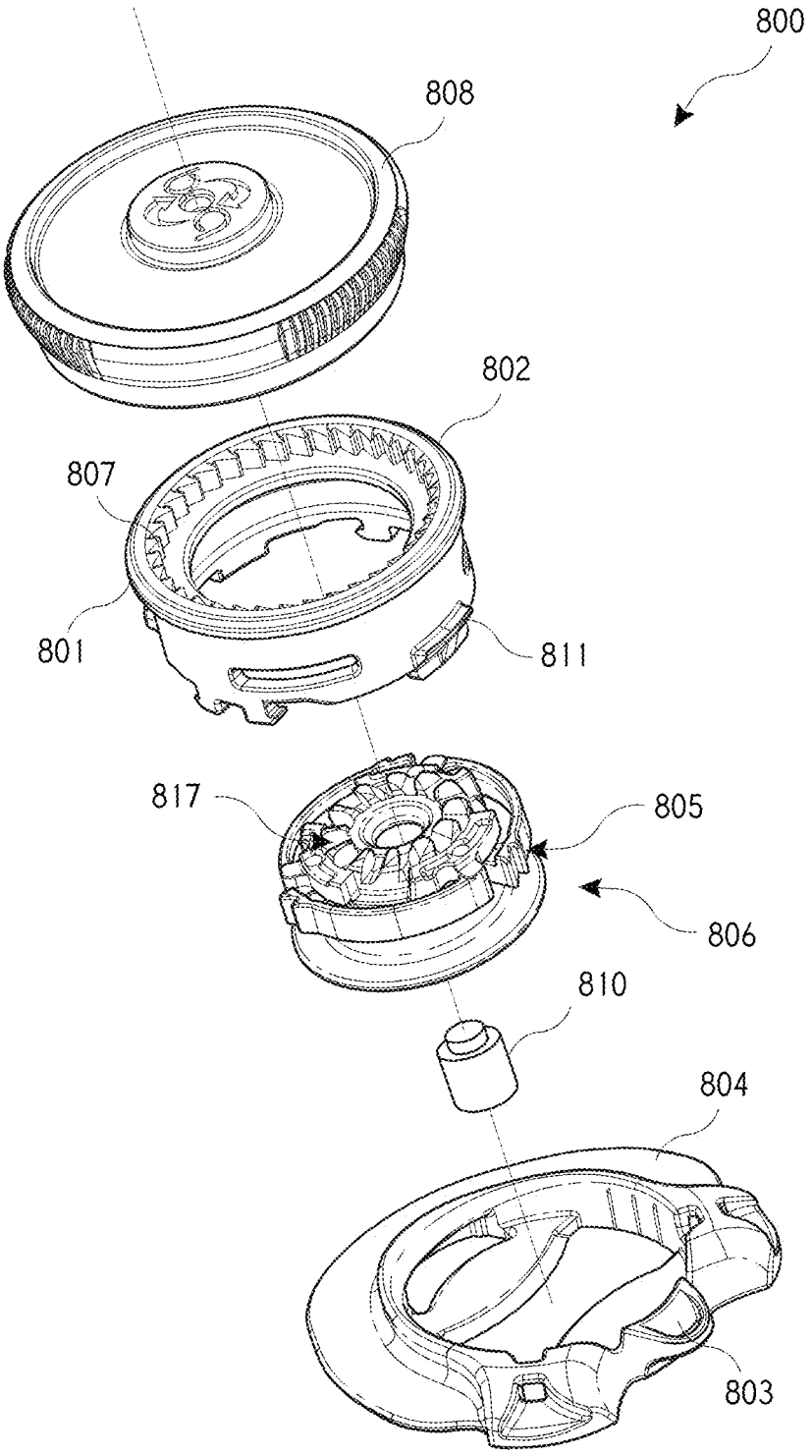
Figure 8B:
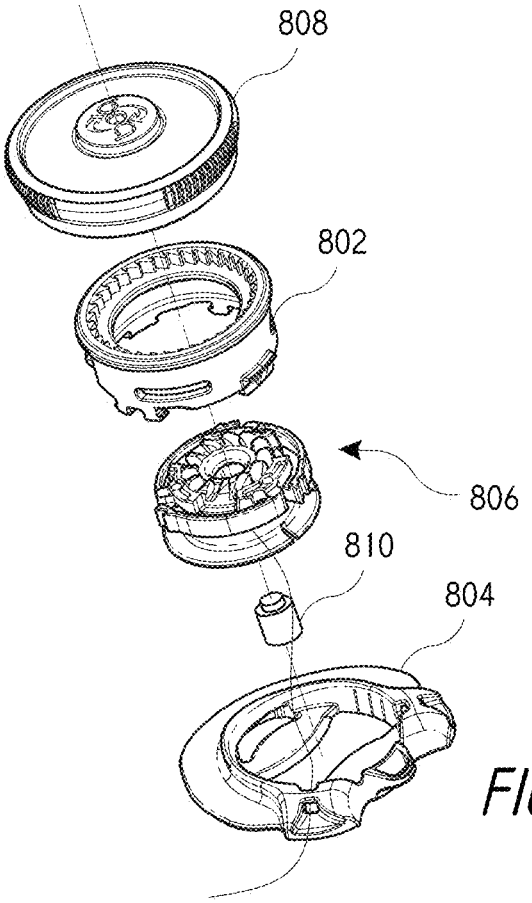
Figure 8C:
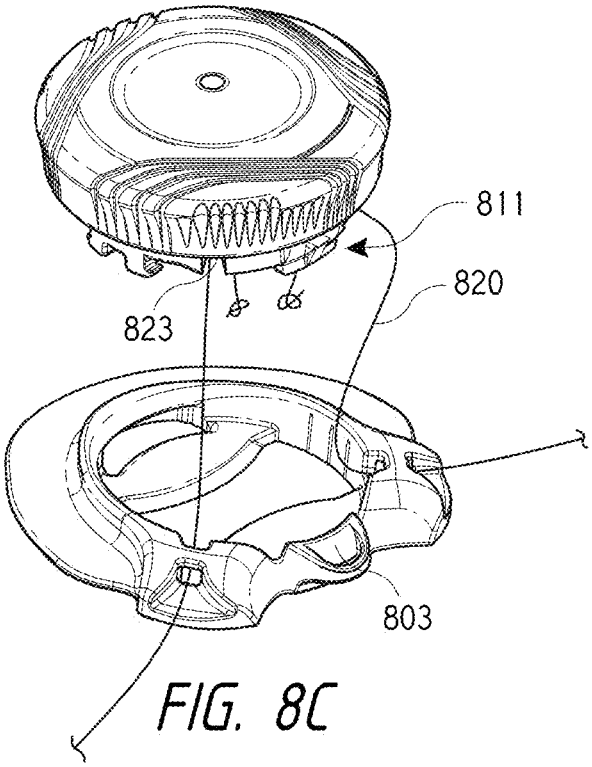
Figure 8D:
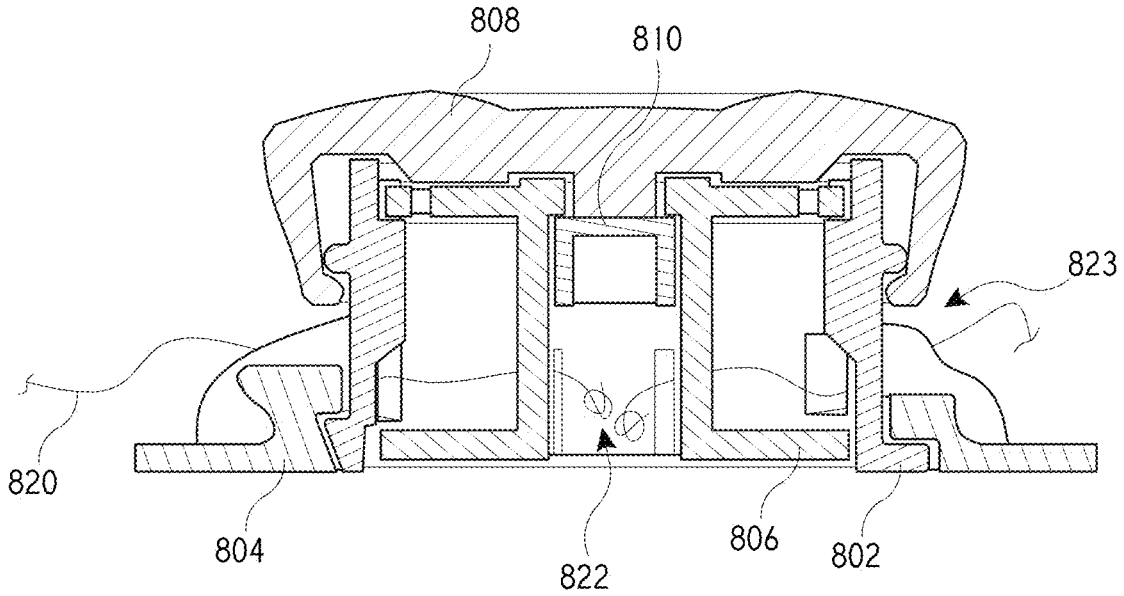
Figure 8E:
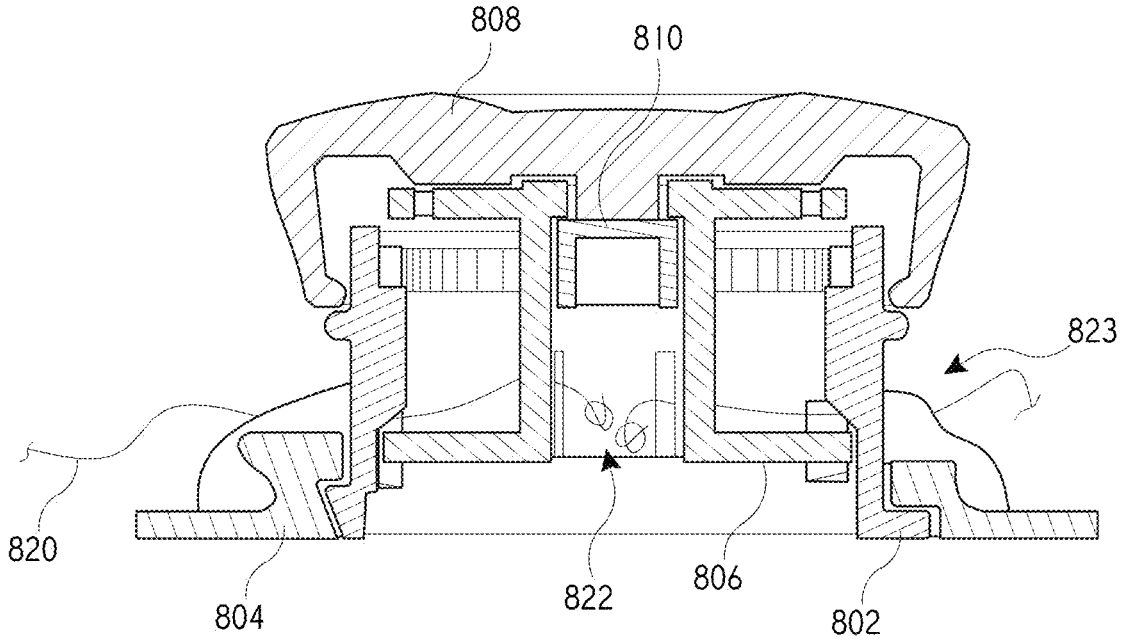
Figure 8F:
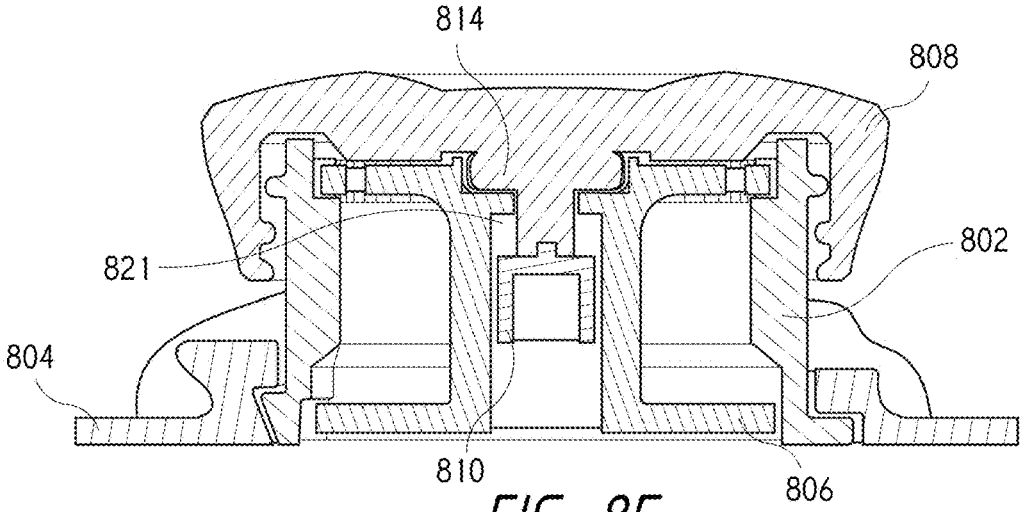
Figure 8G:
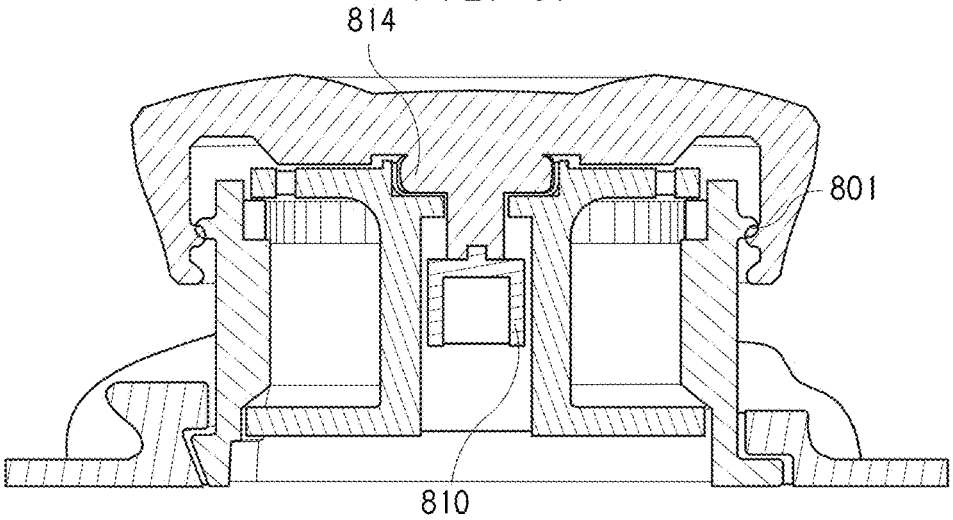
Figure 8H:
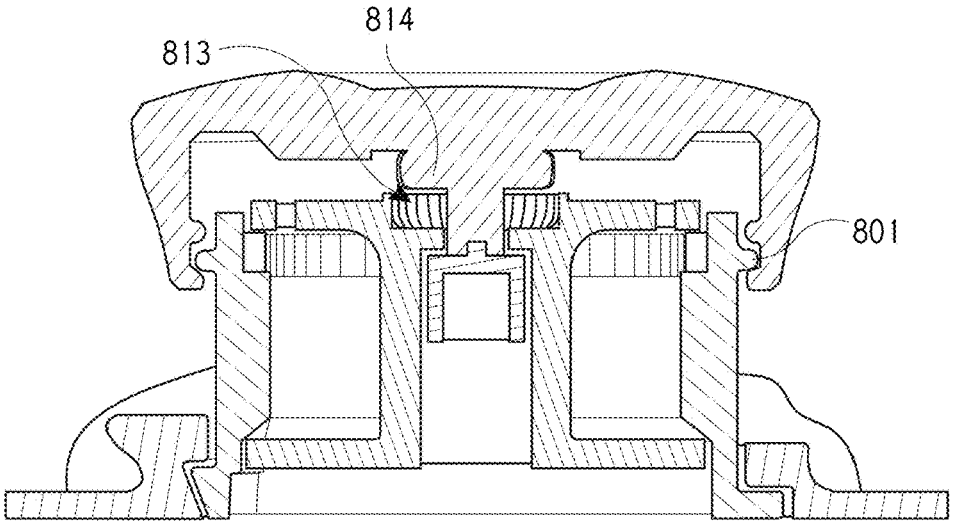

In some embodiments, the spool with pawls 806 may include a plurality of teeth 817 positioned on a top surface that engage and interact with teeth (not shown) positioned within an interior portion of the cover with grip 808. In another embodiment, the cover with grip 808 may include a spline 814 (see FIGS. 8F-I) that engages with the spool with pawls 806. As shown in FIGS. 8F-H, as the cover with grip 808 is first pulled axially upward, friction between the spline 814 and an aperture 813 of the spool with pawls 806 causes the spool to move axially upward to a disengaged position (FIG. 8G) at which point the integrated pawl teeth are retracted from the ratchet teeth of the housing. At this point the user could incrementally unwind lace if desired and push the cover with grip 808 axially downward to the closed position in which the pawls are reengaged with the ratchet teeth. To fully release the spool with pawls 806, the cover with grip 808 may be pulled further axially upward to a second position (FIG. 8H) at which the pawl teeth disengage from the ratchet teeth and the spline 814 is disengaged from the aperture 813, which allows the spool with pawls 806 to freewheel or freely spin/rotate while the cover with grip 808 remains stationary.

To allow the spline 814 to be disengaged from the aperture 813, the shaft 810 may be coupled axially below a lipped portion 821 of the spool with pawls 806 as shown in FIG. 8F. This allows the shaft 810 to travel axially upward a desired distance before disengaging the spline 814 from the aperture 813. Frictional engagement of the spline 814 and aperture 813 causes the pawl teeth 805 to be disengaged from the ratchet teeth 807 via pulling on the cover with grip 808 as previously described. Positioning the shaft 810 axially below the lipped portion 821 may also reduce an amount of "wobble" of the cover with grip 808 of reel assembly 800 providing a benefit over other reel assemblies. In other embodiments, the shaft 810 may be coupled immediately below the lipped portion 821 of the spool with pawls 806 so that any upward axial motion of the cover with grip 808 is transferred to the spool with pawls 806.

As shown in FIGS. 8F-H, in some embodiments, the spool housing flange 801 may include two outwardly extending flanges (not shown) that are configured to hold the cover with grip 808 in a first position in which the spline 814 is disengaged from the aperture 813 and in a second position in which the spline 814 is disengaged from the aperture 813 and in which the pawl teeth 805 are disengaged from the ratchet teeth 807. In other embodiments, the spool housing 802 may include circumferential grooves (not shown) in place of the spool housing fingers 801. A flanged portion of the cover with grip 808 may fit within the circumferential grooves of the spool housing 802 and as the cover with grip 808 is pulled axially upward, the flanged portion may slide into another circumferential groove to hold the cover with grip 808 and any coupled components in an axially raised orientation. In some embodiments, this configuration may allow the cover with grip 808 to be removed without the use of a tool. Removing the cover with grip 808 allows the spool to be exposed and lace to be easily removed and retied or attached to the spool, such as for replacement.

As previously described, in some embodiments, the reel assembly 800 may be removed to replace the lace 820 of the reel assembly. FIGS. 8B-E illustrates one embodiment in which the lace 820 may be replaced. Specifically, the spool housing 802 may include apertures 823 through which the lace 820 is fed or threaded. The spool with pawls 806 may likewise include apertures 822 through which the lace 820 is fed or threaded. In such embodiments, the apertures, 822 and 823, of the spool with pawls 806 and spool housing 802, respectively, may be aligned and the lace 820 fed through the two apertures, either from the reel assemblies exterior or the interior regions. A knot may be tied in the lace 820 that is unable to pass through the apertures 822 of the spool with pawls 806 so as to couple the lace with the spool. In this manner, replacement of the lace 820 is relatively quick, convenient, and easy. In some embodiments, the spool with pawls 806 may include slots instead of apertures 822. The slots may extend from a bottom edge of the spool with pawls 806 axially upward to allow the lace 820 to be slid within the slot during lace replacement.

Figure 81:
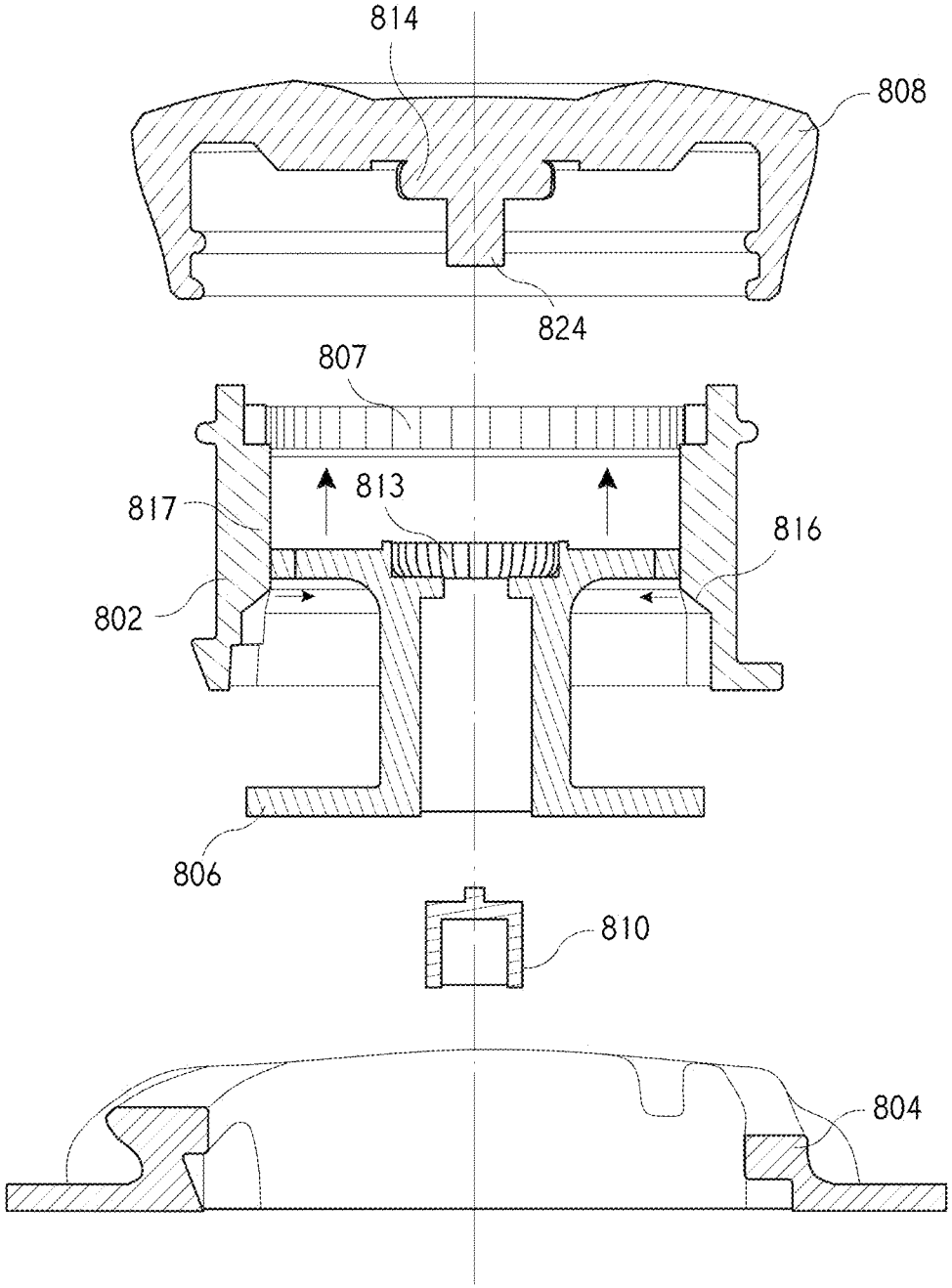
Figure 8J:
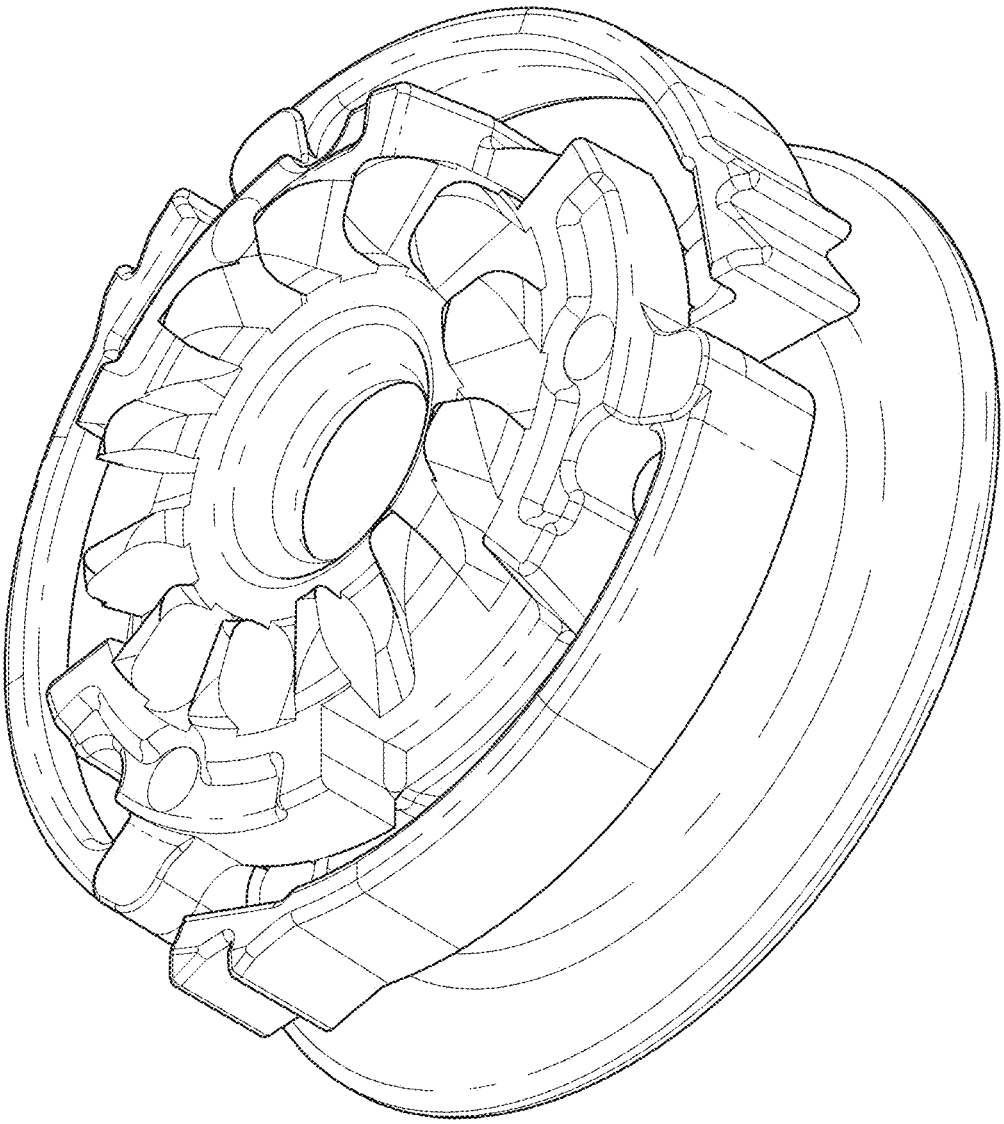
Figure 8K:
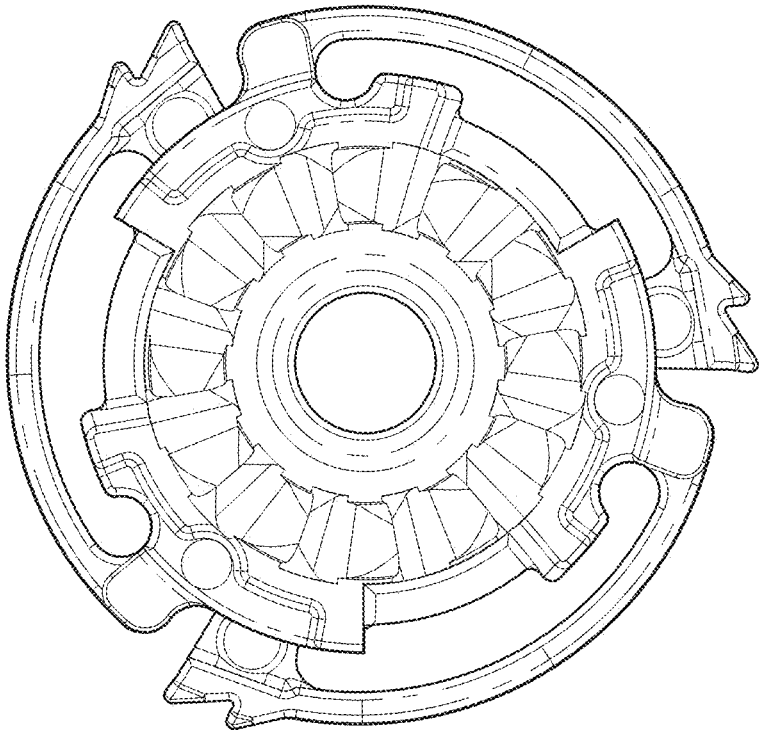
Figure 8L:
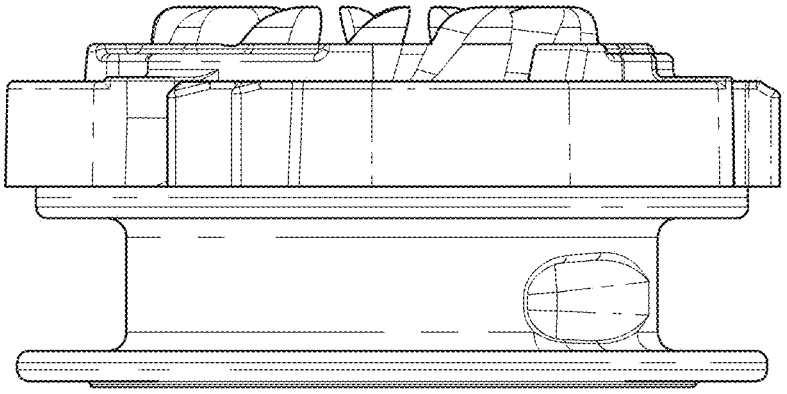

FIGS. 8J-L illustrates the integrated spool with pawls 806 and pawl teeth 805 of reel assembly 800 in greater detail. FIGS. 8B and 81 illustrate a method of assembling the components of reel assembly 800. For example, to assemble the components, the spool with pawls 806 and shaft 810 may be positioned below the spool housing 802. The spool with pawls 806 may then be inserted within a chamber of the spool housing 802 and moved axially upward relative to the spool housing until the pawl teeth 805 are positioned adjacent the ratchet teeth 807 of spool housing 802. To facilitate insertion of the spool with pawls 806 within the spool housing 802, the spool housing may include a ramped or angled portion 816 that is configured to deflect the pawl teeth 805 inwardly around a bottom edge of the ratchet teeth 807. As the pawl teeth 805 are pushed upward adjacent the ratchet teeth 807, the pawl teeth may spring radially outward to engage with the ratchet teeth 807.

The cover with grip 808 may then be inserted over the spool with pawls 806 and spool housing 802 so that a shaft or slug 824 is inserted through a central aperture of the spool. The spline 814 is inserted within the aperture 813 of spool with pawls 806. The shaft 810 may then be inserted through the central aperture of spool with pawls 806 until the shaft 810 contacts the slug 824. The shaft 810 and slug 824 may then be coupled together via sonic welding, adhesive bonding, riveting, heat welding, and the like. Lace may then be fed through the spool with pawls and spool housing and the coupled components may be releasably attached to a bayonet 804 that is coupled with a shoe, brace, or other device or apparel.

In some embodiments, an interior diameter 817 of the spool housing 802 may uniform so that the spool housing does not need to include ramped portion 816. Rather, the pawl teeth 805 may be inwardly deflected prior to inserting the spool with pawls 806 within spool housing 802. The spool with pawls may then be moved axially upward until the pawl teeth 805 deflect radially outward and engage with the ratchet teeth 807. The remaining assembly process may be the same as that previously described.

Figure 9A:
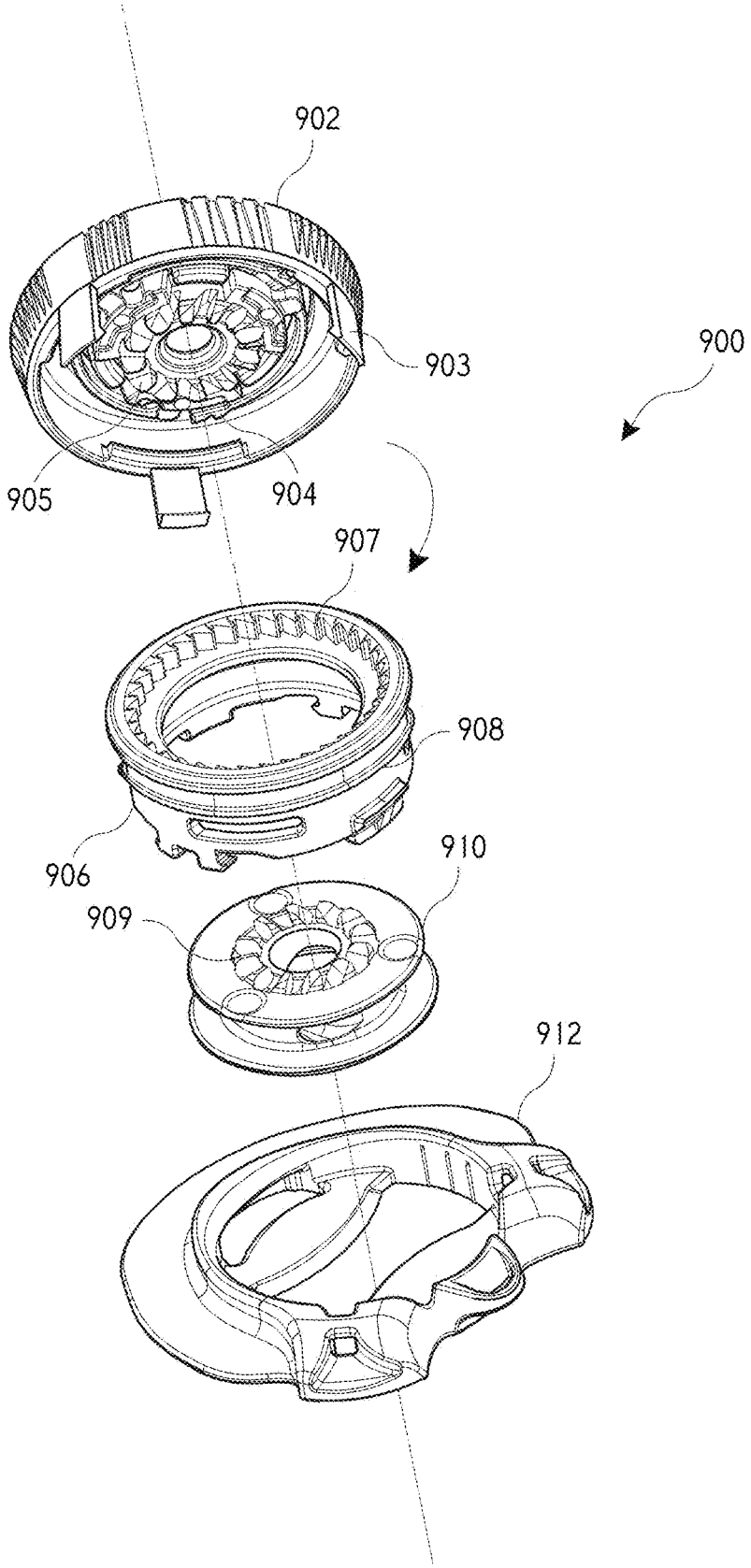
FIGS. 9A-O illustrate various other embodiments of reels assemblies having integrated components and of various reel assembly components.

Referring now to FIGS. 9A-O, illustrated are various other embodiments of reels systems and reel assembly components. FIG. 9A illustrates a reel assembly 900 where several of the components integrated into the knob 902. Specifically, the knob 902 includes knob assembly fingers 903 that function similar to the spool housing fingers (i.e., 606) described in previous embodiments. The knob assembly fingers 903 are configured to fit over the body of spool housing 906 and slip over ridge 908 to hold or maintain the knob 902 in a raised position in which lace (not shown) can be unwound from spool 910 or in an engaged position in which pawl teeth 904 of knob 902 are engaged with ratchet teeth 907 of spool housing 906. The knob assembly fingers 903 may snap into position as the fingers are pressed or pulled over ridge 908. The fingers 903 on the knob eliminate openings in the spool housing 906 making it more difficult for dirt and debris to enter therein. The knob 902 also includes spool teeth 905 that engage with clutch teeth 909 of spool 910 to facilitate winding of the spool. The spool teeth 905 disengage from teeth 909 when the knob 902 is in the axially raised position. A pawl disc is incorporated into the knob 902. In some embodiments, a pawl disc or mechanism may be snap fit into an interior portion of the knob 902. In other embodiments, the pawl disc or mechanism may be may be sonically welded, adhered, or otherwise coupled with the knob 902 or pawl mechanism features may be molded into the knob. The knob 902, or any of the other caps described herein, may also include grip features on its exterior surface that allow for improved feel and/or grip ability.

As is evident with reference to FIG. 9A, when tension is applied to the lace, the rotational force of spool 910 is transferred to the knob 902 via interaction between teeth 909 and spool teeth 905. This force is in turn transferred to spool housing 906 via interaction between the pawl teeth 904 and ratchet teeth 907. Since the pawl teeth 904 deflect inwardly as the knob is rotated to wind the lace, the pawl teeth make a clicking noise when the knob 902 is turned to wind the lace about spool 910.

As previously described, the spool housing 906 includes an aperture (not numbered) that allows the lace to exit the spool housing. The geometry of the aperture may be configured to prolong the life of the lace. Similarly, the spool 910 includes a lace attachment method, such as the previously described apertures or slots. In one embodiment, the components of reel assembly 900 may be assembled by attaching the knob 902 and pawl mechanism or knob core via snap fitting or other methods. Lace may then be inserted through the lace exits (i.e., aperture) of the spool housing 906 inwardly and attached to the spool 910. The lace may then be pulled tight to seat the spool 910 into the body of the spool housing 906. The spool housing 906 may then be attached to a bayonet 912. The knob 902 may then be snapped onto the spool housing 906 by applying pressure until the knob assembly fingers 903 clear ridge 908 surrounding the outer diameter of spool housing 906.

Figure 9B:
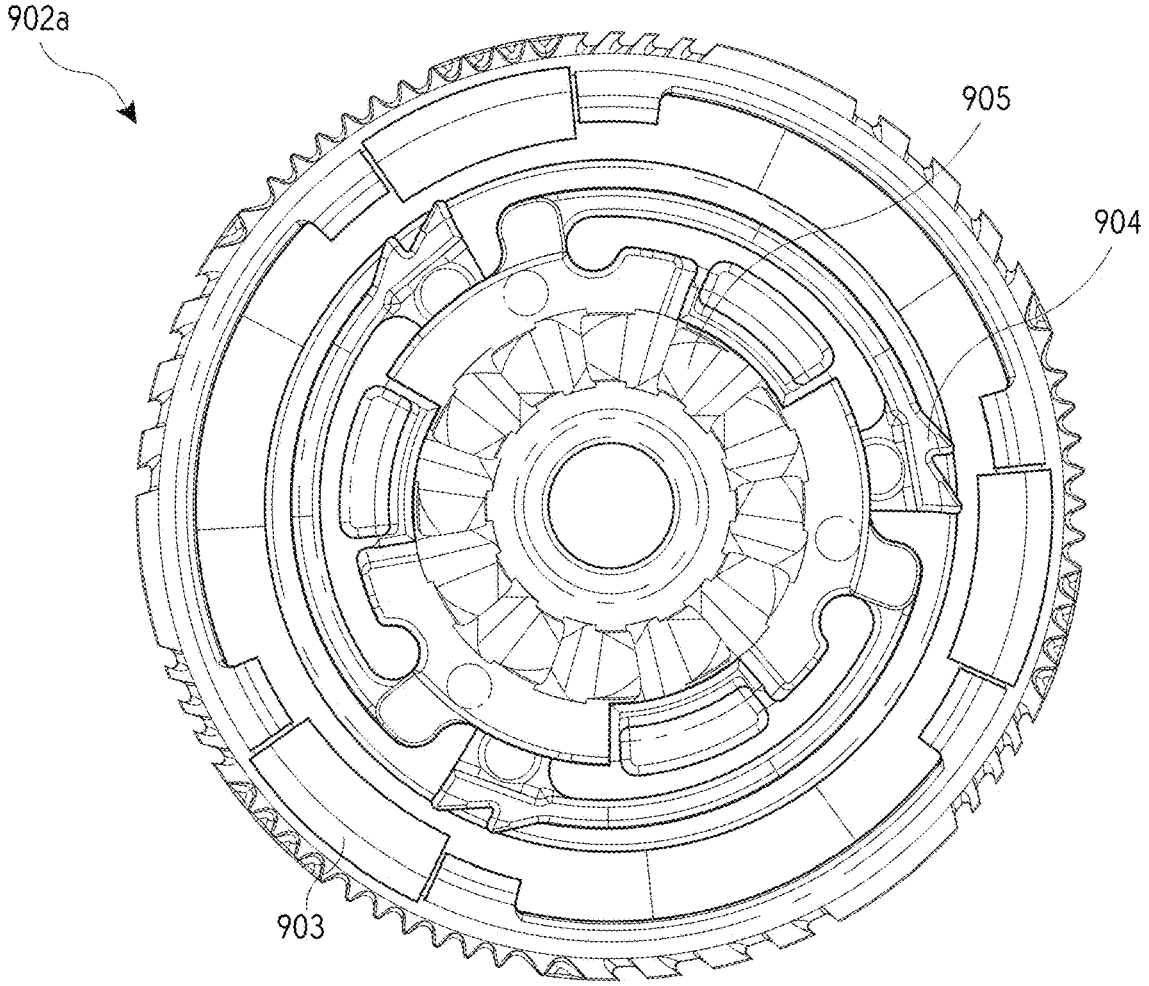
Figure 9C:
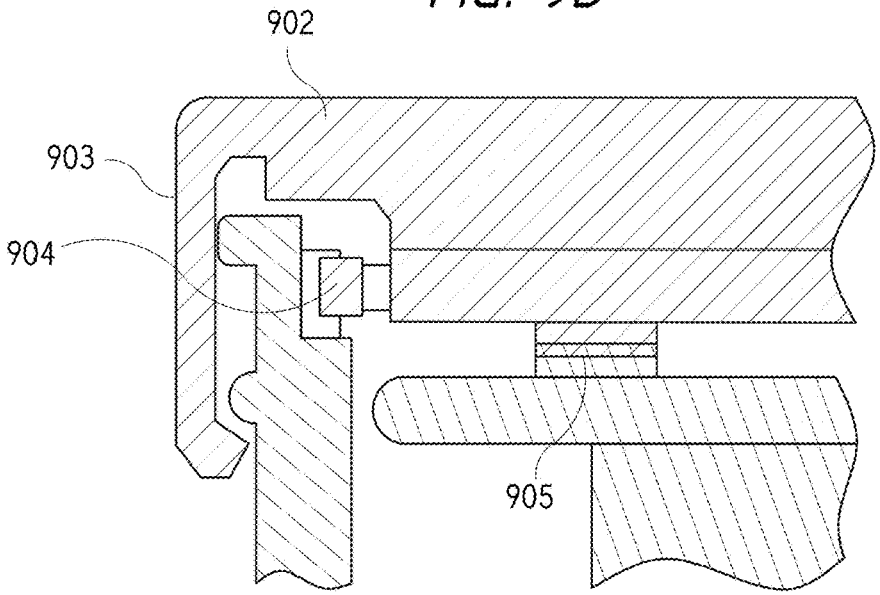

FIG. 9B illustrates a bottom view of the knob 902 and further illustrates the various integrated components of knob 902. FIG. 9C illustrates the fingers 903 of the knob 902 positioned over the flange of the spool housing. FIG. 9C further illustrates engagement of the pawl teeth 904 and ratchet teeth and spool teeth 905 and clutch teeth.

Figure 9D:
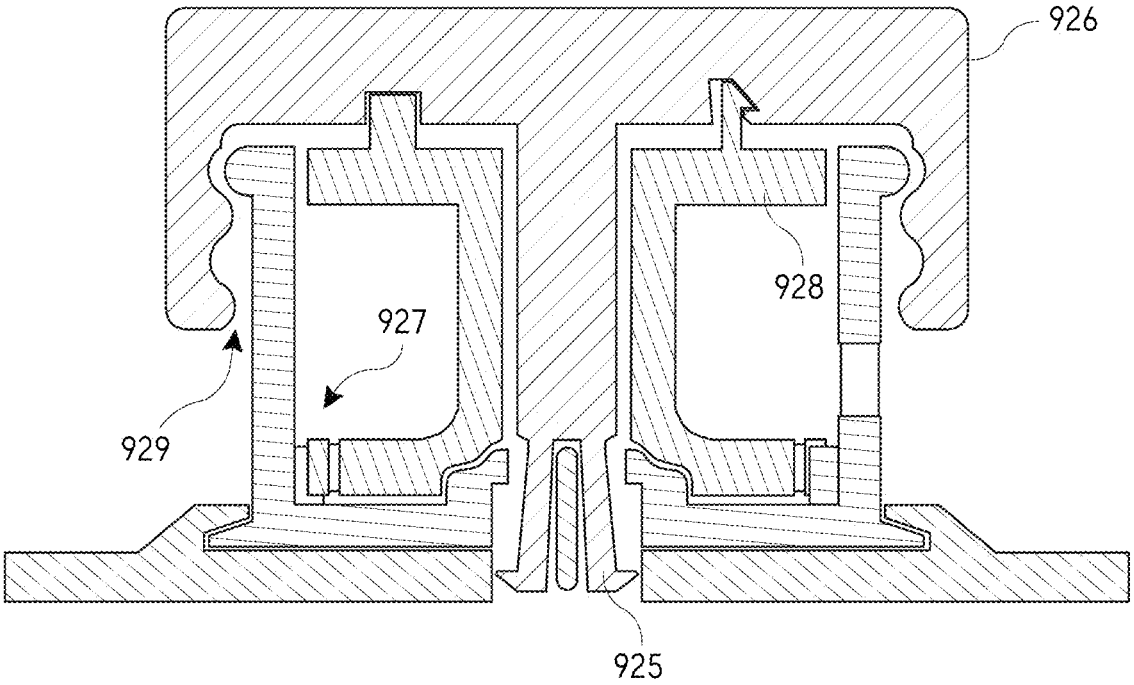
Figure 9E:
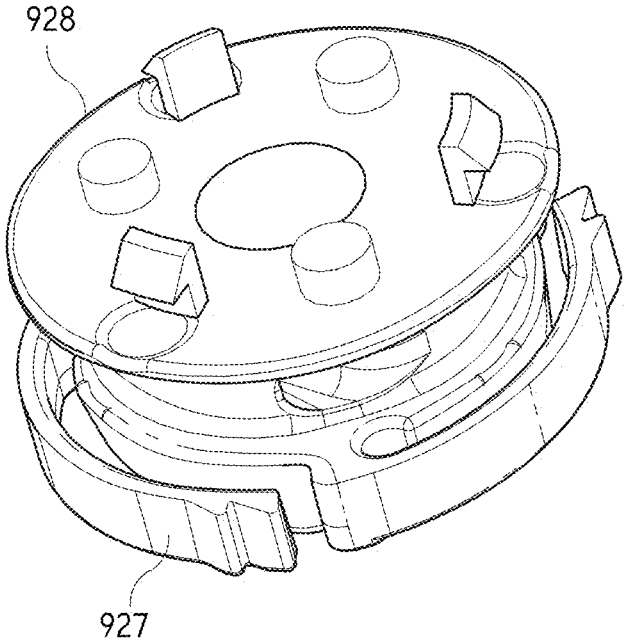
Figure 9F:
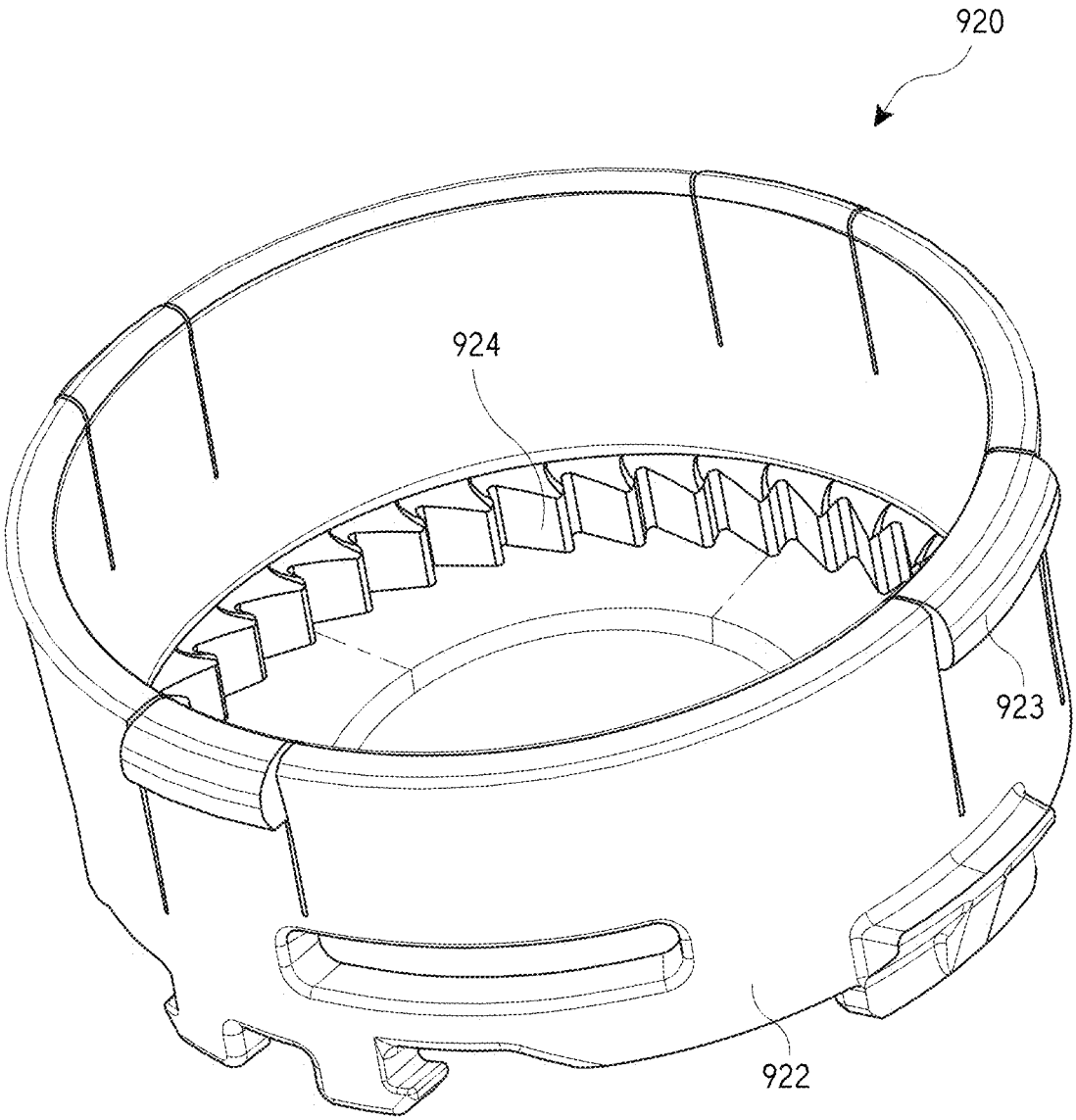

FIGS. 9D-F illustrate another embodiment of a reel assembly 920. Reel assembly 920 includes a spool housing 922 having spool housing fingers 923 as previously described. Spool housing 922 also includes ratchet teeth 924 that engage with pawl teeth. The ratchet teeth 924 of spool housing 922 are positioned near a bottom surface of the spool housing 922. As in some of the previous embodiments, the pawl teeth 927 may be integrated with the spool 928, but positioned on a bottom flange of the spool 928. The spool may be inserted within the spool housing 922 and a knob 926 positioned over the components. Knob 926 may include circumferential grooves 929 that engage with a flanged portion of the spool housing fingers 923 to allow the knob 926 to be rotated relative to spool housing 922. A centrally positioned slug 925 of knob 926 may be inserted through an aperture of spool housing 922 to couple the components together. Knob 926 may engage with spool 926 via interaction between teeth (not shown), a clutch (not shown), and the like.

Figure 9G:
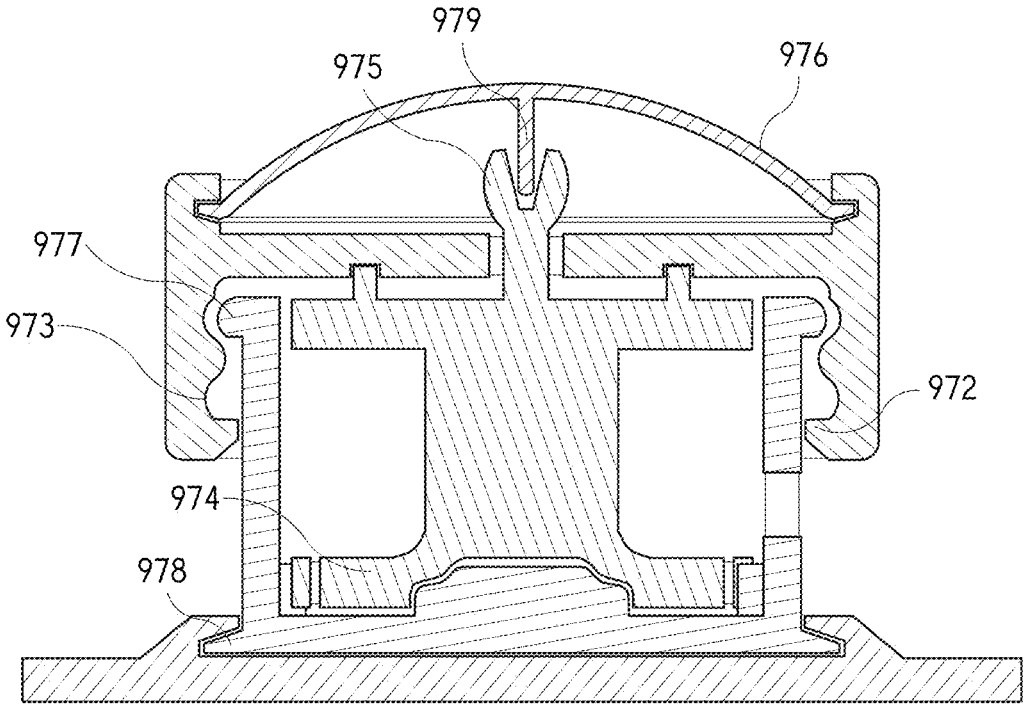
Figure 9H:
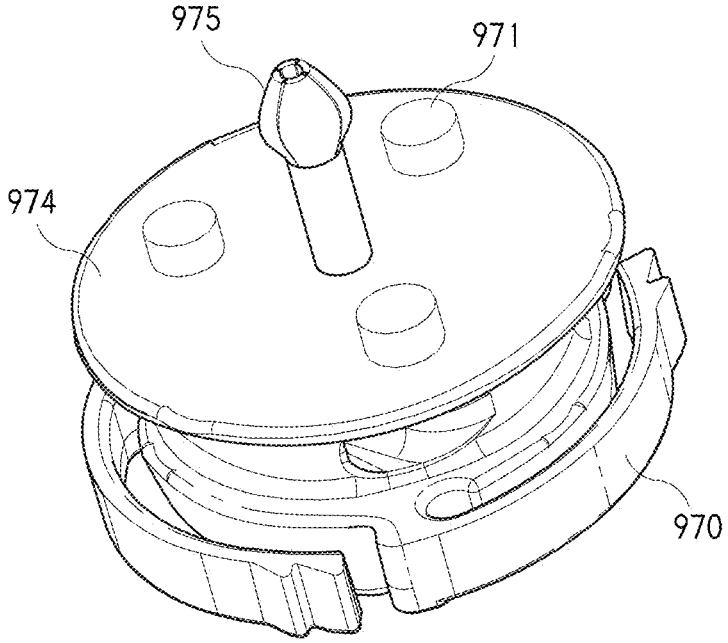
Figure 9J:
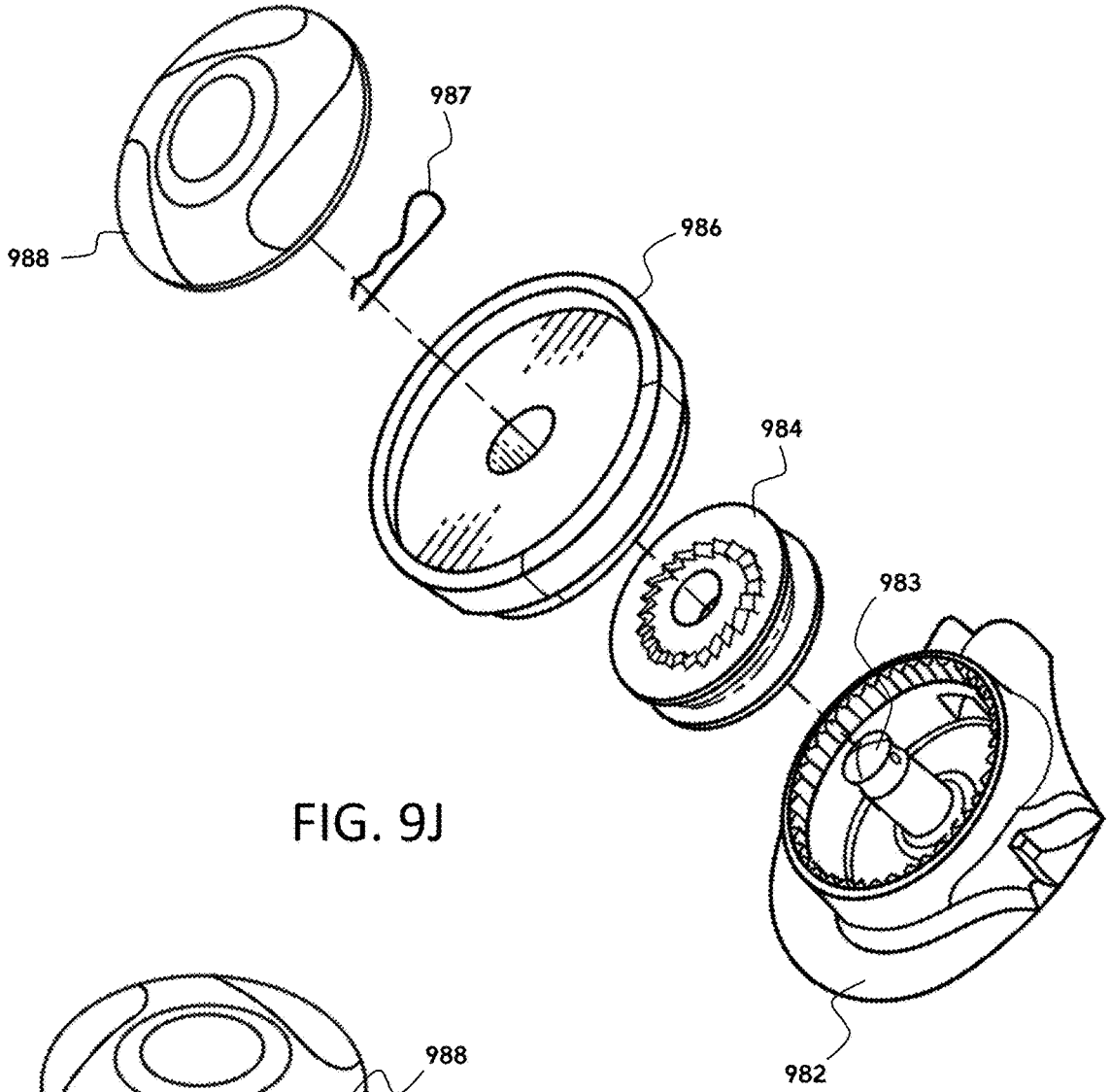
Figure 9K:
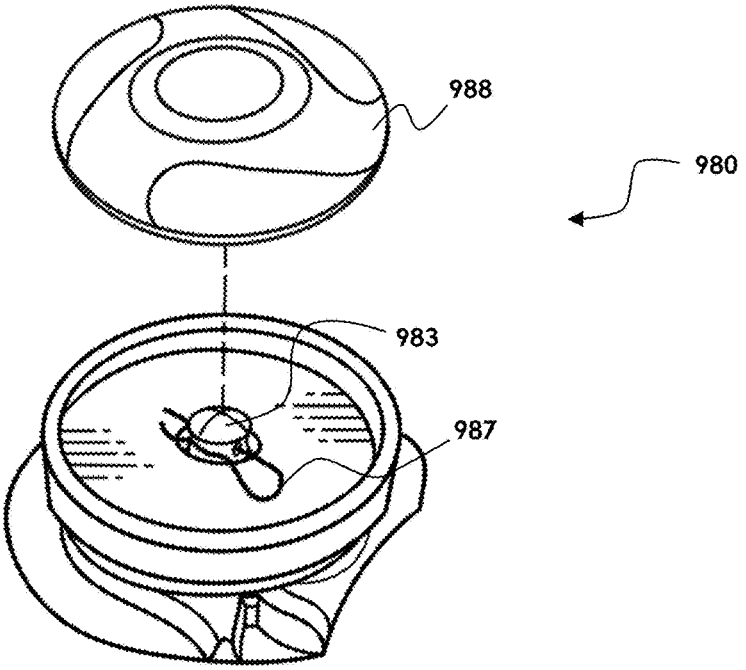
Figure 9L:
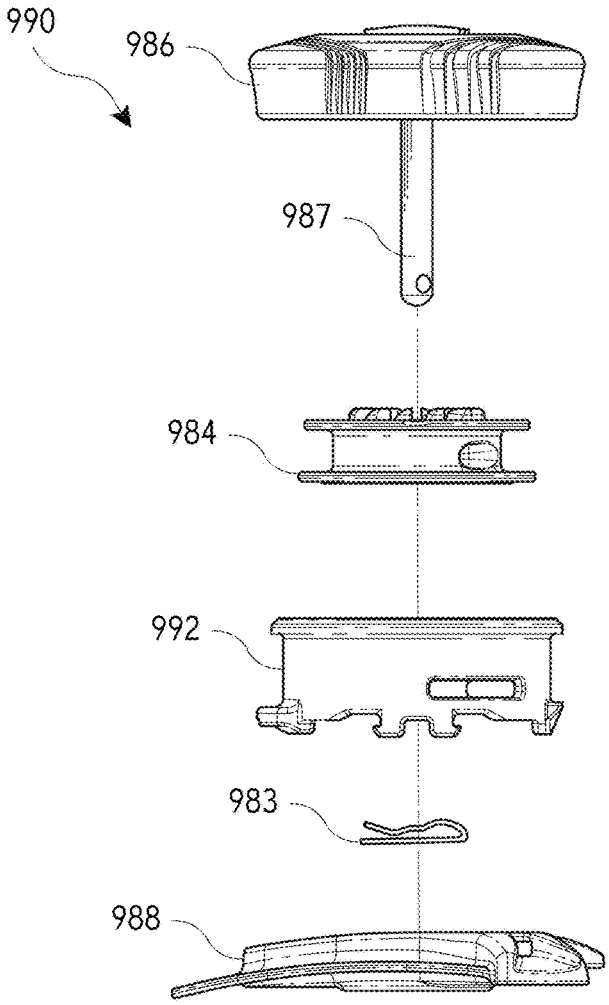
Figure 9M:
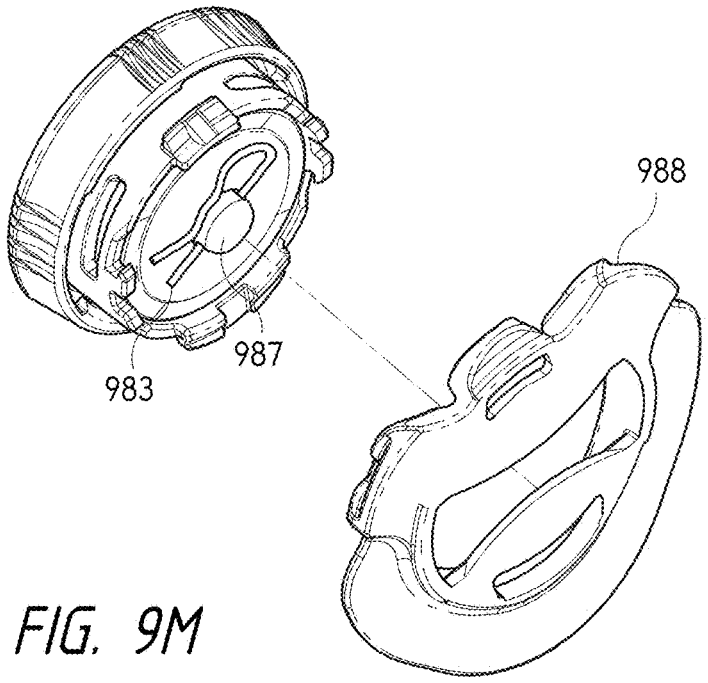
Figure 9N:
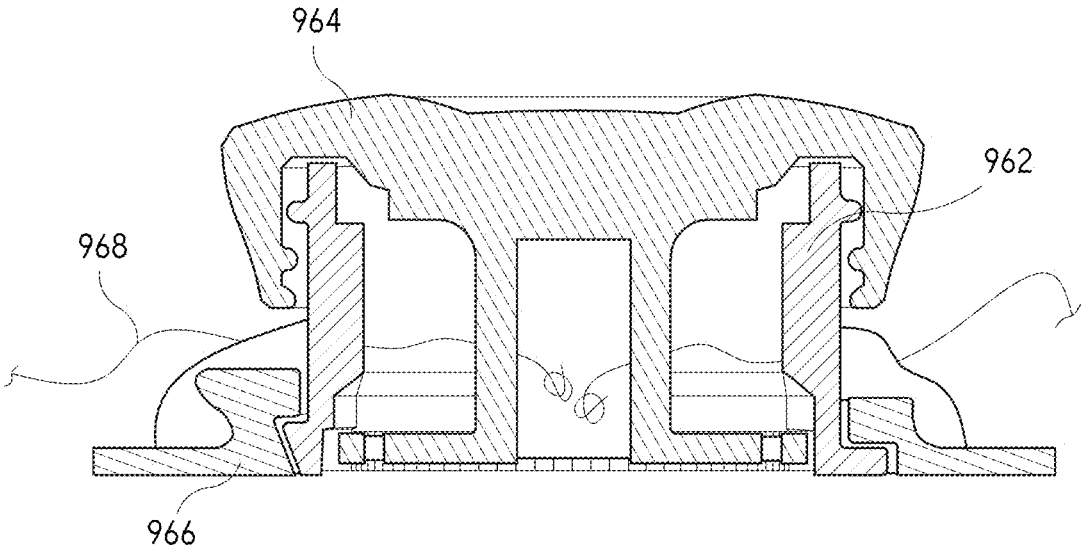
Figure 90:
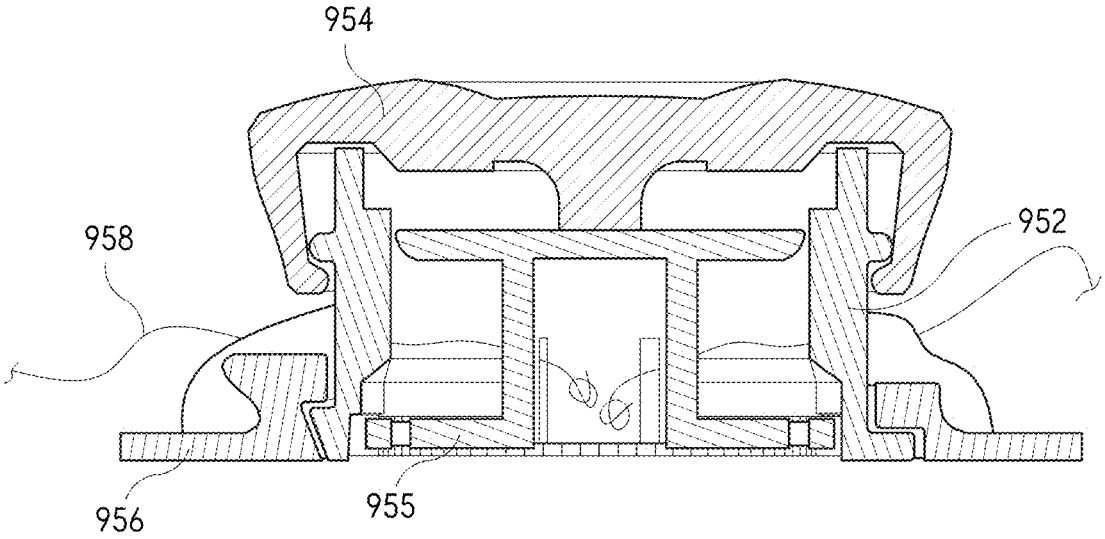

FIGS. 9N and 9O illustrate another embodiment of reel assemblies. Specifically, FIG. 9O illustrates a first reel assembly that includes a spool housing 952, a knob 954, a spool 955, and a bayonet 956. Pawl teeth and ratchet teeth of the spool 955 and spool housing 952 may engage and interact to provide the one-way ratchet motion described herein. The pawl teeth may be integrated with either the spool 955 or spool housing 952 with the ratchet teeth integrated with the other component as previously described. The spool housing 952 may also include spool housing fingers or springs that engage with the circumferential grooves or flanges of the knob 954 to hold the knob and spool in an orientation wherein the pawl teeth are disengaged from the ratchet teeth to allow lace to be unwound from the spool 955. In some embodiments, the knob 924 may be permanently coupled with the spool 955 via adhesive bonding, welding, and the like. In other embodiments, the knob 954 may be removably coupled with the spool 955 such as via a snap fit, press fit, and the like. FIG. 9N illustrates a reel assembly that is similar to the reel assembly of FIG. 9O except that the knob and spool are integrated into a single component 964 that is inserted within spool housing 962. The reel assemblies of FIGS. 9N and 90 may be removably coupled with a bayonet, 956 and 966 respectively, to allow lace, 958 and 968 respectively, to be coupled with the spool.

Figure 91:
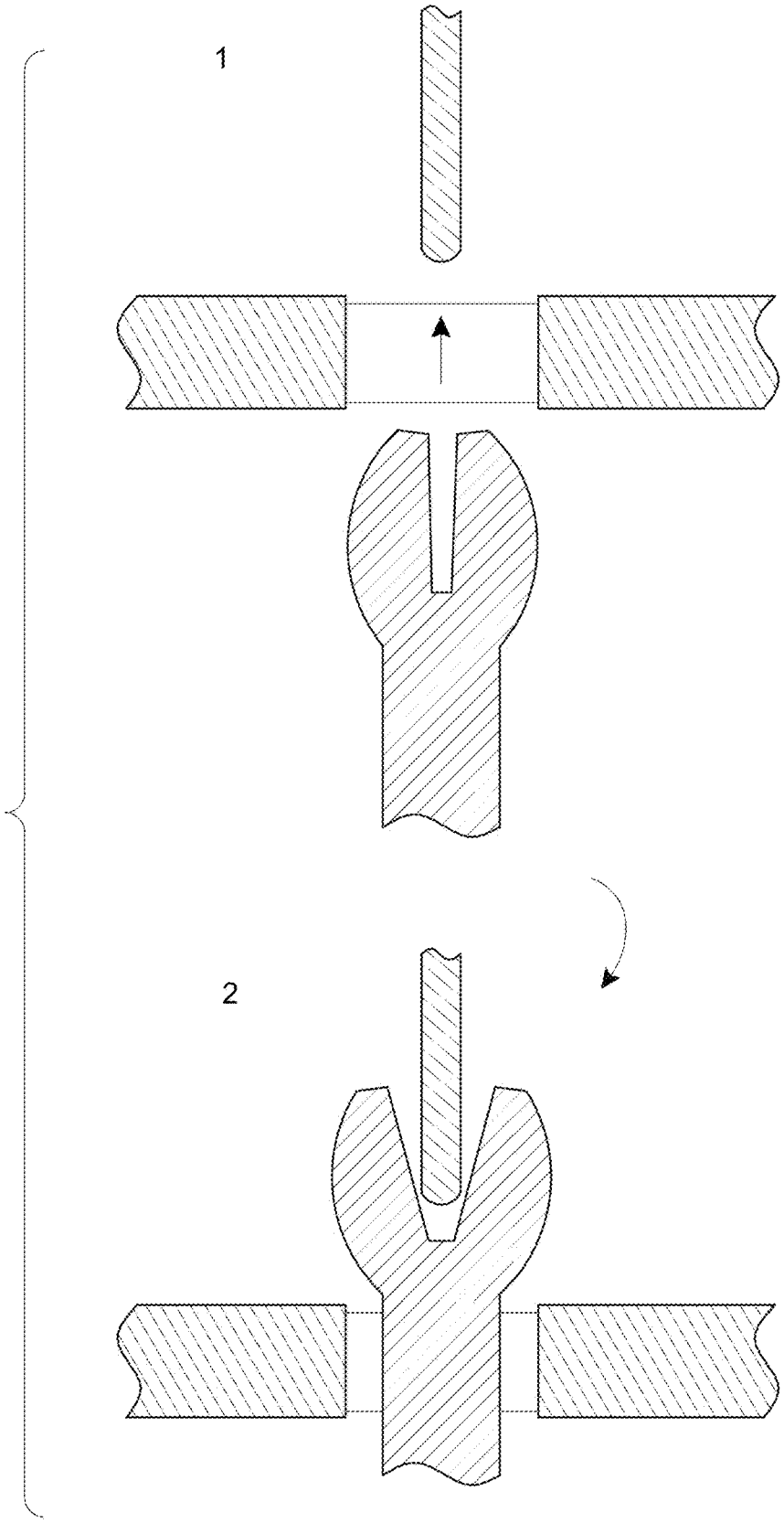

FIGS. 9G-I illustrate another embodiment of a reel assembly. Unlike other embodiments, the spool 974 of the reel assembly is indirectly coupled with the spool housing 972. For example, the spool 974 includes a slug 975 positioned near its top surface. Slug 975 is inserted through an aperture of spool housing 972 and coupled with a dart 979 or plug of a cover 976 that is in turn coupled with the spool housing 972 such as by inserting edges of the cover 976 within an interior groove of spool housing 972. As shown in FIG. 91, the slug 975 includes expanding barbs that expand and fit over the dart 979 as the components are pressed together. As the barbs expand, the slug 975 becomes too large to fit through the aperture of spool housing 972, thereby locking the spool 974 in place relative to spool housing 972. The top surface of the spool 974 includes drive component 971 that are insertable within corresponding recesses (not numbered) of the spool housing 972. The drive component 971 transfer torque from the spool housing 972 to the spool 974.

The spool housing 972 is then coupled with a bayonet 978 such as by pressing an inwardly facing flange 973 of spool housing 972 over an outwardly facing flange 977 of bayonet 978. Alternatively, the inwardly facing flange 973 may be pressed onto a circumferential groove (not shown) of bayonet 978 or vice versa. In operation, the spool housing 972 could be turned and the rotational motion transferred to spool 974 via drive component 971, which may include teeth (not shown), a frictional force between slug 975 and dart 979, a clutch mechanism, and the like. The spool housing and bayonet could include a pawl teeth 970 and ratchet teeth (not numbered) arrangement that allow for the described one-way ratchet motion.

Referring now to FIGS. 9J and 9K, illustrated is an embodiment 980 that shows a method of coupling the components of a reel assembly together. As described herein, the reel assembly may include a spool housing 982, a spool 984, one or more other components 986 (e.g., a pawl disc, dial, integrated knob and pawl mechanism, and the like), and a knob 988. The spool housing 982 may include a centrally located shaft 983 that may be inserted through an aperture of one or more of the components (e.g., spool 984 and component 986). The shaft 983 may have a radially extending aperture through which a pin 987 (e.g., cotter pin) may be inserted to lock the components in place. The knob 988 may then be coupled with the spool housing 982 covering the pin 987 and shaft 983.

Referring now to FIGS. 9L and 9M, illustrated is another embodiment 990 of coupling the components of a reel assembly together. Embodiment 990 is similar to embodiment 980 in that the reel assembly may include a spool housing 992, a spool 984, another component (e.g., a pawl disc, dial, integrated knob and pawl mechanism, and the like—not shown), and a knob 986 or cap. Unlike embodiment 980, the knob 986 includes the shaft 987 which is inserted through an aperture of the other components. A pin 983 may inserted through the shaft 987 on a bottom side or surface of spool housing 992 to couple the components together. The coupled components may then be coupled with a bayonet 988 as described herein.

Figure 10A:
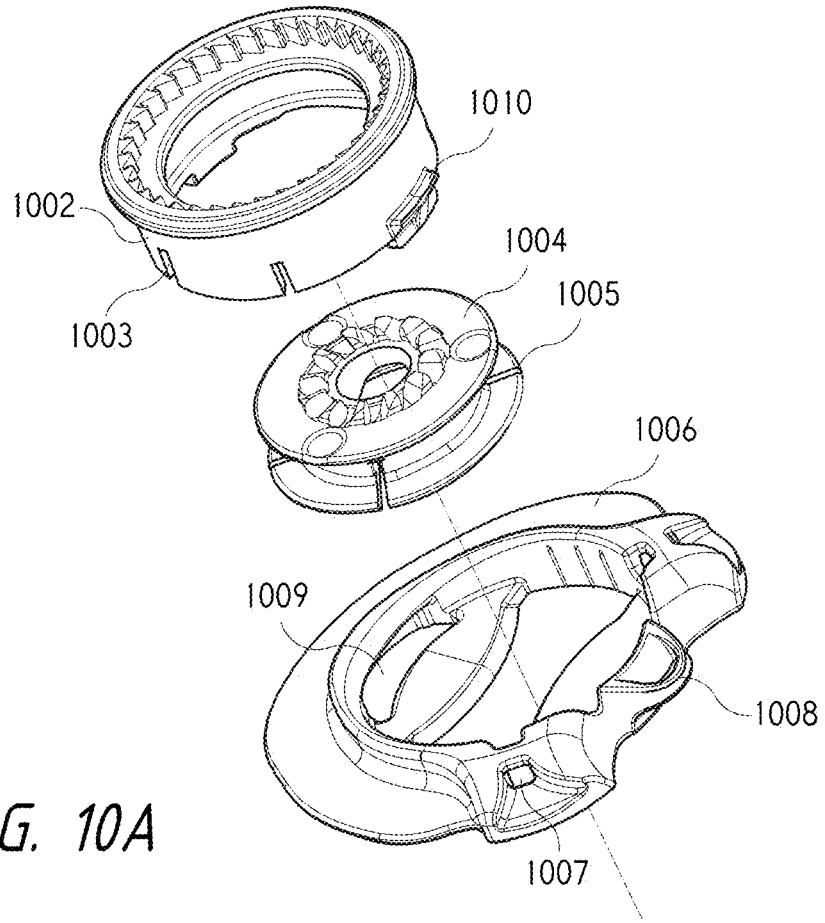
FIGS. 10A-B illustrate an embodiment of a spool housing that may be coupled with multiple bayonets.
Figure 10B:
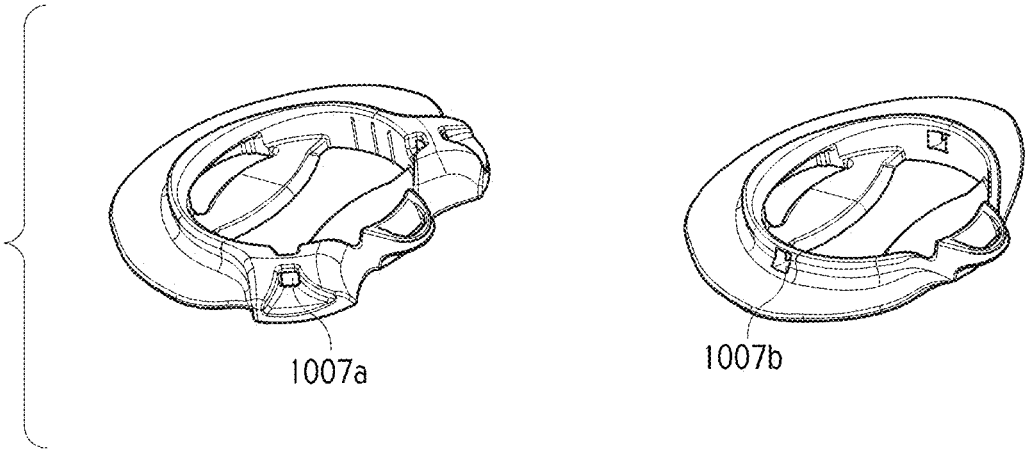
Figure 10C:
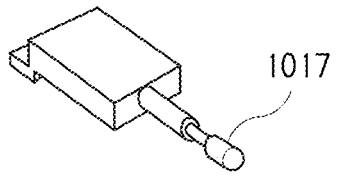
FIGS. 10C-H illustrate embodiments of coupling a lace with a spool housing in order to facilitate easy lace attachment and/or replacement.

Referring now to FIGS. 10A and 10B, illustrated is an embodiment of a spool housing 1002 that may be coupled with multiple bayonets 1006. As described herein, a spool 1004 is inserted within spool housing 1002 from an open bottom end and is operated via a reel assembly (not shown). The spool 1004 and spool housing 1002 include slots, 1005 and 1003 respectively, that allow the lace (not shown) of the lacing system to be quickly and easily replaced as described herein. For example, the lace may be easily slid within the slots, 1003 and 1005, of the spool housing 1002 and spool 1004 and then coupled with the spool 1004.

The spool housing 1002 also includes a tab or coupling component 1010 that allows the spool housing 1002 to be removably coupled with the bayonet 1006. To removably couple the components, the tab 1010 may be pressed downward against a coupling protrusion 1008 of the bayonet 1006. Another tab (not shown) that is positioned on an opposite side of the spool housing 1002 may be inserted within a recess 1009 of the bayonet 1006 to lock the spool housing 1002 in position relative to the bayonet 1006. The bayonet 1006 also includes channels or ports 1007 through which the lace is inserted so as to be accessible to the spool housing 1002 and spool 1004.

As shown in FIG. 10B, the bayonet 1006 may be available in multiple styles or configurations. For example, the bayonet 1006 may be available with various channels or ports 1007 configurations. In one embodiment, the ports 1007*b* may be spaced roughly 180 degrees apart so that the two lace ends exit the reel assembly roughly opposite one another. In another embodiment, the ports 1007*a* may be angularly offset by some desired degree so that the two lace ends are similarly offset. In other embodiments, the ports may have an angled configuration (e.g., 90 degree bend and the like) so that the lace enters the ports and bends before accessing the spool housing 1002 and spool 1004.

In some embodiments, the spool housing 1002 and/or the spool 1004 may include multiple slots, 1003 and 1005, to allow the spool housing 1002 and/or the spool 1004 to be removably coupled with multiple bayonets 1006 having various port 1007 configurations. The configuration of the ports 1007 and/or slots, 1003 and 1005, may allow a single spool housing 1002 to be coupled with various bayonets 1006 so as to provide a desired lace path or pattern.

Figure 10D:
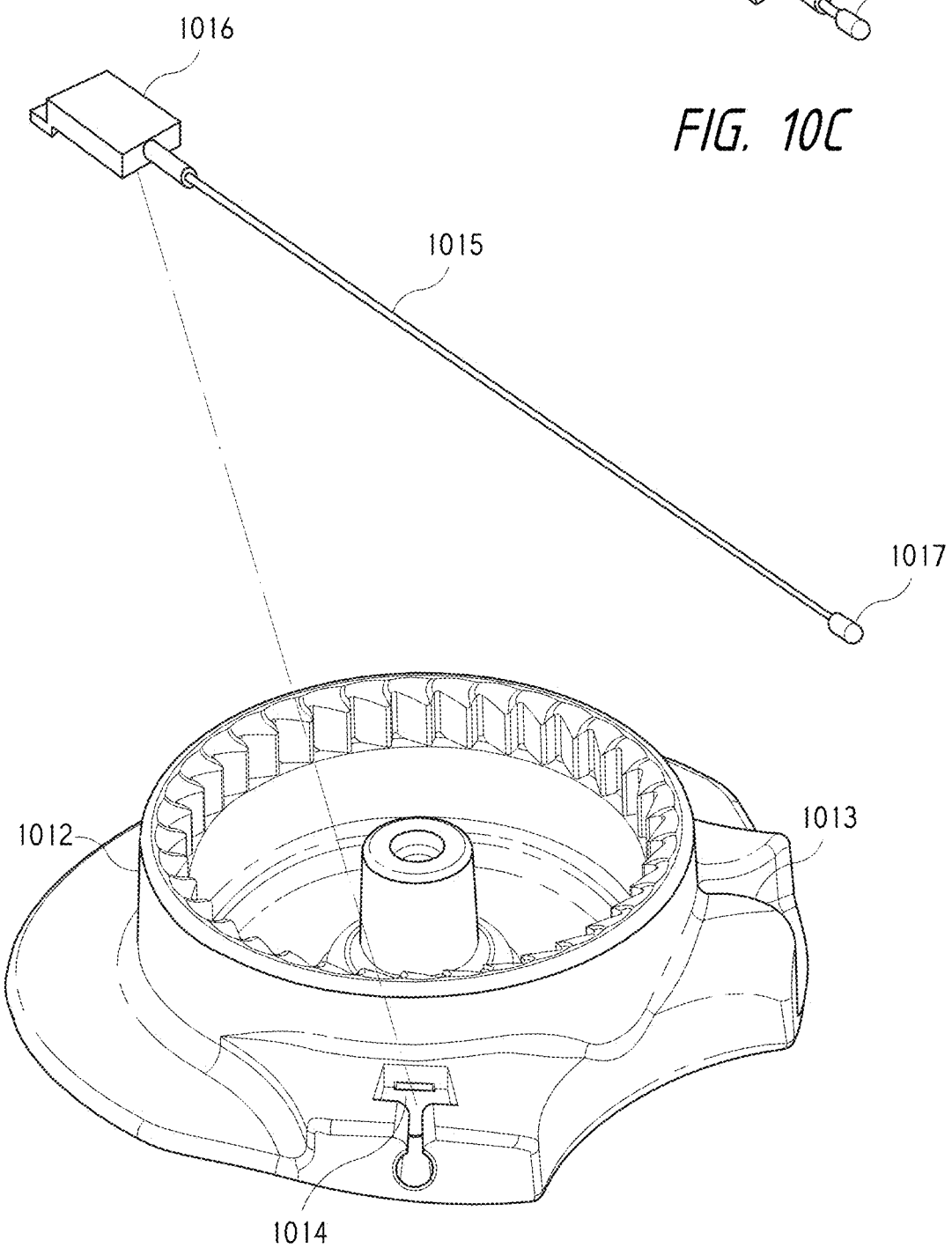
Figure 10E:
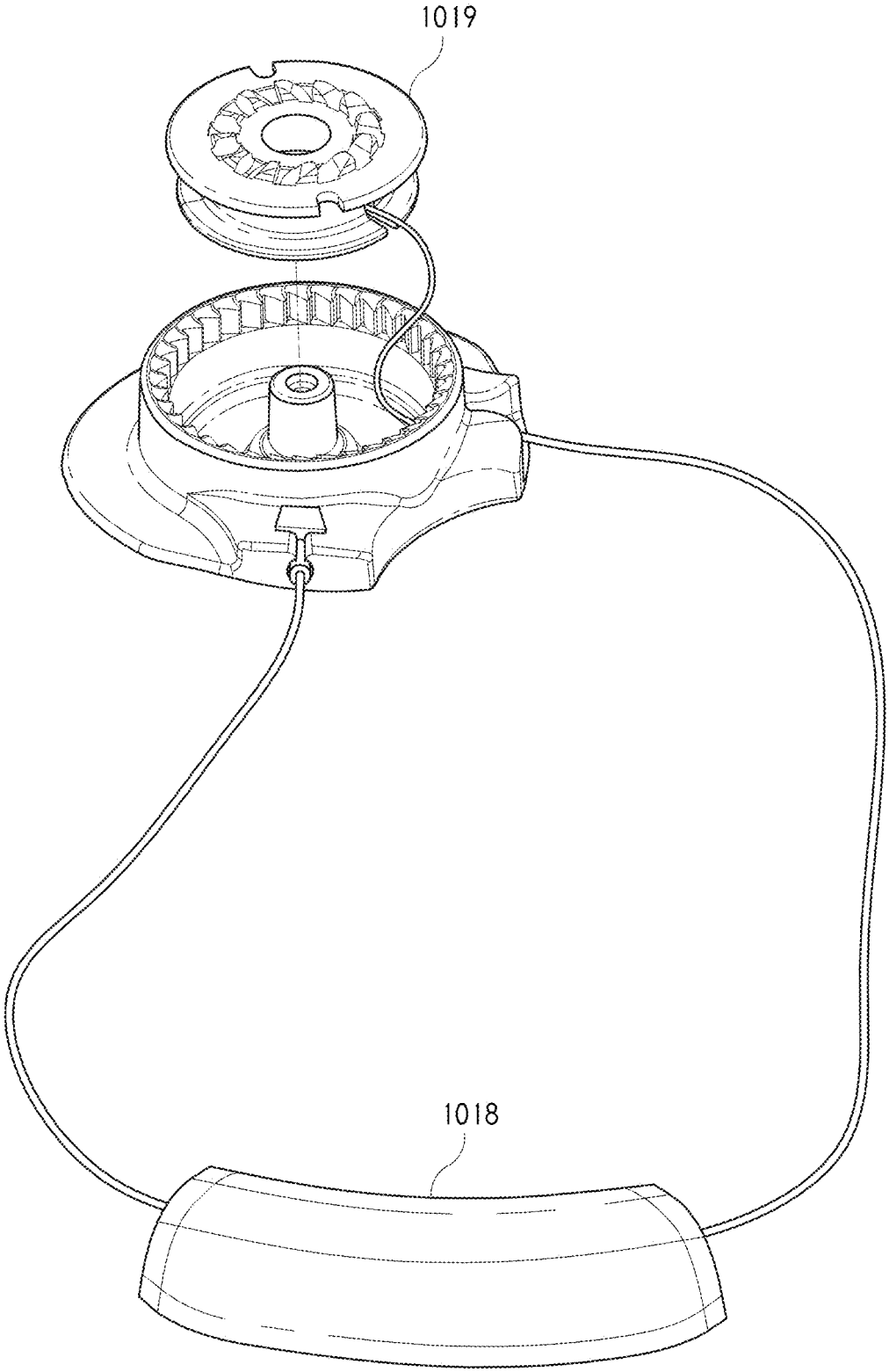

Referring now to FIGS. 10C-H, illustrated are embodiments of coupling a lace with a spool housing in order to facilitate easy lace attachment and/or replacement. FIG. 10D illustrates one embodiment of a spool housing 1012 that includes a recess 1014 within which a base 1016 of a lace components fits. The base 1016 may be inserted within the recess 1014 to couple the lace component with the spool housing 1012. In some embodiments, the base 1016 is removable from recess 1014 to allow the lace to be replaced. In other embodiments the base 1016 may be permanently coupled within recess 1014.

Lace 1015 extends from base 1016 and includes a plug or slug 1017 that is coupled at a distal end of the lace 1015. In some embodiments, a length of the lace 1015 may be predetermined so that an appropriate lacing component may be selected based on the intended application. In another embodiment, the lace length may be varied or adjusted, such as by submerging nylon lace in heated water and pulling on the slug 1017 to stretch the nylon lace. After an appropriate length of lace 1015 is selected, or the lace length is adjusted as desired, the base 1016 may be coupled with the recess and the lace 1015 wound around one or more guide components 1018. The slug 1017 and distal end of the lace 1015 may then be inserted through one or more channels or ports 1013 of the spool housing 1012 and coupled with a spool 1019, such as by inserting the slug through a slot of the spool 1019 as described herein. The slug 1017 may be sized larger than the slot of the spool 1019 to prevent the lace from uncoupling from the spool 1019. Spool housing 1012 allows the lace 1015 to be easily removed and replaced as needed.

Figure 10F:
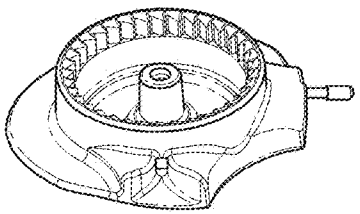
Figure 10G:
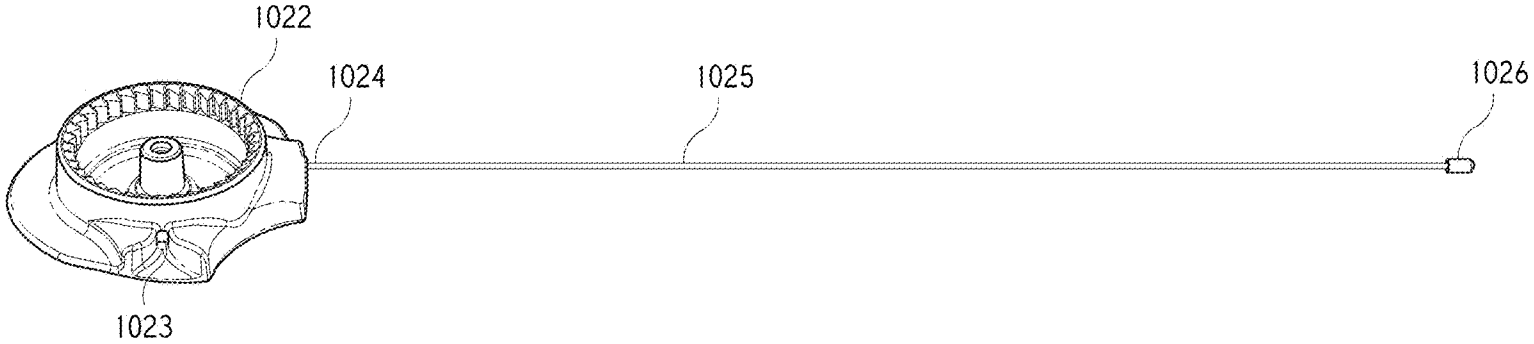
Figure 10H:
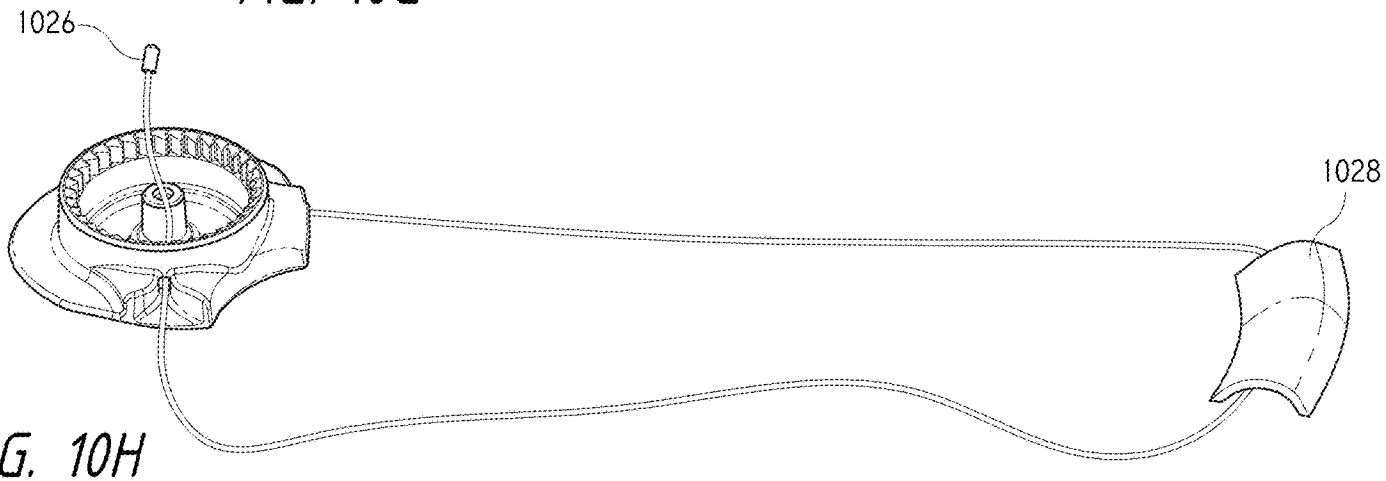

FIGS. 10F-H illustrate a similar embodiment of a spool housing 1022 except that the lacing component is integrally formed with the spool housing 1022. Specifically, the base 1024 of the lacing component is integrally formed with the spool housing 1022 or otherwise fixedly coupled to the spool housing 1022 via rf welding, adhesive bonding, inserting molding, and the like. A tension member or lace 1025 extends from the base 1024 and includes a slug 1026 coupled with a distal end as previously described. The lace length may be a predetermined amount, or may be varied or adjusted such as by submerging nylon lace in near boiling water, which may raise the temperature of the spool housing to above a threshold temperature at which forming the lace 1025 is possible. Stated differently, the lace 1025 is formed by elongating and deforming a material of the spool housing 1022. The slug 1026 may facilitate in forming the lace 1025 by providing a feature that may be gripped and tensioned in elongating and deforming the spool housing's material. The lace 1025 may be wound around one or more guides 1028, inserted through one or more ports 1023 of spool housing 1022, and subsequently coupled with a spool (not shown). The spool housing components of FIGS. 10C-H provide a single "active" lace, or in other words, a single lace end that is tensioned via a reel assembly or tightening component.

According to one embodiment, a method of forming tension member of a lacing system includes securing a material of a base portion (e.g., spool housing) and elongating the material of the base portion to form a tension member having a proximal end that is integrally attached to the base portion and a distal end opposite the proximal end. The method also includes coupling the distal end of the tension member with a spool. As described herein, the is configured for gathering the tension member to tighten an article. The method additionally includes operationally coupling the spool with a tightening component so that operation of the tightening component causes the spool to gather the tension member and thereby tighten the article. In some embodiments, securing the material of the base portion is accomplished by gripping a grip feature of the base portion, such as the above described slug. The grip feature/slug facilitates in elongating of the base portion's material. In some embodiment, elongating the material of the base portion is achievable while the material is above a threshold temperature, such as by placing the base portion in boiling water and the like.

Figure 11A:
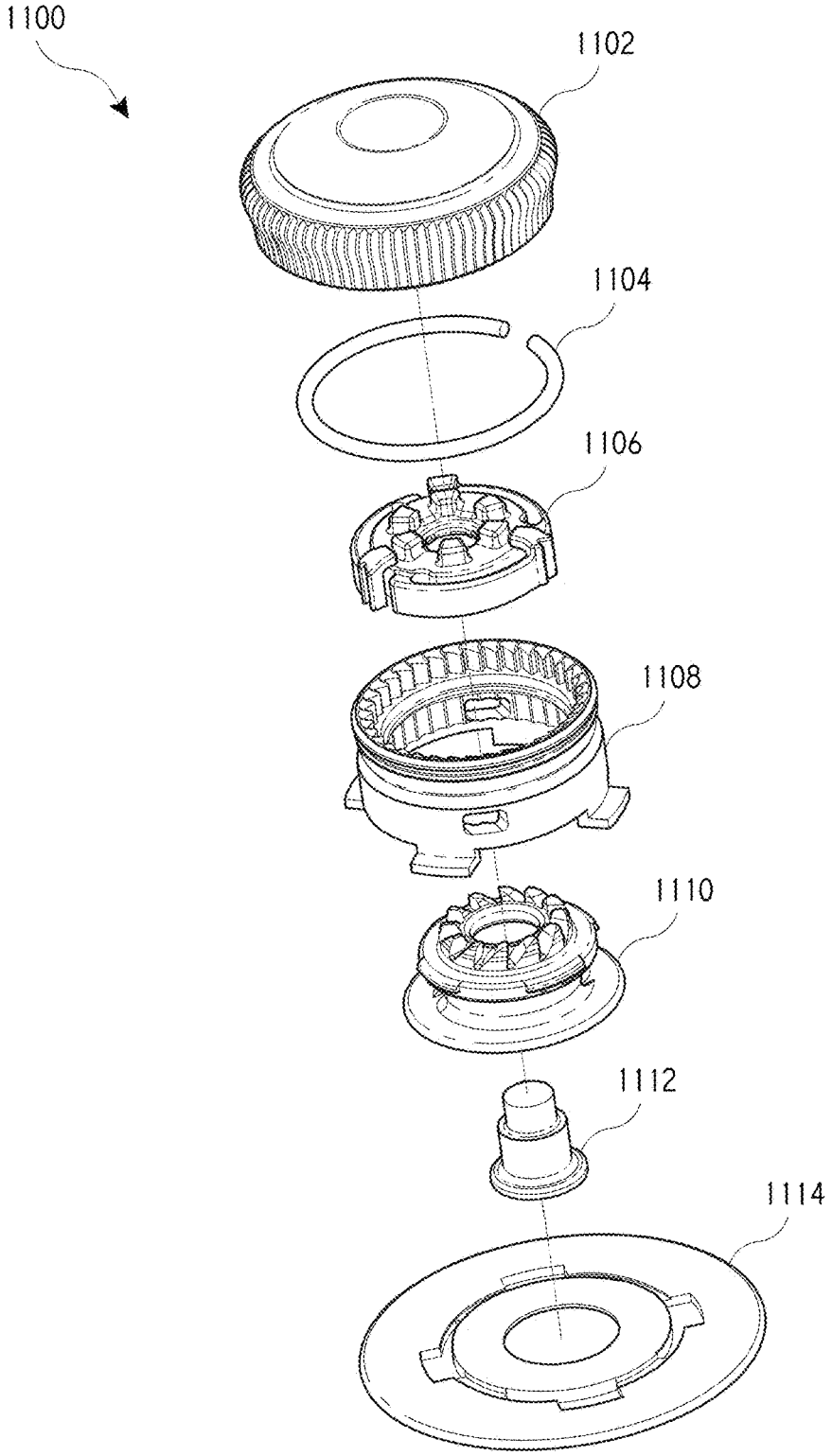
FIGS. 11A-P illustrate another embodiment of a reel assembly having various integrated components.
Figure 11B:
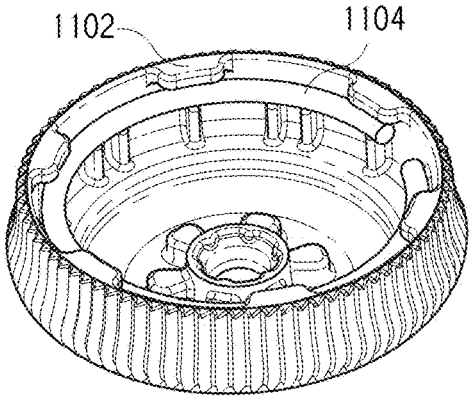
Figure 11C:
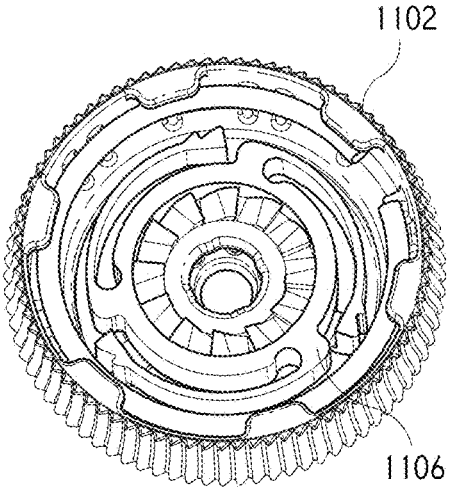
Figure 11D:
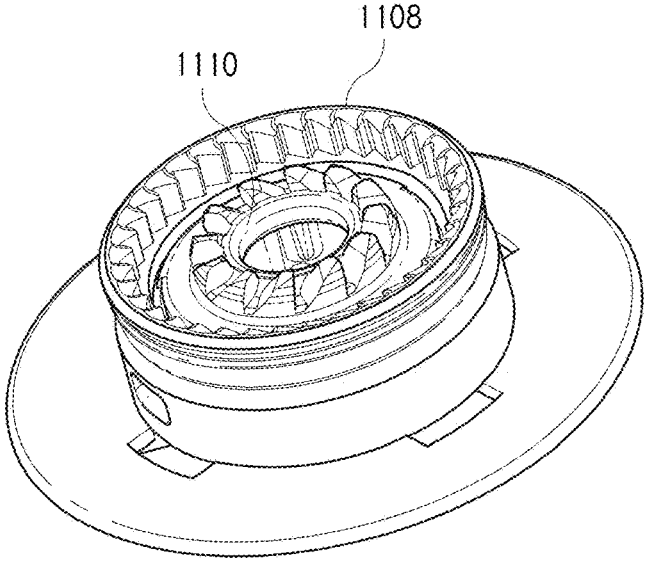
Figure 11E:
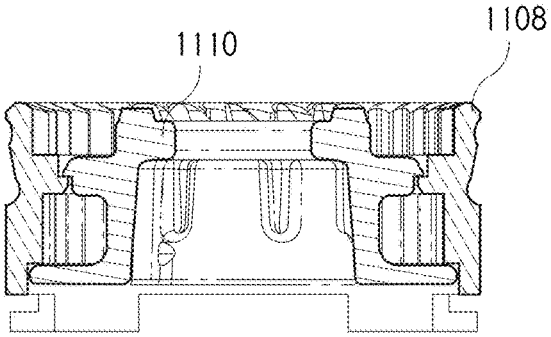
Figure 11F:
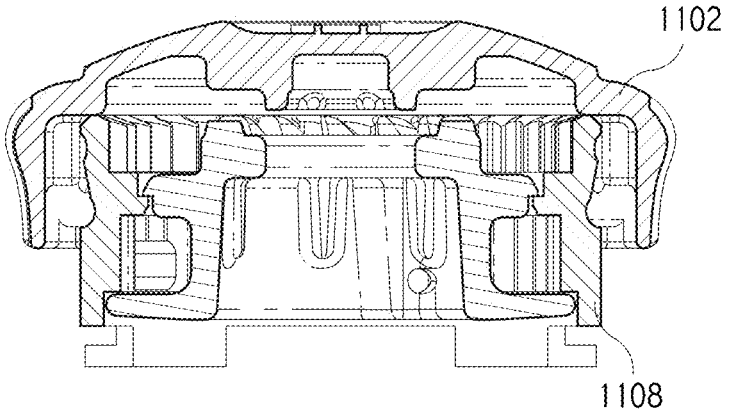
Figure 11G:
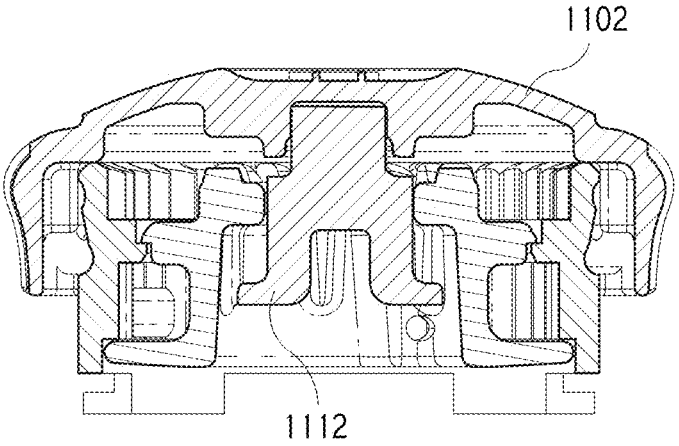
Figure 11H:
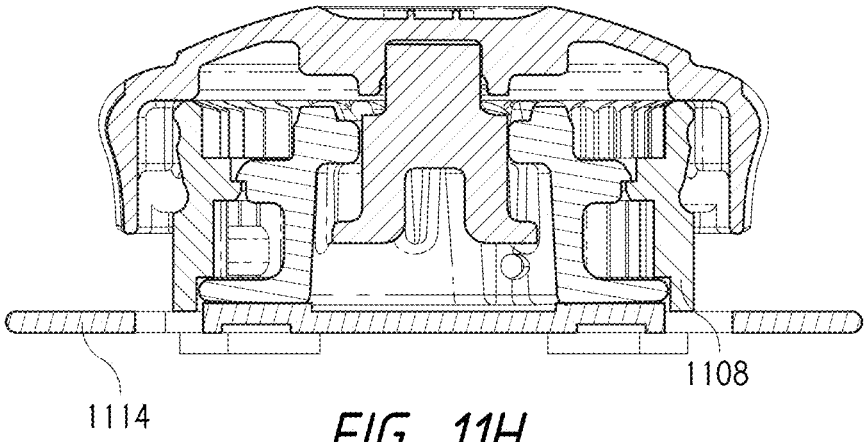
Figure 11I:
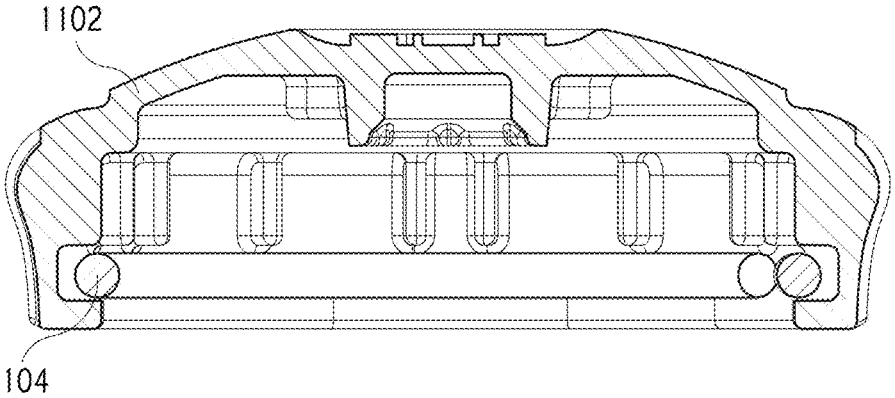
Figure 11J:
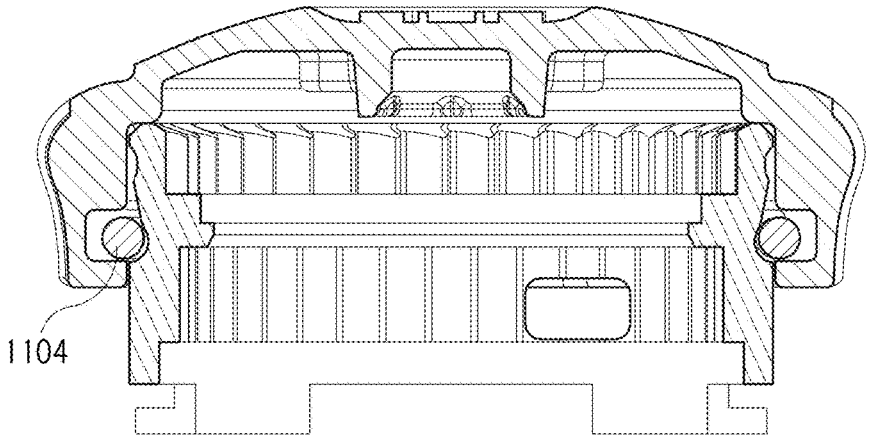
Figure 11K:
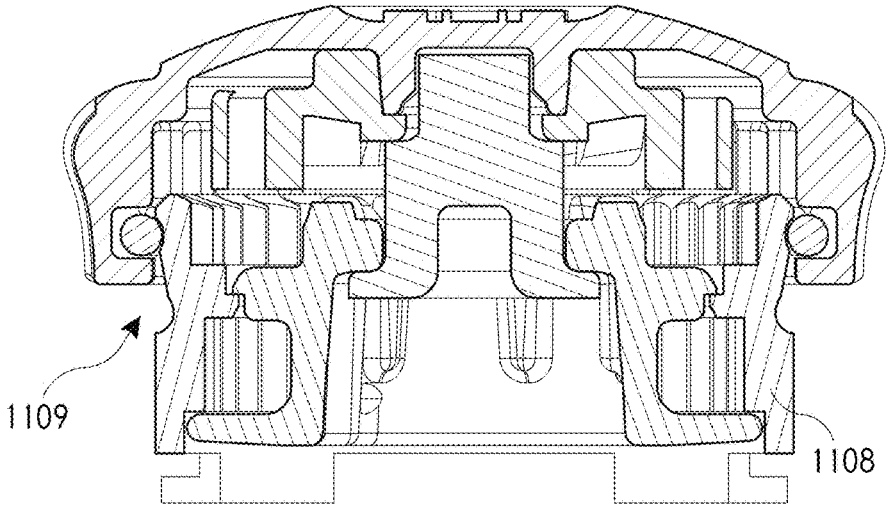
Figure 11L:
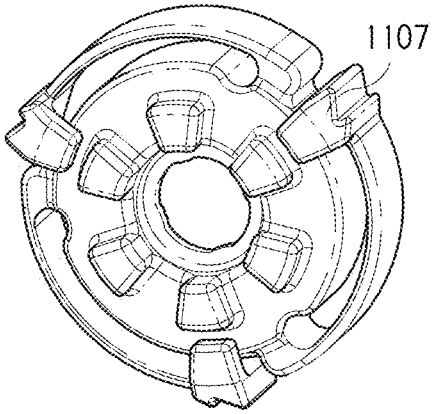
Figure 11M:
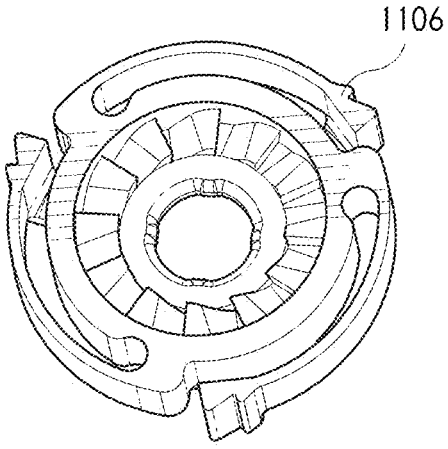
Figure 11N:
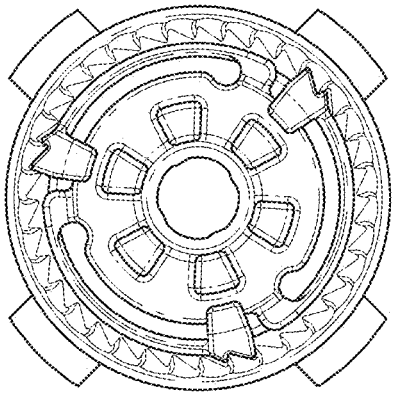
Figure 110:
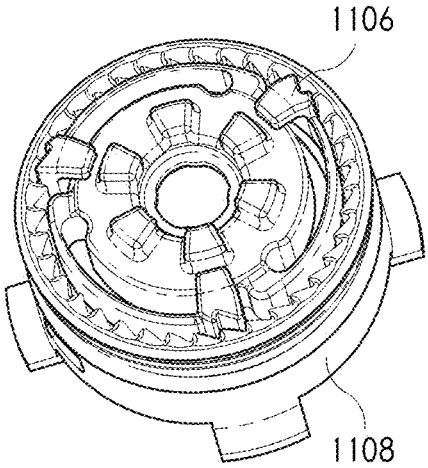
Figure 11P:
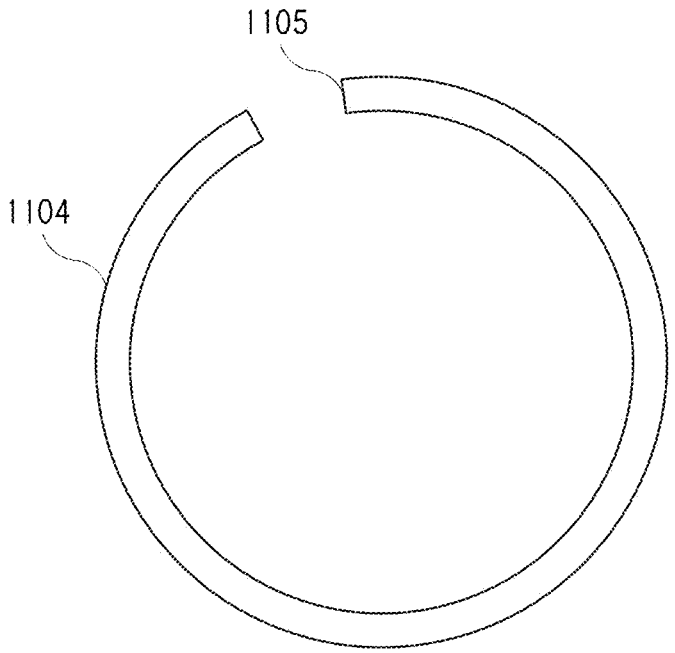

Referring now to FIGS. 11A-P, illustrated is another embodiment of a reel assembly 1100 having various integrated components. Reel assembly 1100 includes a knob 1102, an annular spring 1104, a pawl disc 1106, a spool housing 1108, a spool 1110, a slug 1112, and a bayonet 1114. FIG. 11P illustrates a top view of the annular spring 1104 and specifically shows that the annular spring 1104 includes disjointed ends 1105 that allow the annular spring 1104 to deflect circumferentially and thereby expand or contract radially to enable the knob 1102 to be raised and lowered relative to the spool housing 1108 as described below. The knob 1102 is configured to be rotated by a user, which in turn rotates pawl disc 1106 within spool housing 1108 via a drive component, spline, engaged teeth, and the like. Pawl disc 1106 includes pawl teeth that interact with the ratchet teeth of spool housing 1108 as illustrated in FIGS. 11L-0. Pawl disc 1106 rotates spool 1112 (e.g., via engaged teeth, spline, and the like) to wind and unwind lace therefrom as described herein. Slug 1112 is coupled with knob 1102 to couple the various components of the reel assembly 1100 together. The spool housing 1108 may be releasably coupled with bayonet 1114.

FIGS. 11B-H illustrate a process of assembling the components of reel assembly 1100. Specifically, in FIG. 11B the annular spring 1104 is inserted within a groove or recess of the knob 1102 (not shown). The annular spring 1104 is able to circumferentially and/or radially deflect within the groove of knob 1102 so that a diameter of the annular spring 1104 slightly widens and narrows. In FIG. 11C, the pawl disc 1106 is inserted within a central portion of knob 1102. Knob 1102 includes drive components that mate with corresponding drive components of pawl disc 1106 so as to transfer the rotational force from knob 1102 to the pawl disc 1106. In FIGS. 11D and 11E the spool 1110 is inserted within spool housing 1108. In FIG. 11F, knob 1102 and the components coupled therewith (i.e., annular spring 1104 and pawl disc 1106) are coupled with spool housing 1108. Coupling these components may be performed by aligning knob 1102 coaxially with spool housing 1108 and pressing knob 1102 axially downward onto spool housing 1108, which causes annular spring 1104 to circumferentially deflect and to be positioned within annular groove 1109 of spool housing 1108. As shown in FIG. 11G, the slug 1112 may then be inserted through a central aperture of spool 1110 such that a top portion of slug 1112 mates with knob 1102. The knob 1102 and slug 1112 are then coupled together to lock or otherwise couple the components of reel assembly 1100 together. Coupling the slug 1112 with knob 1102 may be performed via RF welding, adhesive bonding, mechanically fastening, and the like. In a specific welding embodiment, the coupling between slug 1112 and knob 1102 may have a weld diameter of about 4.5 mm and a weld height of about 1.2 mm. In FIG. 11H, the spool housing 1108 may then be coupled with bayonet 1114 such as by snapping or otherwise coupling corresponding components of the spool housing 1108 and bayonet 1114 together.

FIGS. 11I-K illustrate a specific use of reel assembly 1100. Specifically, the annular spring 1104 may be used to maintain or hold the knob 1102 in a raised and lowered configuration relative to the spool housing 1108. FIG. 11I illustrates a cross sectional view of knob 1102 showing the annular spring 1104 positioned within the groove of knob 1102. FIG. 11J illustrates the knob 1102 in a lowered configuration relative to spool housing 1108. In this configuration, annular spring 1104 is positioned within the annular groove 1109 of spool housing 1108. FIG. 11K illustrates the knob 1102 in a raised configuration relative to spool housing 1108. In this configuration, annular spring 1104 is positioned axially above the annular groove 1109 of spool housing 1108 and may be positioned within a secondary annular groove of spool housing 1109. The annular spring 1104 may deflect circumferentially and slightly widen in diameter as the knob 1102 is raised axially relative to spool housing 1108. The annular spring 1104 may also compress as the annular spring 1104 is moved into the secondary annular groove (not numbered) of spool housing 1108, which may hold or releasably lock the knob 1102 in the raised configuration relative to the spool housing 1108. In the raised configuration, teeth (not numbered) of the pawl disc 1106 may be disengaged from corresponding teeth (not numbered) of spool 1110 so as to allow the spool 1110, and any the lace coupled therewith, to unwind relative to spool housing 1108.

FIGS. 11N and 11O illustrate an interaction between the pawl disc 1106 and the spool housing 1108. Specifically, pawl disc 1106 includes a plurality of arms that have pawl teeth positioned at a distal end thereof. The distal end of the arms also includes a tab 1107 that is configured to move radially atop a surface of pawl disc 1106 as the arms are deflected radially inward due to the ratchet like movement of the pawl teeth relative to the spool housing 1108's ratchet teeth. Since the tabs 1107 are positioned on a top surface of the pawl disc 1106, the tabs 1107 pull the pawl teeth axially upward as the knob 1102 is pulled axially upward relative to spool housing 1108. The axially upward movement of the pawl teeth via the tabs 1107 disengages the pawl teeth from the spool housing 1108's ratchet teeth. The pawl disc 1106 is inserted within the spool housing 1108 so that the pawl teeth of pawl disc 1106 interact with the ratchet teeth of spool housing 1108.

Figure 12A:
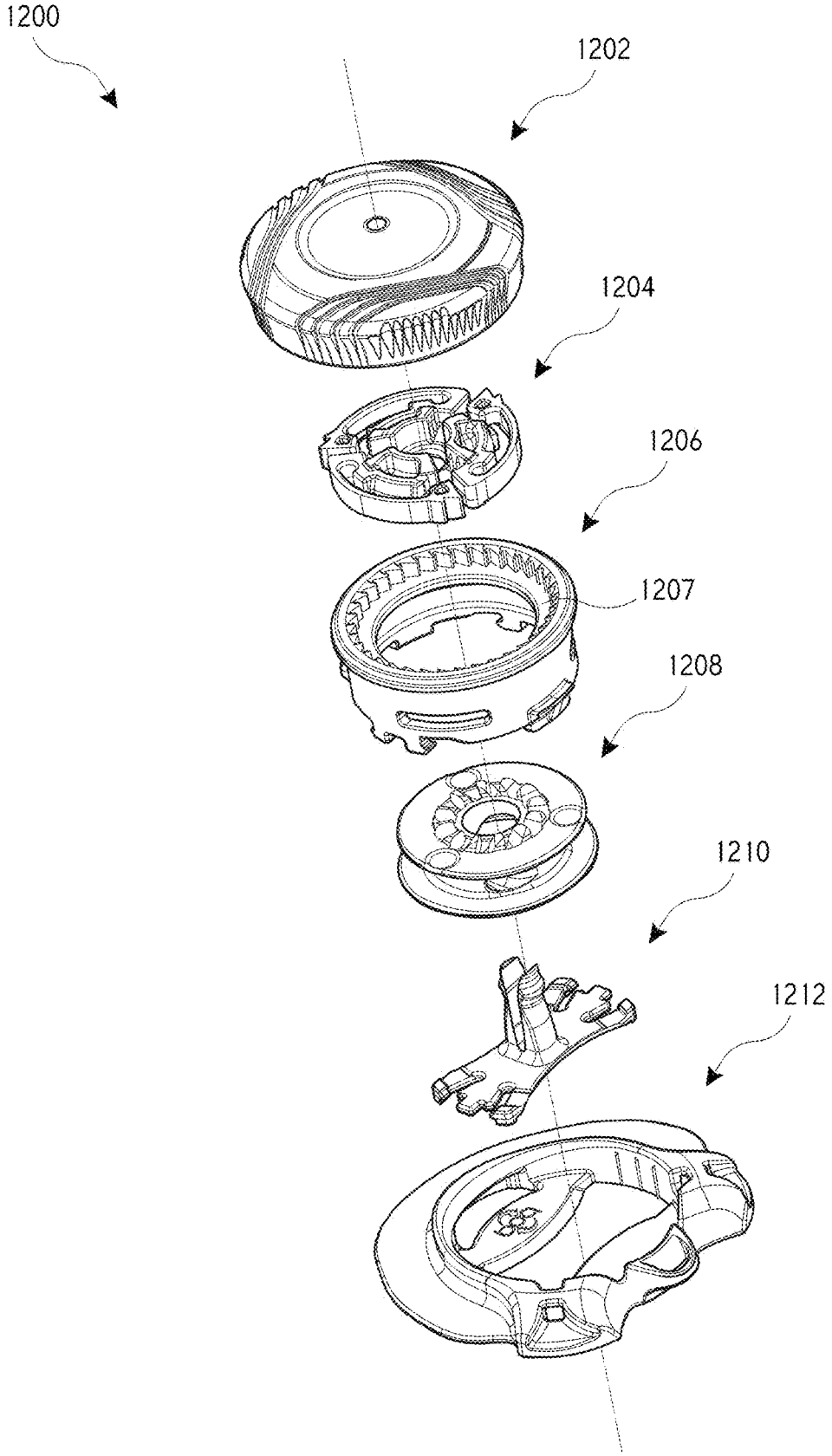
Figure 12B:
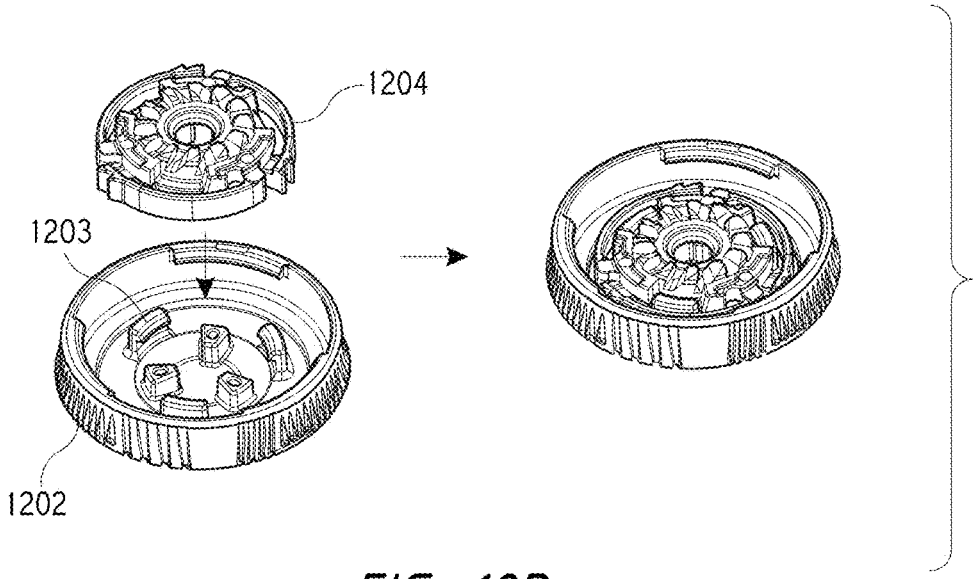
Figure 12C:
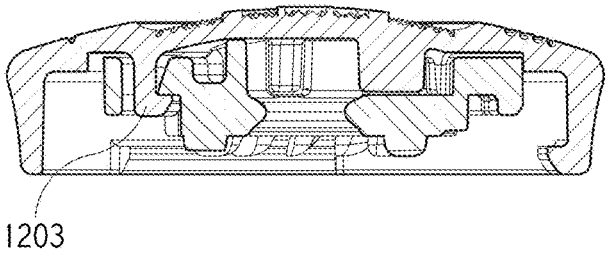

Referring now to FIGS. 12A-N, illustrated is another embodiment of a reel assembly 1200 having various integrated components. Specifically, reel assembly 1200 includes a tightening component or knob 1202 (hereinafter knob 1202), a pawl disc or drive component 1204 (hereinafter pawl disc 1204), a spool housing 1206, a spool 1208, an attachment or coupling component 1210 (hereinafter coupling component 1210), and a bayonet 1212. The attachment component 1210 in this embodiment may also be used as a mechanism that facilitates in opening and closing of the knob 1202. In this manner the component count of reel assembly 1200 is reduced and the assembly of the reel assembly 1200 is relatively quick and easy. The knob 1202, pawl disc 1204, spool housing 1206, and bayonet 1212 function similar to the other real assembly components described herein.

For example, pawl disc 1204 may include pawl teeth (not numbered) that are configured to engage with corresponding housing teeth to allow the spool 1208 to be rotated in a first direction (e.g., clockwise) while preventing rotation of the spool 1208 in a second direction (e.g., counter clockwise). The pawl disc 1204 may also include spool teeth (not numbered) that releasably engage with corresponding teeth (not numbered) of the spool 1208 to transfer a rotational force or torque input by a user on knob 1202. The pawl disc 1204 may further include a central aperture or feature that snaps around the central post of coupling component 1210 to allow the pawl disc 1204 to be moved between an engaged and disengaged state.

Referring now to FIGS. 12B-J, a method of assembling the reel assembly 1200 is illustrated. To assemble the components, the pawl disc 1204 is coaxially aligned with the knob 1202 and the pawl disc 1204 is pressed axially downward against the knob 1202 and into a recessed region of the knob 1202. The pawl disc 1204 includes a central aperture, or a plurality of recesses, that fit over a plurality of protrusions 1203 of the knob. The protrusions 1203 snap into a groove or cutout portion of the pawl disc 1204 to lock the pawl disc 1204 in position relative to knob 1202 and/or transfer a rotation force or torque input by a user to knob 1202. The locking of the protrusions 1203 relative to pawl disc 1204 is illustrated in greater detail in the cross sectional view of FIG. 12C. When the pawl disc 1204 is inserted into the knob 1202, a shoulder (not numbered) on the knob 1202 depresses the pawl teeth (not numbered) radially inward to an "in use" compression state. In this state, the pawl teeth are now ready to engage smoothly with the ratchet teeth (not numbered) of the spool housing 1206.

Figure 12D:
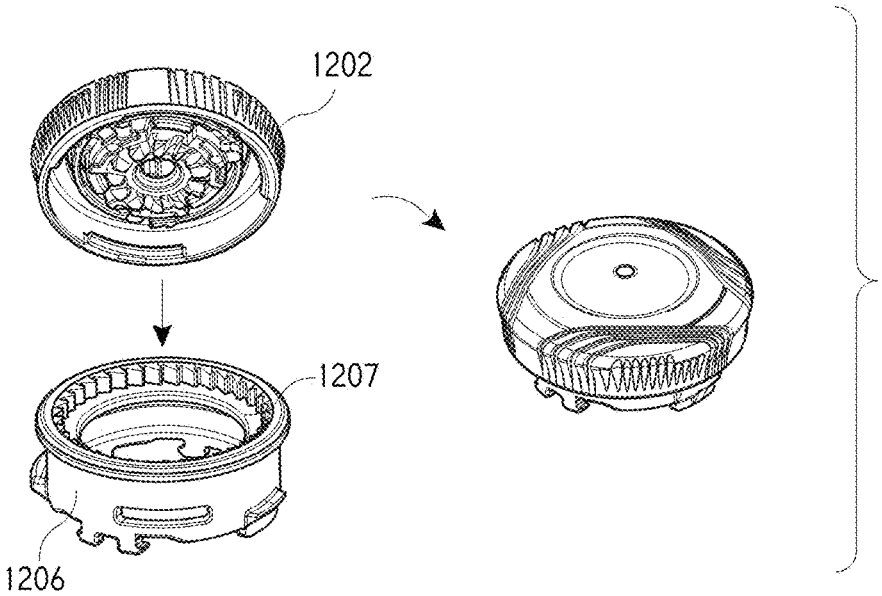

As shown in FIG. 12D, the assembled pawl disc 1204 and knob 1202 are coaxially aligned with the spool housing 1206 and the knob 1202 is pressed axially downward relative to spool housing 1206. The spool housing 1206 includes an open top end and an open bottom end. In coupling the knob 1202 with the spool housing 1206, the pawl disc 1204 is inserted within the top end of the spool housing so as to face the interior region of the spool housing 1206. The pawl disc 1204 rests and/or is axially above a partition 1207 of the spool housing 1206 that divides the spool housing's interior region into an upper and lower portion. In some embodiments, the partition 1207 is an annular ring that is formed or positioned within the spool housing 1206.

Figure 12E:
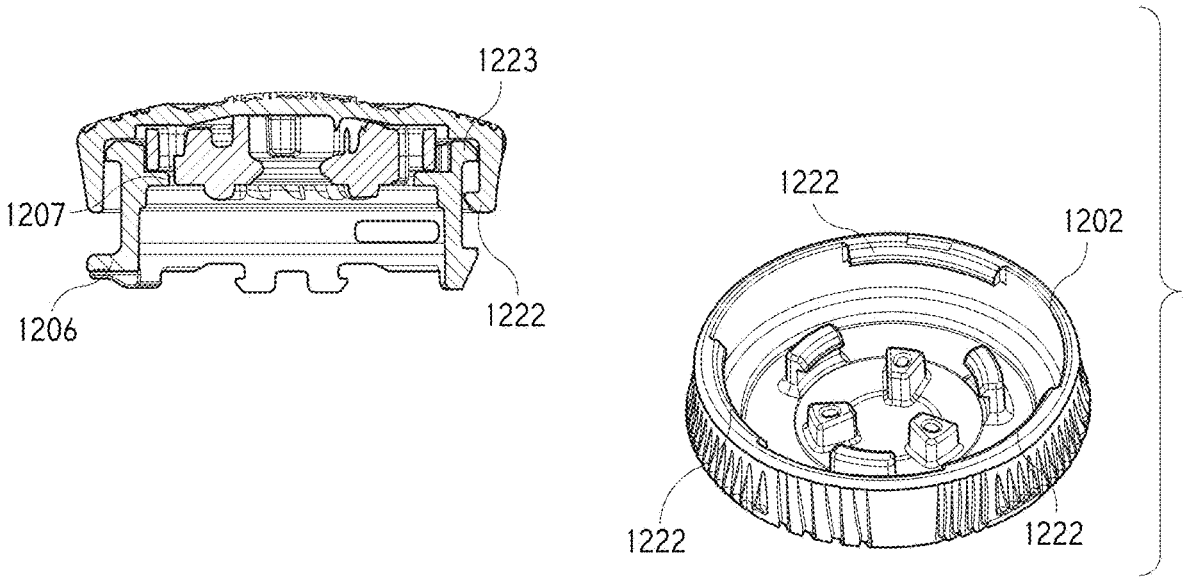

As shown in greater detail in FIG. 12E, the knob 1202 includes one or more flange portions 1222 that protrude radially inward from a grip portion or outer edge of the knob 1202. As the knob 1202 is pressed axially downward relative to spool housing 1206, the flange portions 1222 flex and slide over and an annular ridge 1223 of spool housing 1206. The flange portions 1222 of knob 1202 and the annular ridge 1223 of spool housing 1206 prevent the knob 1202 from uncoupling from spool housing 1206. In some embodiments, the flange portions 1222 may be an annular ring that fully or substantially surrounds the spool housing 1206.

Figure 12F:
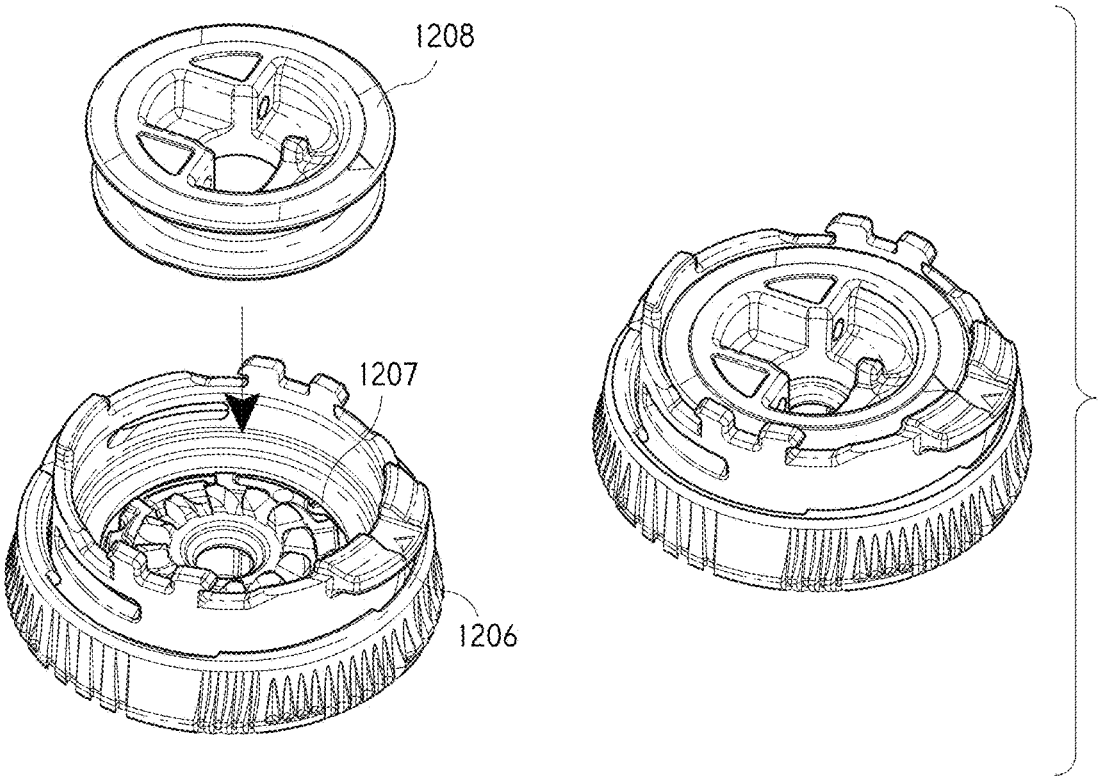

As shown in FIG. 12F, spool 1208 may then be inserted within a central region of the assembled spool housing 1206 and other components (i.e., knob 1202 and pawl disc 1204). The spool 1208 is inserted through the open bottom end of the spool housing 1206. The spool 1208 may be inserted so as to rest or be positioned adjacent the partition 1207 within the lower portion of the spool housing 1206. The spool 1208 faces the bottom end of the pawl disc 1204 after being inserted within the open bottom end of the spool housing 1206. As shown in FIG. 12F, when the reel assembly 1200 is assembled, the spool 1208 is substantially positioned within the spool housing's interior region so as to be accessible from the open bottom end of the spool housing. This allows a user to couple lace or another tension member with the spool 1208 while the spool is positioned within the spool housing's interior region. As used herein, the spool 1208 being substantially positioned within the spool housing's interior region means that greater than 80 percent of the spool 1208 is within spool housing's interior region, which is defined as a volume of the spool characterized by the spool housing's exterior walls and a plan that is positioned over the spool housing's open top and bottom end. In some embodiments, greater than 90 percent of the spool 1208 is within spool housing's interior region, and in some embodiments, the spool 1208 is positioned entirely or completely within the spool housing's interior region.

Figure 12G:
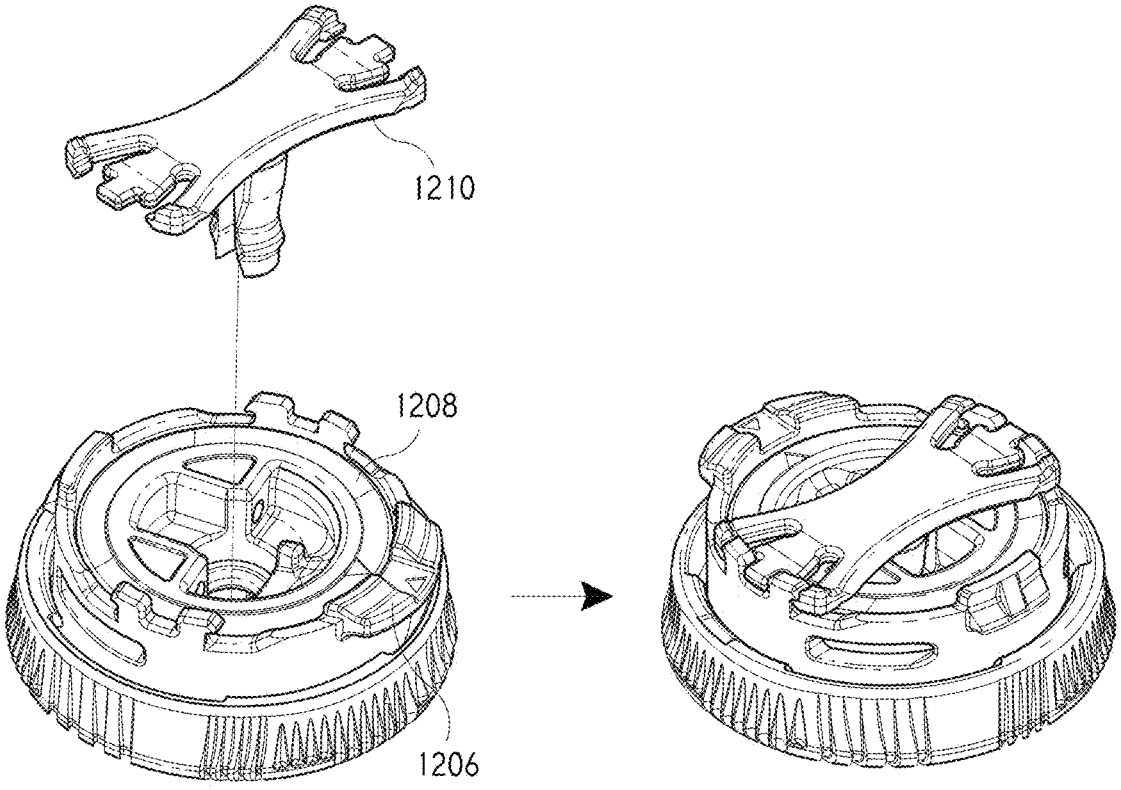

As shown in FIG. 12G, the coupling component 1210 is then coupled with spool housing 1206 so that a central boss or coupling member extends through a central aperture of the spool 1208 and spool housing 1206 and is coupled with the pawl disc 1204. Coupling of the central boss with the pawl disc 1204 operationally couples the pawl disc 1204 and the spool 1208 so that operation of the knob 1202 causes the spool 1208 to rotate within the housing in the first direction (e.g., clockwise) while preventing rotation of the spool component in the second direction (e.g., counterclockwise). Operationally coupling the pawl disc 1204 and spool 1208 may be achieved by engaging corresponding teeth of the pawl disc 1204 and spool 1208, or by engaging a spline or other torque transmitting features or components.

Figure 12H:
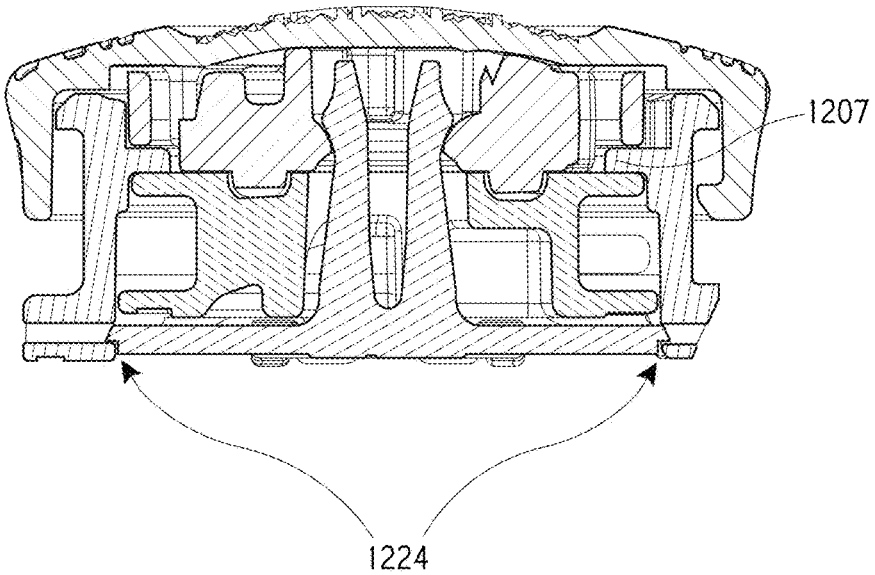
Figure 12I:
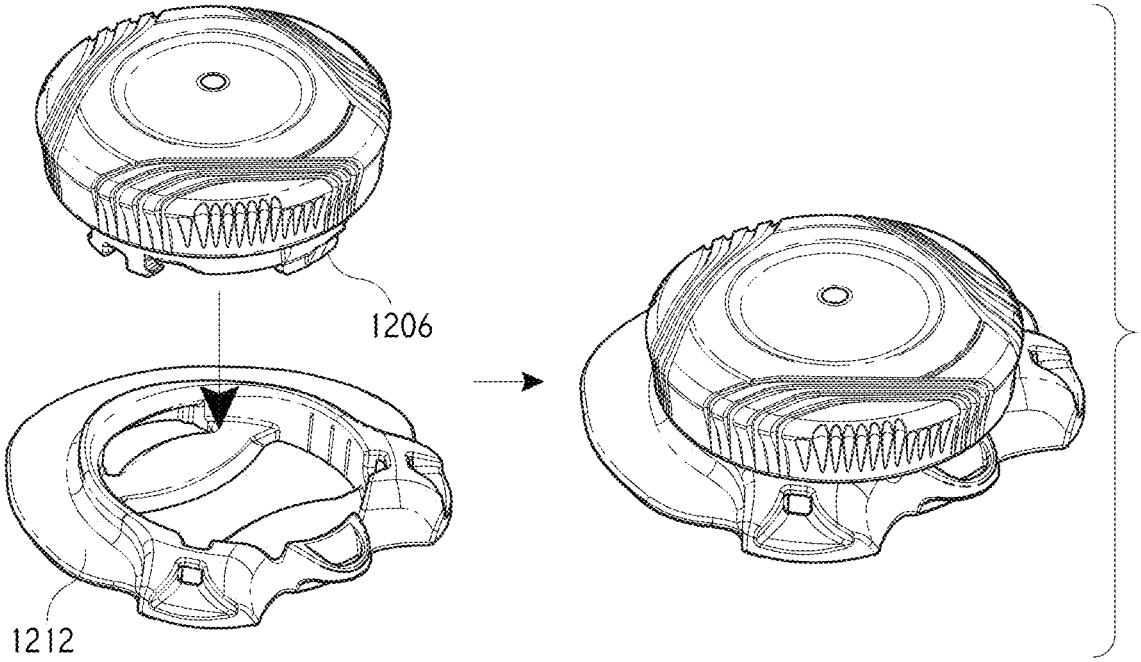

In some embodiments, coupling component 1210 includes a relatively flat bottom member that spans the spool 1208 and/or spool housing 1206 and prevents the coupling component 1210 from moving axially upward relative to the other components of reel assembly 1200. FIG. 12H illustrates that in some embodiments the coupling component 1210 may include attachment members 1224 that snap into corresponding slots of spool housing 1206 so as to further hold the coupling component 1210 in position relative to the other components of the reel assembly 1200. After the coupling component 1210 is snapped into position, the knob 1202, pawl disc 1204, spool housing 1206, and spool 1208 are fixedly coupled together. The spool housing 1206, and the other assembled components, may then be removably coupled with bayonet 1212 as shown in FIG. 12I.

In some embodiments, assembling the reel assembly 1200 is performed in a manner in which the reel assembly 1200 is free of a screw or other rigid fastener. For example, the pawl disc 1204 may be coupled with the knob 1202 by snapping the drive component into a recessed portion of the tightening component. Similarly, the knob 1202 may be coupled with the spool housing 1206 via snapping the knob's lip or flange over a corresponding lip or flange of the spool housing 1206. The coupling component 1210 may likewise be snapped into engagement with the bottom end of the spool housing 1206. The central boss of the coupling component 1210 may be snapped into engagement with an aperture of the pawl disc 1204 and the assembled reel assembly 1200 may be snapped into engagement with the bayonet 1212 that is positioned on a shoe or other article to be tightened. In such an embodiment, assembly of the reel assembly 1200 entirely or substantially involves snapping the various components into engagement and does not include the use of a screw, rivet, or other rigid fastener.

The part or component count of the reel assembly 1200 is also minimal, which reduces the overall manufacturing costs in producing and/or assembly the reel assembly 1200. For example, the component count of the reel assembly 1200 may be no more than about six components including: the knob 1202, the pawl disc 1204, the spool housing 1206, the spool 1208, and the coupling component 1210. In some embodiments, the bayonet 1212 may also be included in the component count. In some embodiments the reel assembly 1200 may have no more than five components and/or some of the previously described components could be combined or integrated. For example, the pawl disc 1204 could be integrated or combined with the spool 1208. In another embodiment, the coupling component 1210, and specifically the central boss that allows the assembly to remain in the engaged or disengaged position, could be integrated or combined with the spool 1208.

In some embodiments, one or more of the above components may include two or more parts that are coupled together. For example, the knob may include a main body and a grip body that is positioned on a circumferential edge of the main body. The grip body may have a coefficient of friction that is greater than the main body to enable gripping of the knob 1202. In another embodiment, the bayonet 1212 may include a mounting feature that is configured for releasably coupling with the spool housing 1206 and may include an attachment feature (e.g., stitch flange) that is configured for coupling with a shoe or other article. The mounting feature may be made of a first material and the attachment feature may be made of a second material that is softer than the first material. The softer second material may enable easy coupling or attachment of the bayonet 1212 to the shoe or other article, while the more rigid first material provides a rigid feature that enables or facilitates coupling of the bayonet with the spool housing 1206. The separate components or members may be integrally formed together via two shot molding, rf welding, sonic welding, and the like so that the resulting component is essentially similar to or functions as a single piece component.

Figure 12J:
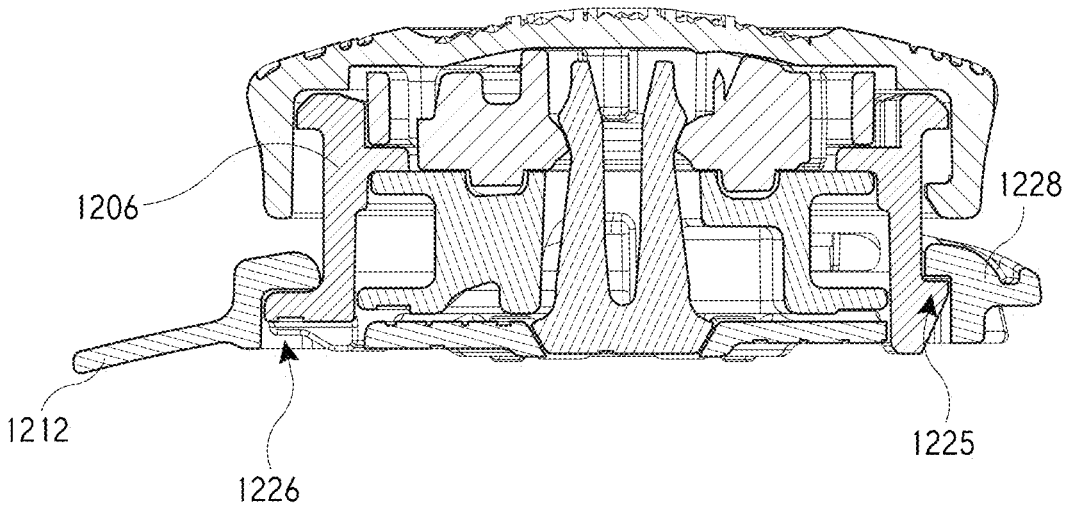

FIG. 12J illustrates one embodiment in which the spool housing 1206 may be removably coupled with bayonet 1212. In this embodiment, one or more interlocking tabs 1226 of spool housing 1206 may be positioned under an undercut or grooved portion 1225 of bayonet 1212. One of the undercuts 1225 may be formed from, or otherwise defined by, a pressable tab or button 1228. The tab 1226 is able to be released or removed from the undercut 1225 when the button 1228 is pressed. In this manner, the spool housing 1226 and other components of reel assembly 1200 may be detached from bayonet 1212 as desired.

Figure 12K:
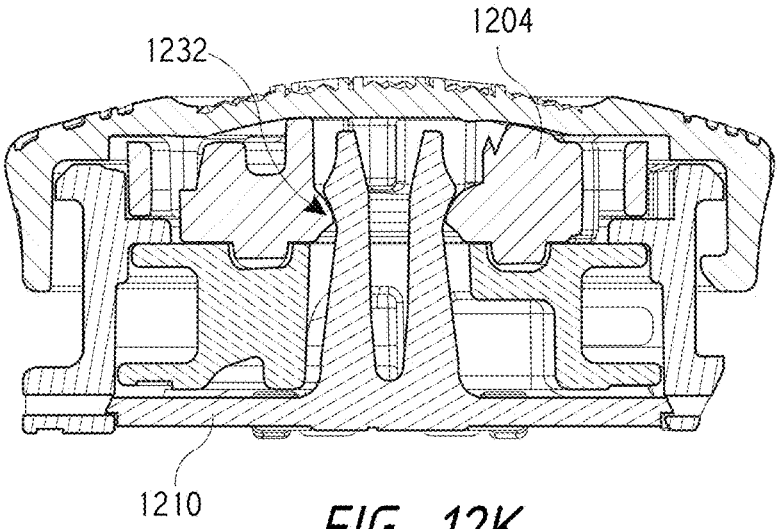
Figure 12L:
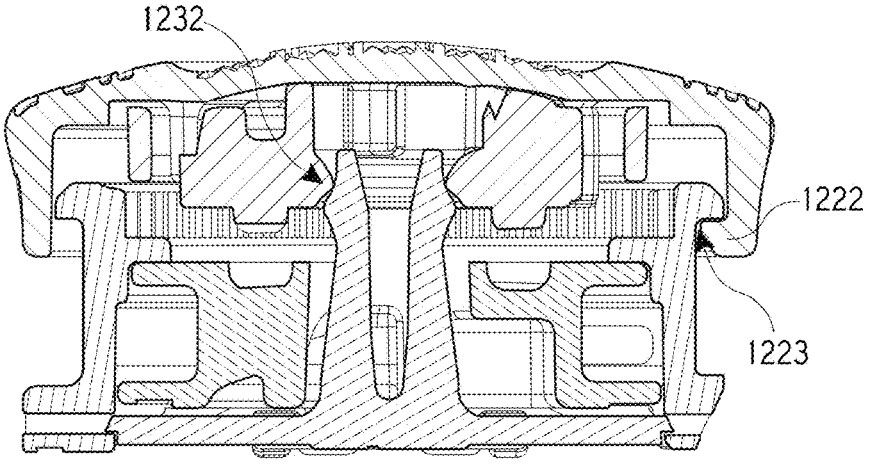

Referring now to FIGS. 12K and 12L, illustrated is an embodiment of the coupling component 1210 being used to facilitate in opening and closing of the knob 1202 so as to allow the spool 1208, and any lace coupled therewith, to be unwound or rotated in a reverse direction. Stated differently, the coupling component is being used to move the pawl disc between an engaged and disengaged state that allow the lace tension to be released. FIGS. 12*k* and 121 also illustrate the coupling component 1210 coupled with the pawl disc 1204 to lock or otherwise couple the components of the reel assembly 1200 together as previously described.

FIG. 12K illustrates the knob 1202 positioned in a lowered configuration relative to spool housing 1206. In this configuration, a flange or bushing 1232 of pawl disc 1204 is positioned within a first annular groove of coupling component 1210, or positioned below a radial protrusion or feature of the coupling component's central boss. The positioning of the bushing 1232 within the coupling component 1210's first annular groove, or below the radial protrusion, holds or otherwise maintains the knob 1202 in the lowered configuration relative to spool housing 1206. In the lowered configuration the pawl teeth of pawl disc 1204 engage with the ratchet teeth of spool housing 1206 as described herein to allow the spool 1208 to be wound in a ratchet like manner.

FIG. 12L illustrates the knob 1202 positioned in a raised configuration in which the knob 1202 and pawl disc 1204 are moved axially upward relative to spool housing 1206, spool 1208, and coupling component 1210. In the raised configuration, the bushing 1232 of pawl disc 1204 is moved axially upward and out of the coupling component 1210's first annular groove and into a second annular groove of coupling component 1210. In other embodiments, the bushing 1232 is axially raised so as to be positioned above the radial protrusion or feature of the coupling component's central boss. The positioning of the bushing 1232 within the coupling component 1210's second annular groove, or above the radial protrusion, holds or otherwise maintains the knob 1202 and pawl disc 1204 in the raised configuration relative to spool housing 1206. In the raised configuration the pawl teeth of pawl disc 1204 are disengaged from the ratchet teeth of spool housing 1206 as described herein.

FIG. 12L also illustrates that an interaction between the flange 1222 and annular ridge 1223 prevents further upward axial movement of the knob 1202 and pawl disc 1204 relative to spool housing 1206, and thereby prevents the knob 1202 from being detached from spool housing 1206. To enable the bushing 1232 of the pawl disc 1204 to be moved axially above or below the radial protrusion or feature of the coupling component 1210, the coupling component's central boss includes two members that extend axially upwards into the spool housing's interior region. The two members have a forked shaped configuration wherein the two members are disconnected so as to allow the two members to flex radially inward as the bushing 1232 is moved axially upward and downward. In this manner, the coupling component's central boss functions as a spring to allow the knob 1202 and pawl disc 1204 to be axially moved and maintained in an axially raised or lower position.

The forked shaped central boss may be configured to ensure there is no or limited "slop" or rattle between the knob 1202 and the spool housing 1206. This is achieved by the interaction of the geometry of the central boss's forked profile and the pawl disc's bushing 1232, which have a preload/interference between one another. A "transition point" on the central boss's profile is important to reduce unintentional opening or axially movement of the knob 1202. The "transition point" refers to the widest portion of the central boss's radial protrusion. The central boss is configured so that the transition point is positioned axially upward from the bushing 1232 when the assembly is engaged or closed—i.e., when the assembly is in the lowered position. As such, when the knob 1202 is side loaded, which causes the knob 1202 to tilt slightly upward, the bushing 1232 remains below the central boss's transition point thereby keeping the assembly engaged or closed. The central boss's radial protrusion is also angled axially above and below the transition point to help ensure that the knob 1202 and other components remain in the open/disengaged position or the closed/engaged position as desired. The configuration and positioning of the bushing 1232 and transition point ensures that if the bushing 1232 is positioned axially above the transition point, the knob 1202 and other components will remain open/disengaged. In contrast, if the busing 1232 is positioned axially below the transition point, the knob 1202 and other components will remain closed/engaged. In some embodiments, the central boss may be made of a reinforced polymer material (e.g., 25% GF POM) to provide a sufficient stiffness and ductility, which aids in maintaining the knob 1202 and other components in the open/disengaged position or the closed/engaged position as desired.

In some embodiments, the knob 1202 and pawl disc 1204 may be axially raised or lowered by pushing or pulling on the knob 1202. In other embodiment, the knob 1202 and pawl disc 1204 may be axially raised or lowered by rotating the knob 1202 in the second direction (e.g., counterclockwise) and/or by pushing a button or other mechanism.

Figure 12M:
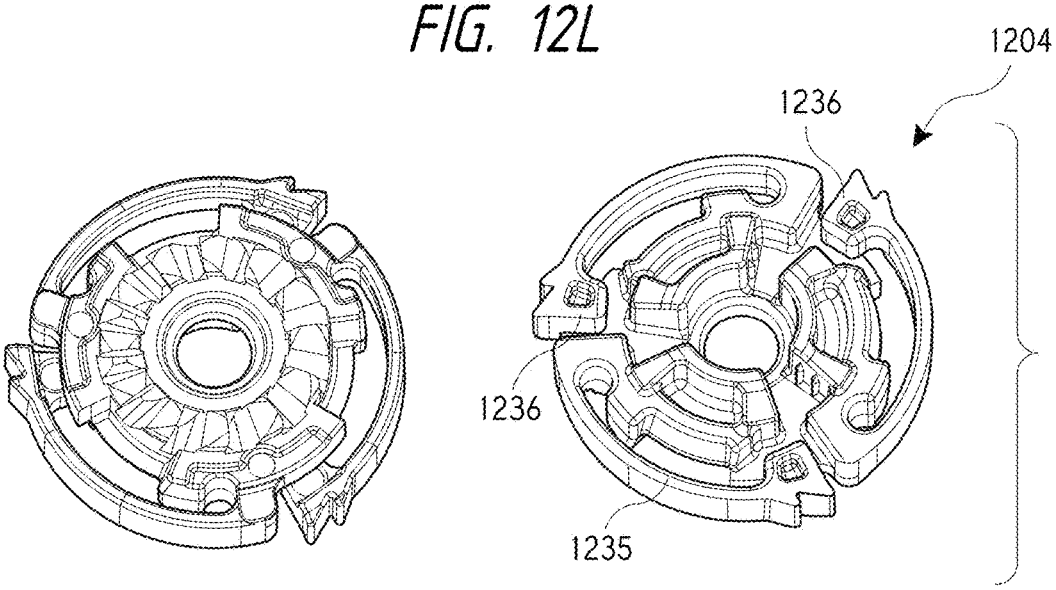

To facilitate in disengagement of the pawl teeth from the ratchet teeth, the pawl disc 1204 includes tabs 1236 that are positioned at a distal end of pawl teeth arms 1235 as described herein. As the pawl disc 1204 is pulled axially upward, such as via knob 1202, the tabs 1236 pull upward on the pawl teeth to facilitate disengagement of the pawl teeth from the ratchet teeth. FIGS. 12M and 12N illustrate the pawl disc 1204 in greater detail and also illustrates the pawl disc 1204 interacting with the coupling component 1210 while the pawl teeth are engaged with the ratchet teeth.

Figure 120:
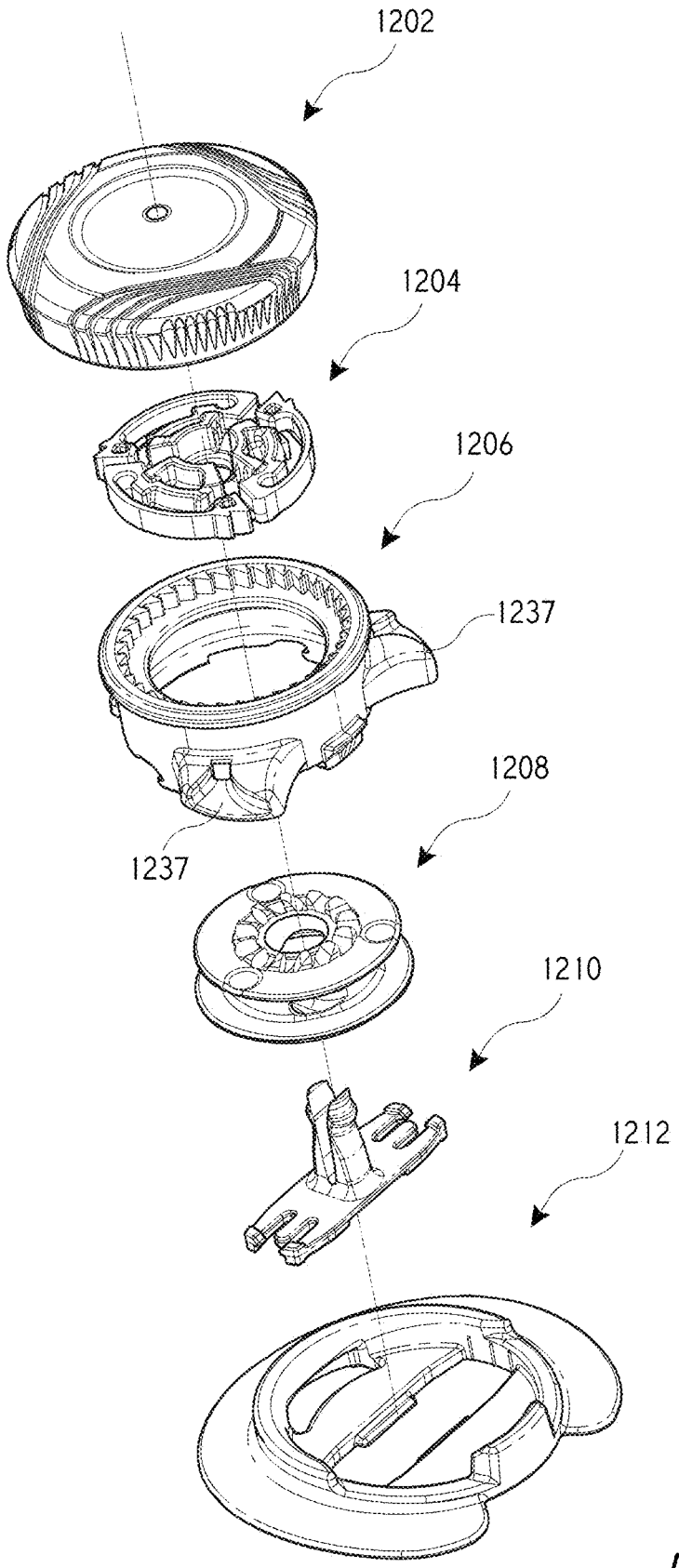

FIG. 120 illustrates a similar embodiment of a reel assembly 1200 having the various components described above. The embodiment of FIG. 120 differs, however, in that lace entrance and exit ports 1237 are positioned on the spool housing 1206 instead of on the bayonet 1212.

According to one embodiment, a method of assembling a reel assembly includes coupling a drive component (e.g., pawl disc) with a tightening component (e.g., knob). The method also includes coupling the tightening component with a top end of a housing (e.g., spool housing) so that the drive component faces an interior region of the housing. The method additionally includes inserting a spool component (e.g., spool) within a bottom end of the housing so that the spool component is positioned within the interior region of the housing and so that a top end of the spool component faces a bottom surface of the drive component. The method additionally includes coupling an attachment component with the bottom end of the housing. The attachment component includes a coupling member that couples with the drive component. Coupling the coupling member with the drive component may operationally couple the drive component and the spool component so that operation of the tightening component causes the spool component to rotate within the housing in a first direction while preventing rotation of the spool component in a second direction.

In some embodiments, one or more of the various components are assembled or coupled so that the reel assembly is free of a screw or other rigid fastener. In some embodiments, coupling the drive component with the tightening component includes snapping the drive component into a recessed portion of the tightening component. In some embodiments, coupling the tightening component with the top end of the housing includes snapping a lip of the tightening component over a corresponding lip of the housing. In some embodiments, coupling the attachment component with the bottom end of the housing includes snapping a flange of the attachment component within an aperture of the housing. In some embodiments, the method may additionally include snapping the attachment component's coupling member within an aperture of the drive component to couple said components together and/or the method may include coupling the assembled reel assembly with a mounting component that is positioned on an article to be tightened with the reel assembly.

In one embodiment, a reel assembly for tightening a shoe or other article includes a housing having an interior region and a partition that divides the interior region into an upper portion and a lower portion and a spool rotatably positioned within the lower portion of the housing's interior region axially below the partition. The partition may prevent the spool from axially moving upward into the upper portion. The reel assembly also includes a drive component that is positioned within the upper portion of the housing's interior region. The drive component may be axially moveable relative to the spool between an engaged state and a disengaged state. In the engaged state, the drive component allows the spool to rotate in a first direction within the housing's interior region while preventing rotation of the spool component in a second direction. In the disengaged state, the drive component allows the spool to rotate in the second direction within the housing's interior region.

The reel assembly also includes a tightening component that is positioned axially above the drive component and coupled therewith so that operation of the tightening component causes the spool to rotate within the housing's interior region in the first direction. The reel assembly further includes an attachment component that is positioned axially below the spool. The attachment component includes a coupling member that protrudes axially upward into the interior region of the housing and couples with the drive component.

Other embodiments described herein provide closure system components that enable a tension member to be quickly and easily coupled with the closure system. As described previously, the closure system includes a tensioning component that may be operated to tension the tension member. An exemplary tensioning component is a knob that may be grasped and rotated to tension the tension member. Other tensioning components include pull cords, motorized devices, and the like.

The closure system's tensioning component needs to be coupled with the tension member or lace so that operation of the tensioning component effects tensioning of the tension member. Coupling the tension member with the tensioning component in conventional systems is often tedious and/or difficult. For example, conventional systems often require a substantial amount of disassembly of the closure system in order to couple the tensioning component and tension member. Further, replacement of the tension member is sometimes required after considerable usage of the closure system. Replacement of the tension member may require the use of special tools and/or considerable disassembly of the closure system. The embodiments described herein provide a means for quickly and conveniently coupling a tension member with the closure system's tensioning component and/or other components, which greatly reduces the time and money associated with manufacturing the closure systems as well as reduces the time and effort necessary to replace the tension member.

As an example of a reel based tensioning device that may be configured for quick and easy lace attachment, a housing component of the reel based tensioning device may have an interior region within which one or more other components of the reel based tensioning device are positionable and may also have a first aperture that provides a first access to the interior region from an exterior of the housing component and a second aperture that provides a second access to the interior region from the exterior of the housing component. A spool component of the reel based tensioning device may be positionable within the interior region of the housing component and may include a central cylindrical portion and a pair of flanges that are positioned on opposing ends of the central cylindrical portion with each flange extending radially outward from the central cylindrical portion. A lumen may extend through the central cylindrical portion of the spool component. Opposing ends of the lumen may be alignable with the first aperture and with the second aperture of the housing component to enable a lace to be inserted through the first aperture, through the lumen, and through the second aperture so that opposing ends of the lace are positioned exterior to the housing component while a portion of the lace is disposed within the interior region of the housing component and within the lumen of the spool component.

In some embodiments, the lumen may have a tapered region that is configured to engage with a knot that is tied in a distal end of the lace as the lace is retracted through the second aperture and within the lumen of the central cylindrical portion. A narrow portion of the lumen's tapered region may include an engagement feature, such as a notch or pocket, within which the knot engages to prevent uncoupling of the lace and spool component. The lumen may be positioned on one side of the central cylindrical component and an additional lumen may be positioned on an opposite side of the central cylindrical component. In such embodiments, opposing ends of the additional lumen may be alignable with the second aperture of the housing component and with a third aperture of the housing component to enable an additional lace to be inserted through the third aperture, through the lumen, and through the second aperture so that opposing ends of the additional lace are positioned exterior to the housing component while a portion of the additional lace is disposed within the interior region of the housing component and within the additional lumen of the spool component.

In some embodiments, an axis of the first aperture may be angled relative to an axis of the second aperture so that the axes of the tow apertures are offset or non-parallel. The housing component may include a knot securement member within which the knot is positionable so that tensioning of the lace causes the knot to cinch down on itself. The lumen may be configured to guide the lace along a non-parallel or non-straight path between the first aperture and the second aperture of the housing component. The spool component and the housing component may each include indicia that are alignable to indicate when the opposing ends of the lumen are aligned with the first aperture and the second aperture of the housing component.

According to another example of a lace tensioning device that may be configured for quick and easy coupling of the lace, a housing component of the lace tensioning device may have an interior region, a first aperture, and a second aperture. A spool component of the lace tensioning device may be rotatably positionable within the interior region of the housing component and may have a central cylindrical member and a lumen that extends through the central cylindrical portion. The spool may be rotatable within the interior region of the housing component to align one end of the lumen with the first aperture and to align an opposite end of the lumen with the second aperture to enable a lace to be inserted through the first aperture, the lumen, and the second aperture so that opposing ends of the lace are positioned exterior to the housing component.

The lumen that extends through the central cylindrical portion may have a tapered region that is configured to engage with a knot that is tied in a distal end of the lace as the lace is retracted through the second aperture and within the lumen of the central cylindrical portion. A narrow portion of the lumen's tapered region may include a lace engagement feature, such as a notch or pocket, within which the knot engages to prevent uncoupling of the lace and spool component. An axis of the first aperture may be angled relative to an axis of the second aperture so that the axes of the two apertures are not aligned. The first aperture may be positioned toward a front portion of the housing component and the second aperture may be positioned toward a rear portion of the housing component so that when the lace is inserted through the first aperture, the lumen, and the second aperture, the lace extends from the front portion of the housing component, through the spool component, and rearward of the rear portion of the housing component. The housing component may include a knot securement member within which the knot is positionable so that tensioning of the lace causes the knot to cinch down on itself.

Figure 13:
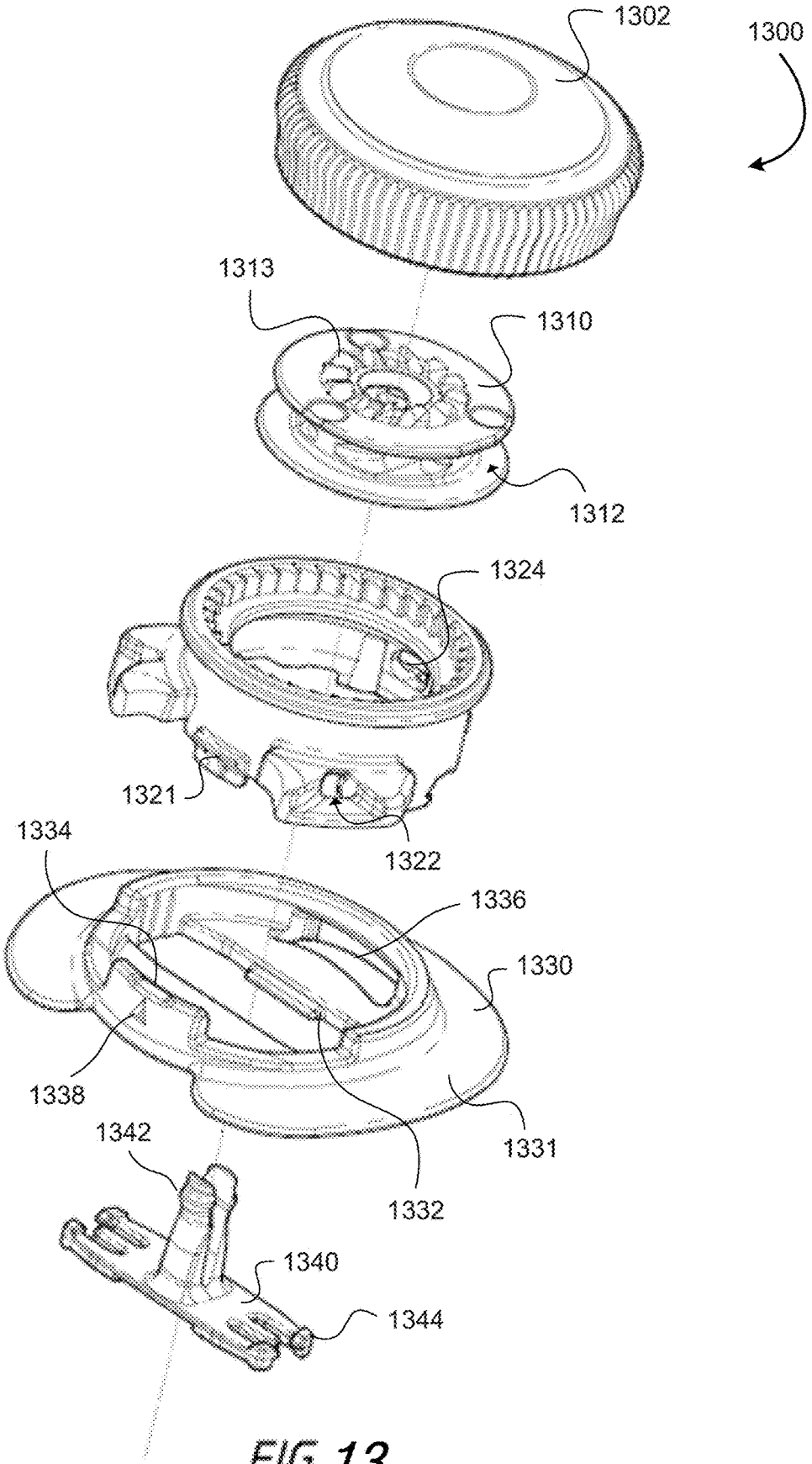
FIG. 13 illustrates an embodiment of a reel assembly that includes various components that enable a tension member or lace to be easily coupled or attached to one or more components of the reel assembly.
Figure 14A:
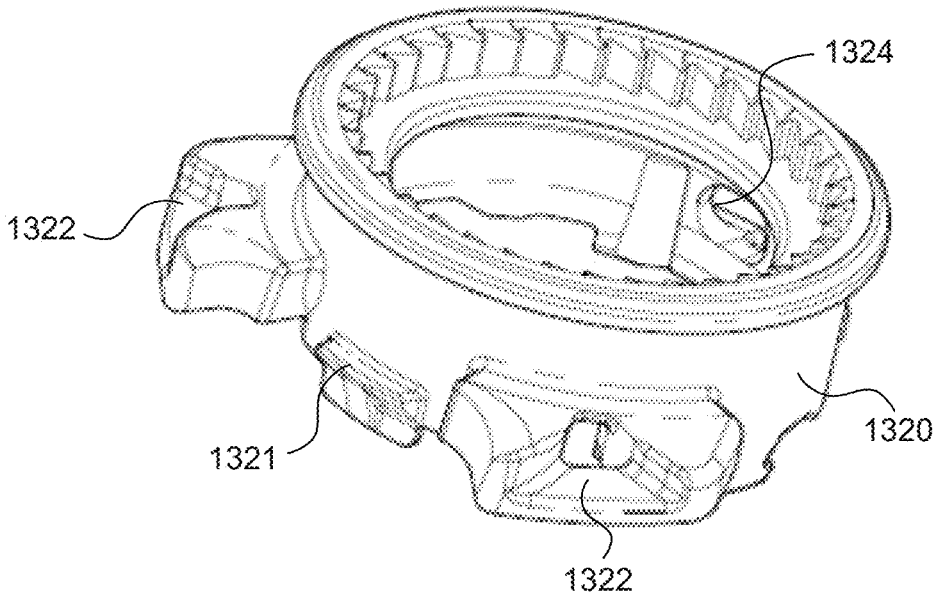
FIGS. 14A-18B illustrate top and bottom perspective views of the various components of the reel assembly of FIG. 13.
Figure 14B:
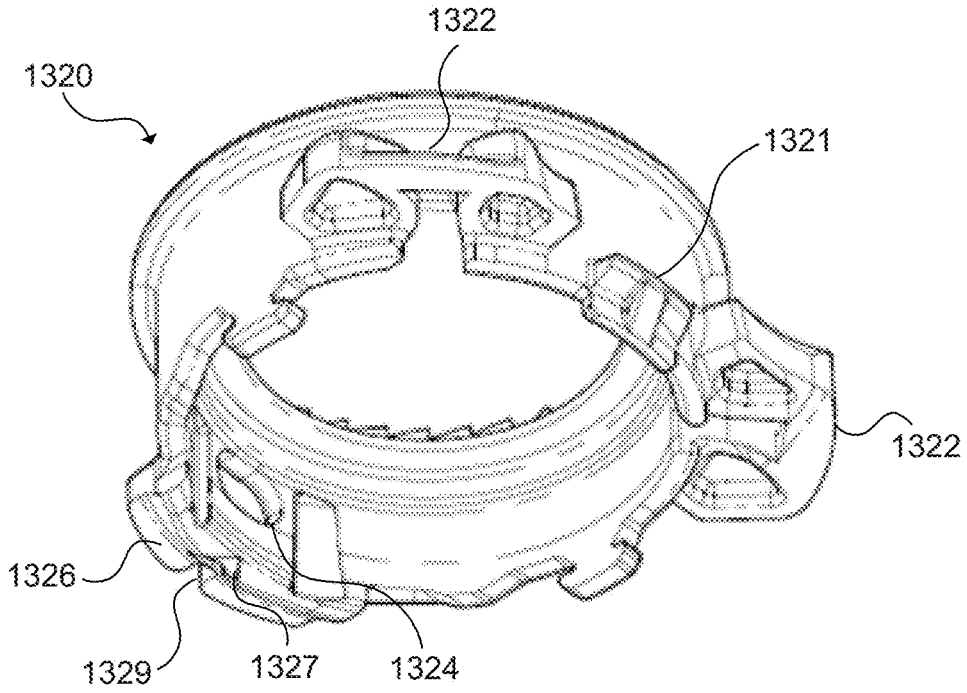

Referring now to FIG. 13, illustrated is an exemplary embodiment of a closure system 1300 that includes various components that enable a tension member or lace (hereinafter lace) to be easily coupled or attached to one or more components of the closure system. The closure system 1300 includes a base or bayonet 1330 that may be coupled with an article via a flange 1331. The flange 1331 may be stitched, adhered, heat bonded, mechanically fastened, or otherwise attached to the article. Removably coupled with the bayonet 1330 is a housing 1320. A spool 1310 is positioned within the housing 1320 and a knob or reel 1302 (hereinafter knob 1302) is positioned atop housing 1320. Knob 1302 is operationally coupled with the spool 1310 so that operation of the knob 1302, and specifically rotation of the knob 1302, effects or causes rotation of the spool 1310 within the housing 1320. A coupling component 1340 is positioned axially below the bayonet 1330 and is used to hold or maintain the knob 1302 in an axially raised or lowered position.

FIGS. 14A-18B illustrate top and bottom perspective views of the various components of closure system 1300. For example, FIGS. 16A and 16B illustrate the bayonet 1330. The bayonet 1330 includes a recessed or open portion 1332 within which the coupling component 1340 is positioned. The coupling component 1340 includes laterally extending arms 1344 that matingly engage with the bayonet 1330 to prevent the coupling component 1340 from being pulled axially upward and out of engagement with the bayonet 1330. The coupling component 1340 also includes an axially extending post 1342 that extends axially upward from the bayonet 1330 when the coupling component 1340 and bayonet 1330 are coupled together. The axially extending post 1342 is disposed through a central aperture of the spool 1310 and matingly engages with the knob 1302 to hold or maintain the knob 1302 in an axially raised or lowered position. Specifically, the axially extending post 1342 has a radially outward extending tip that is positioned within and engages a central aperture 1305 of the knob 1302, which is illustrated in FIG. 15B. In operation, the radially outward extending tip of the coupling component 1340 is positioned within the central aperture 1305 and axially above a smaller diameter annular inward extending surface of the central aperture 1305. Because the tip of coupling component 1340 is positioned axially above the smaller diameter annular surface of central aperture 1305, the tip of coupling component 1340 maintains the knob 1302 in a lowered position. If the user grasps the knob 1302 and pulls axially upward on the knob, the annular inward extending surface of the central aperture deflects the coupling component's tip inward and moves axially upward and above the tip of coupling component 1340. In this instance, because the coupling component's radially outward extending tip is positioned axially below the smaller diameter central aperture 1305, the central post 1342 and radially extending tip maintain the knob in a raised position.

Figure 15A:
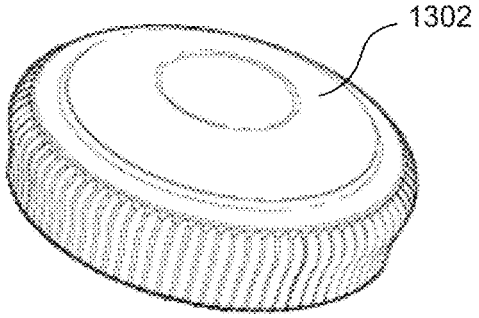
Figure 15B:
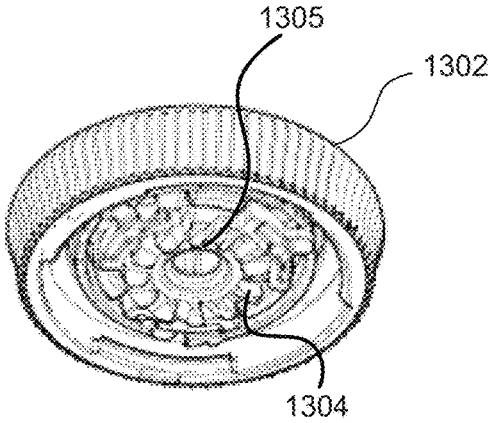
Figure 16A:
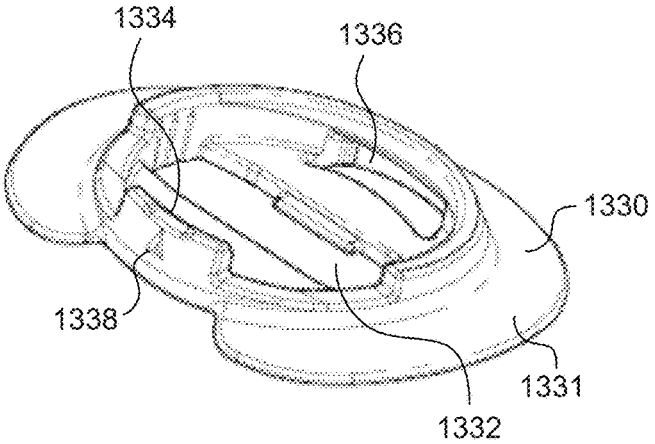
Figure 16B:
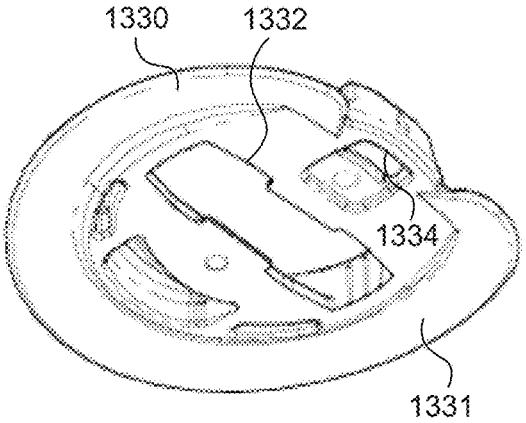
Figure 17A:
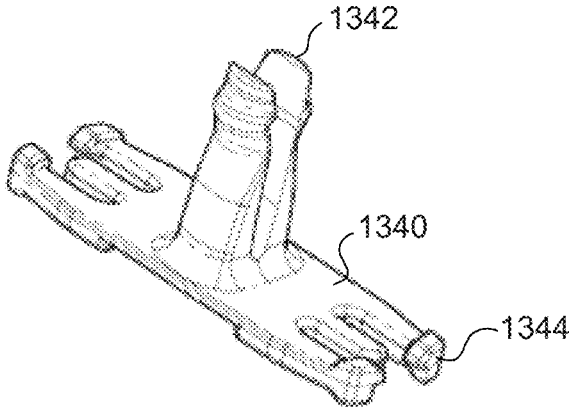
Figure 17B:
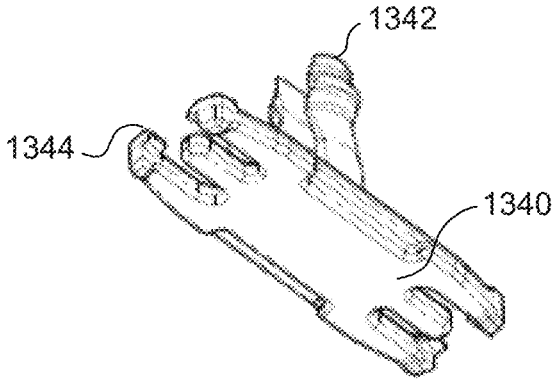

As shown in FIG. 15B, the knob includes axially extending teeth 1304 that are configured to engage with corresponding axially extending teeth 1313 of the spool 1310. When the knob 1302 is positioned in the axially lowered position, the axially extending teeth 1304 of the knob 1302 matingly engage with the corresponding axially extending teeth 1313 of the spool 1310. Engagement of the corresponding teeth of the knob 1302 and spool 1310 causes the spool 1310 to be rotated in a first direction as the knob 1302 is grasped and rotated in the first direction by a user. Rotation of the spool 1310 in the first direction results in a lace (not shown) being wound around an annular channel 1312 or central post of the spool 1310, which results in tensioning of the lace.

Figure 18A:
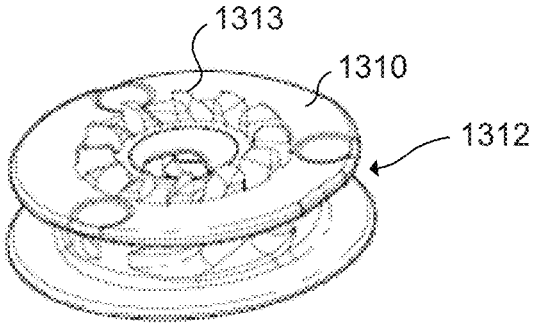
Figure 18B:
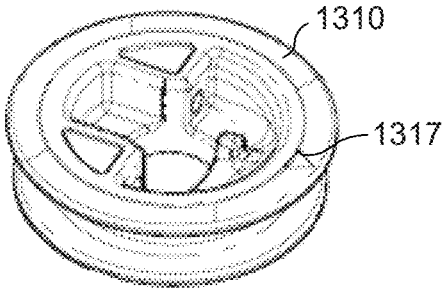

When the knob is positioned in the axially raised position, the axially extending teeth 1304 of the knob 1302 disengage with the corresponding axially extending teeth 1313 of the spool 1310, which allows the spool 1310 to rotate in a second direction opposite the first direction. Rotation of the spool 1310 in the second direction results in the lace being unwound from the annular channel 1312 of the spool, which results in the loosening or releasing of the tension in the lace. In the above manner, a user may tension the lace upon rotation of the knob 1302 in the first direction with the knob 1302 positioned in the axially lowered position, and may release tension on the lace by pulling axially upward on the knob 1302 to disengage the teeth of the knob 1302 and spool 1310. As shown in FIG. 18B, the spool 1310 also includes alignment indicia 1317, which aids in alignment of the spool 1310 and housing for attachment or coupling of the lace with the spool.

Referring again to FIGS. 16A and 16B, the bayonet 1330 includes a recessed portion 1336 within which a lateral flange 1326 of the housing 1320 is positioned. The lateral flange 1326 may include a recessed portion or groove 1329 as described below. The bayonet 1330 also includes an axially extending tab 1334 that is configured to releasably couple with a radial protrusion 1321 of the housing 1320. Specifically, with the lateral flange 1326 positioned within the recessed portion 1336 of the bayonet 1330, the housing 1320 may be rotated downward relative to the bayonet 1330 so that the radial protrusion 1321 contacts or engages with the tab 1334 of the bayonet 1330. A front surface of the radial protrusion 1321 may be angled or tapered so that contact or engagement between the radial protrusion 1321 and tab 1334 causes the tab 1334 to deflect slightly radially outward as the housing 1320 is pressed or rotated into engagement with the bayonet 1330. The tab 1334 may deflect radially outward until an engagement lip (not shown) of the tab is positioned axially above a top surface of the radial protrusion 1321. The tab 1334 may then return to an un-deflected position with the engagement lip positioned above the radial protrusion, which locks the housing 1320 in place about the bayonet 1330.

The housing 1320 may be uncoupled from the bayonet in an opposite manner. Specifically, the tab 1334 of the bayonet may be deflected radially outward, using a flathead screwdriver or other tool, and the housing 1320 may be pulled axially upward and out of engagement with the bayonet 1330. Removal of the housing 1320 causes the spool 1310 and knob 1302 to likewise be uncoupled or detached from the bayonet 1330. Accordingly, the bayonet 1330 enables the housing 1320 and other closure system components to be releasably coupled with the article. The bayonet may include indicia 1338 that identifies the release tab 1334 to a user.

The housing 1320 includes lace entrance ports 1322 (also described herein as first and third apertures) within which the lace is inserted to access the spool 1310. Positioned roughly opposite the lace entrance ports 1322 is an exit port (also described herein as a second aperture) that functions to enable easy attachment of the lace with the spool as describe herein. A bottom surface of the housing 1320 includes indicia 1327, such as an arrow, that may be aligned with the indicia 1317 of the spool 1310 to indicate a proper alignment between the spool 1310 and housing 1320 for attachment of the lace. Stated differently, a user may align the indicia 1317 (e.g., arrow) of the spool 1310 with the indicia 1327 (e.g., arrow) of the housing 1320 to properly align the spool 1310 within the housing 1320 for attachment of the lace.

Figure 19:
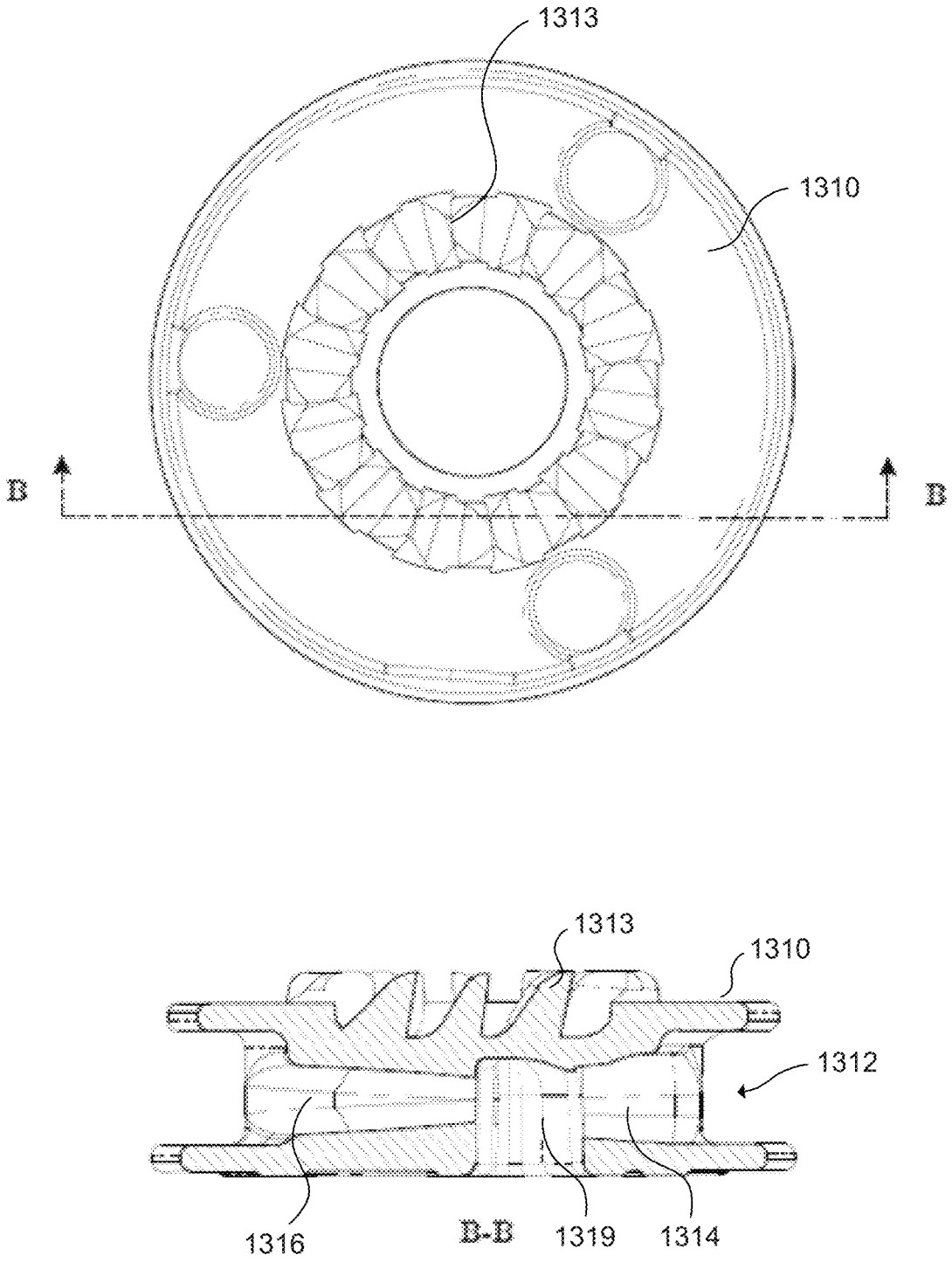
FIG. 19 illustrates a top view and cross section view of the spool of the reel assembly of FIG. 13.
Figure 20A:
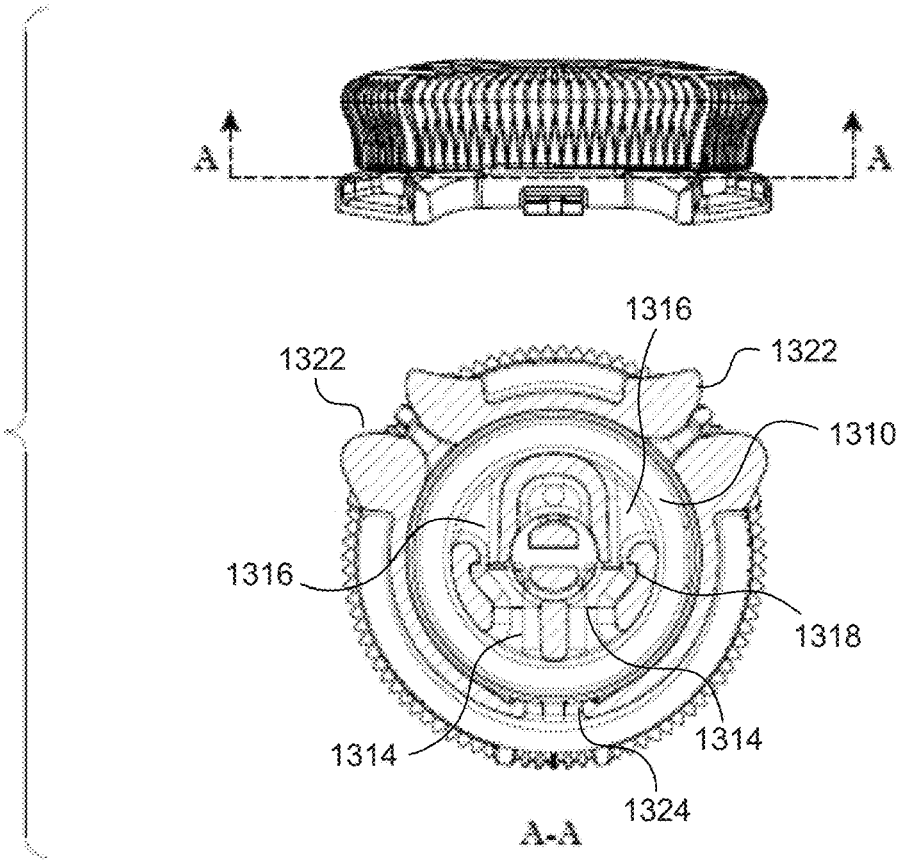
FIGS. 20A-B illustrate a cross section view of the assembled housing component and spool component of the reel assembly of FIG. 13.
Figure 20B:
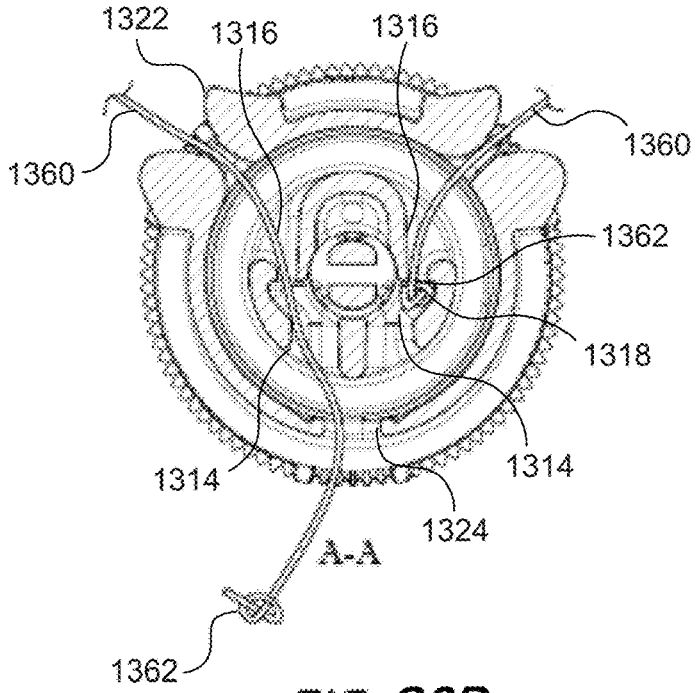

Referring now to FIG. 19, illustrated is a cross section view of the spool 1310 taken along line B-B. The cross sectional view of the spool 1310 illustrates that the spool 1310 includes a first lumen or channel 1316 and a second lumen or channel 1314. The first and second channels, 1316 and 1314, are connected at a midsection 1319 so that a single lumen or channel extends entirely through the spool 1310. The midsection 1319 may be an aperture or channel that connects the first and second channels, 1316 and 1314. In some embodiments, the first and/or second channels, 1316 and 1314, may be tapered so that a diameter of the respective channels decreases as the channels extend inward into the body of the spool 1310. The first and second channels, 1316 and 1314, are radially offset from the central axis of the spool 1310 so that the channels are alignable with the entrance and exits ports, 1322 and 1324, of the housing 1320 as shown in FIGS. 20A and 20B. The first and second channels, 1316 and 1314, may also be angled to some degree relative to the spool 1310, and/or to one another, to further align the channels with the housing's entrance and exit ports, 1322 and 1324.

Although FIG. 19 illustrates only one side of the spool 1310, in many embodiments the opposite side of the spool 1310 includes similar lumens or channels. The lumen or channel configurations on the opposite sides of the spool 1310 enable multiple laces to be quickly and conveniently attached to the spool 1310 as shown in FIG. 20B.

Referring now to FIGS. 20A and 20B, illustrated is a cross section view of the housing 1320 and spool 1310 taken along reference lines A-A. FIG. 20A illustrates the spool 1310 being aligned with the housing 1320 (e.g., via alignment of indicia 1317 and 1327). FIG. 20A also illustrates the spool 1310 having first and second channels, 1316 and 114, positioned on opposite sides of the spool 1310. As illustrated in FIG. 20A, an axis of the entrance ports 1322 is angled from, misaligned, or otherwise not parallel with an axis of the exit port 1324.

In the aligned state, the first channel 1316 of the spool 1310 aligns with the entrance port 1322 of the housing 1320 while the spool's second channel 1314 aligns with the housing's exit port 1324. FIG. 20A illustrates that the first and second channels, 1316 and 1314, are angled slightly relative to the spool 1310, and radially offset from the center of the spool, to better align the channels with the housing's entrance and exit ports, 1322 and 1324.

As illustrated in FIG. 20B, alignment of the spool's first and second channels, 1316 and 1314, with the housing's entrance and exit ports, 1322 and 1324, allows a lace 1360 to be inserted within the housing's entrance port 1322, pushed fully through the spool's first and second channels (1316 and 1314), and exit the housing 1320 via the exit port 1324. The spool's first and second channels (1316 and 1314) are configured to guide or direct the distal end of the lace 1360 fully through the spool and out the exit port 1324 as the lace is inserted through the housing 1320 and spool 1310. A knot 1362 may then be tied in the distal end of the lace 1360, or a crimp component (not shown) coupled with the distal end of the lace 1360. The lace 1360 may then be pulled back through the second channel 1314 of the spool 1310 and into engagement with an engagement portion 1318 of the spool's midsection 1319. The engagement portion 1318 may be a notch, pocket, recess, or cut out portion of the spool's midsection 1319. The engagement portion 1318 may have an opening smaller than the knot 1362 to prevent the knot 1362 from being pulled through the spool's midsection 1319. In other embodiments, the tapered configuration of the second channel 1314 may be configured so as to engage with the knot 1362 and prevent the knot 1362 from being pulled entirely through the second channel 1314. In yet other embodiments, the knot 1362 may engage with a combination of the engagement portion 1318 and the tapered second channel 1314.

Engagement of the knot 1362 with the engagement portion 1318 and/or second channel 1314 attaches the lace 1360 to the spool 1310, which couples the lace 1360 with the knob 1302 via operational engagement between the knob 1302 and spool 1310. As such, operation of the knob 1302 effects tensioning of the lace 1360 via winding of the lace around the spool's annular channel 1312. To replace the lace 1360, a user may easily decouple the housing 1320 from the bayonet 1330 as described above, align the spool 1310 with the housing 1320, insert the lace 1360 through the housing 1320 and spool 1310, tie a knot 1362 in the lace 1360, and pull the lace into engagement with the engagement portion 1318 and/or second channel 1314. The housing 1320 may then be reattached or coupled with the bayonet 1330. The above described lace attachment process does not involve a significant disassembly of the closure system's components. Rather, a user merely needs to remove the housing 1320 from the bayonet 1330 in order to reattach or replace the lace 1360. As such, far less time and energy is required to replace or reattach the lace in comparison to conventional systems.

Figure 21A:
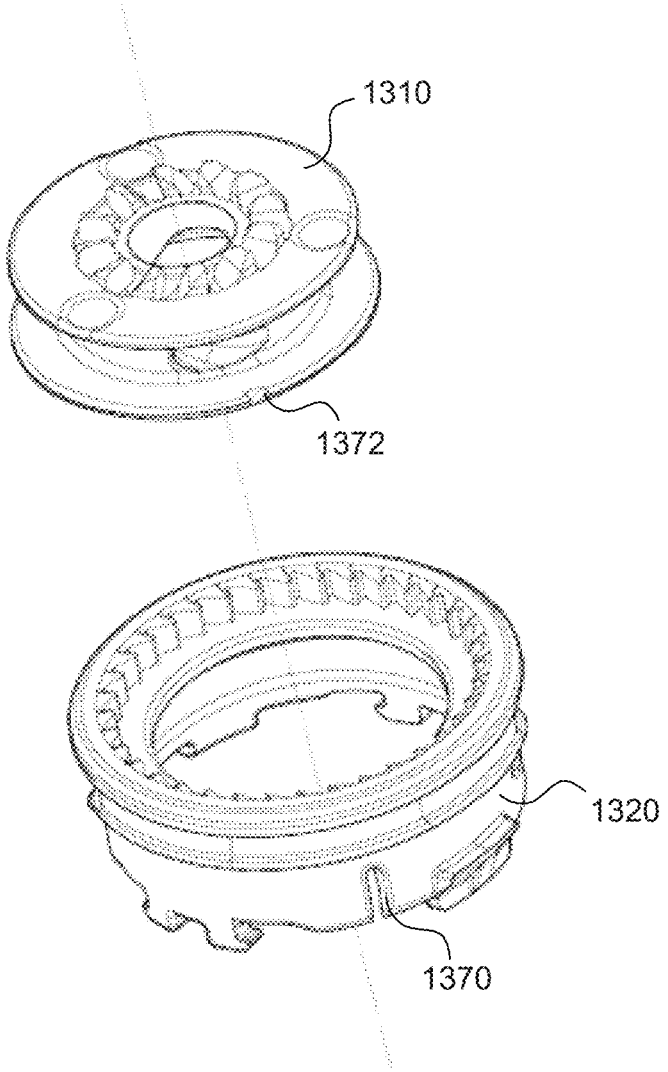
FIGS. 21A-B illustrate an embodiment of a spool component and housing component that include indicia that enable alignment of the spool and housing for easy attachment of the lace.
Figure 21B:
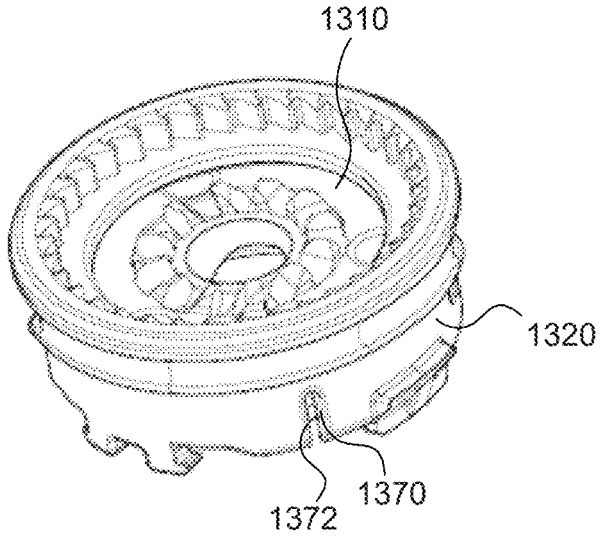

Detachment of the housing 1320 from the bayonet 1330 may only be necessary to ensure a proper alignment of the spool 1310 with housing 1320 since the indicia of the spool and housing are located on the bottom surfaces of the respective components. As illustrated in FIGS. 21A and 21B, in other embodiments the spool 1310 and housing 1320 may include indicia on other surfaces so that alignment of the spool 1310 and housing 1320 may be apparent or visible without detachment of the housing 1320 from the bayonet 1330. For example, as illustrated in FIG. 21A, the spool 1310 may include indicia 1372 positioned on a bottom flange (or elsewhere) and the housing 1320 may include a window 1370 that allows a portion of the spool 1310 to be visible from outside the housing 1320. The window 1370 may include a transparent material or a cut out or removed portion of the housing 1320. As illustrated in FIG. 21B, a user may rotate the spool 1310 within the housing 1320 until the indicia 1372 (e.g., a color coded band or portion and the like) is visible through the window 1370 of the housing 1320. Visibility of the indicia 1372 through the window 1370 indicates a proper alignment of the spool 1310 and housing 1320 for attachment of the lace 1360 as described above.

In this embodiment, the housing 1320 does not need to be decoupled or detached from the bayonet 1330 to ensure that the spool 1310 is properly aligned with the housing 1320. Because the housing 1320 and bayonet 1330 may remain coupled together, minor issues with attaching the lace may be prevented. For example, in some instances in which the housing 1320 is removed from the bayonet 1330, it may be possible to cross the ends of the lace 1360 so that each lace end is inserted within the wrong entrance port 1322 of the housing 1320, which results in the lace 1360 being criss-crossed upon reattachment of the housing 1320 with the bayonet 1330. This potential problem is eliminated if the housing 1320 remains coupled to the bayonet 1330 since it is visibly evident how the lace 1360 and housing 1320 will be arranged prior to insertion of the lace 1360 within the housing's entrance ports 1322.

Figure 22:
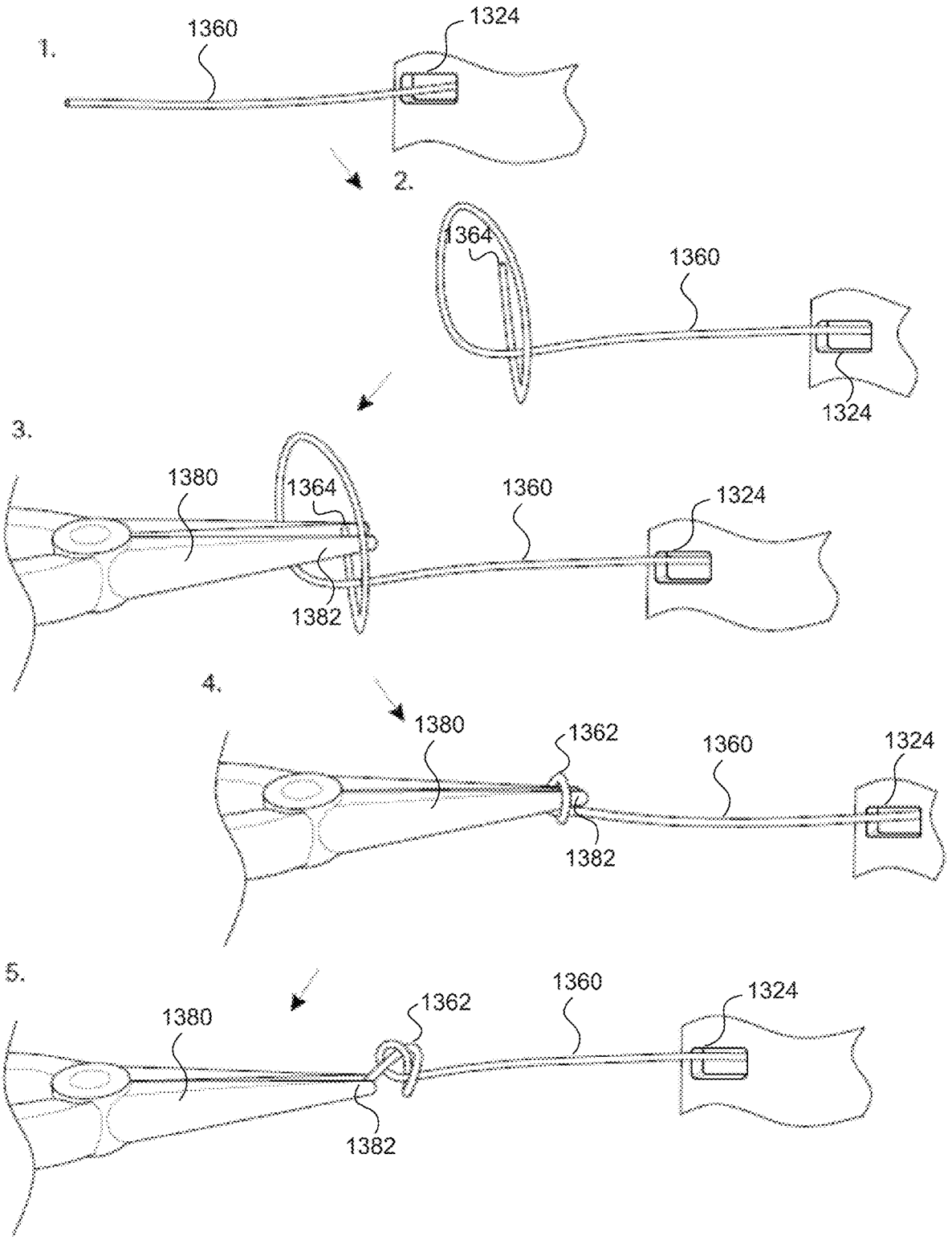
FIG. 22 illustrates a method of tying a knot in a distal end of a lace.

Referring now to FIG. 22, illustrated is a method of tying a knot 1362 in the distal end of the lace 1360. In step 1, the lace 1360 is pulled from the exit portion 1324 of the housing 1320. In step 2, a distal tip 1364 of the lace 1360 is wrapped around the distal end portion of the lace 1360 to form a loop in the distal end of the lace 1360. In step 3, the distal tip 1364 is gripped with the end 1382 of pliers 1380 (e.g., needle nose pliers). The distal tip 1364 may be gripped with the end 1382 of the pliers 1380 so that the distal tip 1364 is flush with a side of the pliers 1380 or is disposed between the opposing sides of the pliers 1380. In step 4, the lace 1360 is retracted or pulled so that the loop formed in the distal end of the lace 1360 slides toward, and eventually off, the end 1382 of the pliers 1380. As the loop slides off the end 1382 of the pliers 1380, a knot 1362 is formed in the lace 1360. Additionally, since the lace's distal end 1364 is gripped in the end 1382 of the pliers 1380, the formed knot 1364 is substantially close to the lace's distal end 1364. A tapered end of the pliers 1380 may aid in sliding the loop off the plier's end 1382. In some embodiments, the taper of the plier's end 1380 may be rather pronounced so that the loop easily and quickly slides of the plier's end 1382 as the lace 1360 is retracted or pulled. In step 5, the lace is pulled entirely off the end 1382 of the pliers 1380 and the formed knot 1362 is sufficiently tightened.

A knot 1362 formed using the process of FIG. 22 ensures that the lace's distal end 1364 will be sufficiently close or adjacent to the knot 1362 to prevent any potential issues when the lace 1360 is attached to the spool 1310. For example, if the lace's distal end 1364 extends too far from the knot 1362, the distal end 1364 will protrude or extend out of the second channel 1314 and into the spool's annular channel 1312 when the lace 1360 is attached to the spool 1310. In such instances, the lace's distal end 1364 may interfere with winding of the lace 1360 about the spool 1310. The knot forming process of FIG. 22 ensures that the distal end 1364 of the lace 1360 is positioned and remains within the second channel 1314 of the spool 1310, thereby eliminating any potential problems that may otherwise exist.

Figure 23:
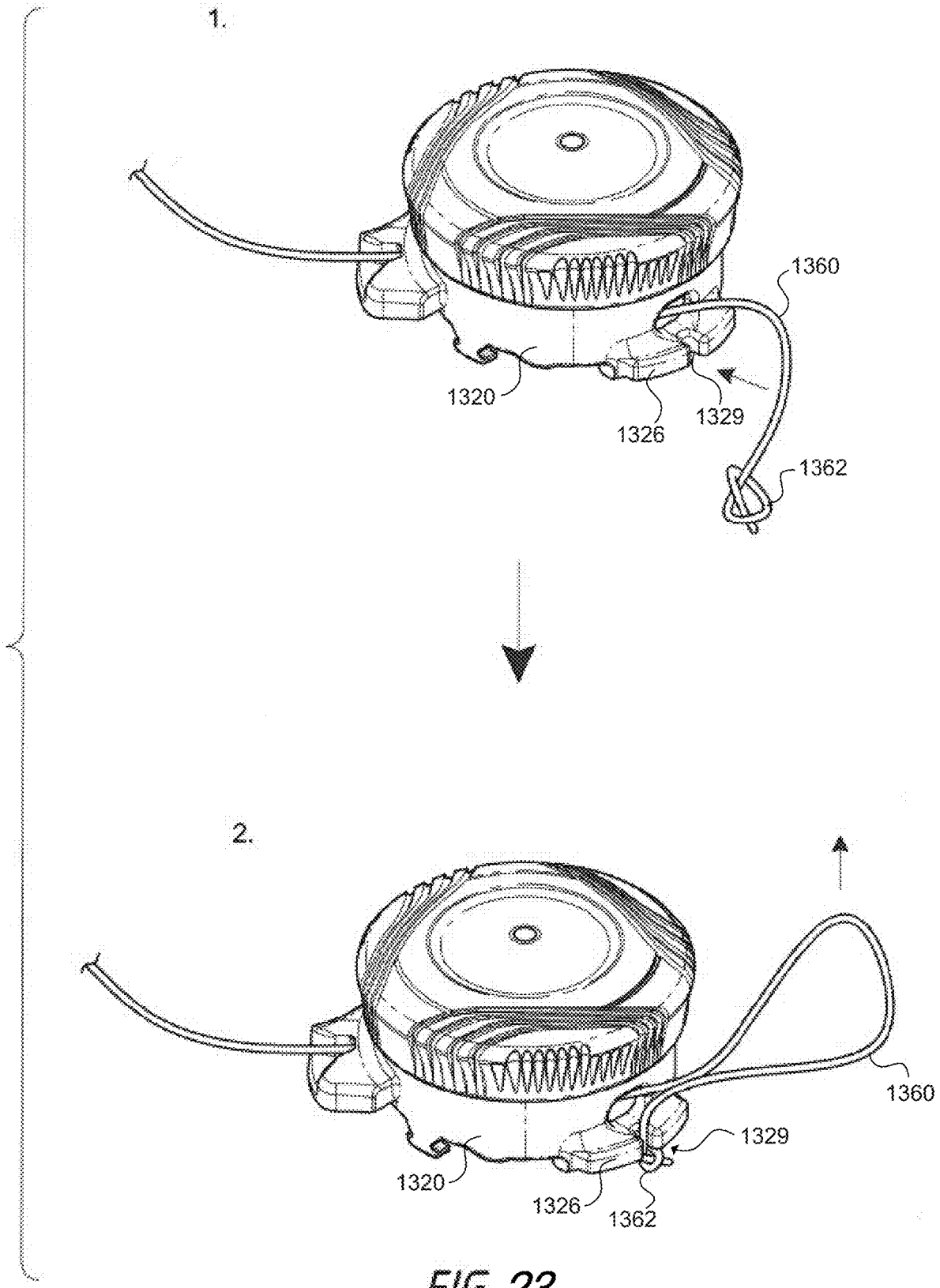
FIG. 23 illustrates the housing component including a knot cinching feature that aids in cinching or tying a knot in a distal end of a lace.

FIG. 23 illustrates another embodiment of forming a knot 1362 in the end of the lace 1360. In forming the knot 1362, the groove or recessed portion 1329 of the flange 1326 is used to cinch or tightly secure the knot 1362. Specifically, a knot 1362 is initially formed in the distal end of the lace 1360. The knot 1362 is then positioned in the groove 1329 and on one side of the flange 1326. The lace 1360 is pulled in an opposite direction so that the groove 1329 and side of the flange 1326 press against the knot 1362 causing the knot 1362 to contract and tightly cinch together. The distal tip of the knot may then trimmed off as desired. The knot 1362 may be initially formed using the process illustrated in FIG. 22 and/or by some other means, such as via a user's hand. The knot cinching process of FIG. 23 ensures that the formed knot 1362 is sufficiently tight so as to prevent further cinching and/or possibly unraveling of the knot 1362 within the second channel 1314.

In accordance with the above disclosure, in some embodiments a method of coupling a lace with a spool component of a reel assembly may include obtaining or providing a housing component having an interior region, a first aperture, and a second aperture, and a spool component having a central cylindrical member and a lumen that extends through the central cylindrical portion. The method may also include positioning the spool component within the interior region of the housing component so that the spool component is rotatable within the interior region. The method may further include rotating the spool component within the interior region of the housing component to align one end of the central cylindrical member's lumen with the first aperture (e.g., entrance port of the housing component) and to align an opposite end of the central cylindrical member's lumen with the second aperture (e.g., exit port of the housing component). The method may additionally include inserting a distal end of the lace through the first aperture, through the lumen, and through the second aperture so that the distal end and a proximal end of the lace are positioned exterior to the housing component.

The method may additionally include tying a knot in the distal end of the lace and retracting the distal end of the lace through the second aperture of the housing component so that the knot in the distal end of the lace engages with the central cylindrical member's lumen to prevent the distal end of the lace from being retraced through the first aperture of the housing component and thereby uncoupling the lace from housing component and spool. In some embodiments, the lumen of the central cylindrical member may include a tapered region that engages with the knot in the distal end of the lace. In such embodiments, a narrow portion of the tapered region may include an engagement portion, such as a notch or pocket, within which the knot is positioned when the knot engages with the central cylindrical member's lumen to prevent the distal end of the lace from being retraced through the first aperture. In some embodiments, an axis of the first aperture is non-parallel to an axis of the second aperture, or is otherwise angled relative to an axis of the second aperture. In some embodiments, the housing component includes a knot securement member within which the knot is positionable so that tensioning of the lace causes the knot to cinch down on itself.

While several embodiments and arrangements of various components are described herein, it should be understood that the various components and/or combination of components described in the various embodiments may be modified, rearranged, changed, adjusted, and the like. For example, the arrangement of components in any of the described embodiments may be adjusted or rearranged and/or the various described components may be employed in any of the embodiments in which they are not currently described or employed. As such, it should be realized that the various embodiments are not limited to the specific arrangement and/or component structures described herein.

In addition, it is to be understood that any workable combination of the features and elements disclosed herein is also considered to be disclosed. Additionally, any time a feature is not discussed with regard in an embodiment in this disclosure, a person of skill in the art is hereby put on notice that some embodiments of the invention may implicitly and specifically exclude such features, thereby providing support for negative claim limitations.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed:

1. A reel based closure device comprising:

a base member having an inner cavity and an outer peripheral wall that surrounds the inner cavity;

a housing that is releasably mounted within the inner cavity of the base member;

a spool rotatably positioned within an interior of the housing, the spool being rotatable in a first direction to wind a tension member about the spool and being rotatable in a second direction to unwind the tension member from about the spool; and a knob or dial that is rotatably coupled with the housing and that is operationally coupled with the spool to cause the spool to rotate in the first direction; wherein:

the base member includes a recessed portion and a tab;

the housing includes a flange that is positionable within the recessed portion of the base member and a radial protrusion that is releasably coupleable with the tab of the base member to releasably mount the housing within the inner cavity of the base member;

the housing includes lace ports that extend radially outward from a cylindrical body of the housing; and the base member includes channels in the outer peripheral wall within which the lace ports of the housing are positioned.

2. The closure device of claim 1, wherein the channels of the base member are positioned on opposing sides of the tab.

3. The closure device of claim 1, wherein the radial protrusion is positioned between the lace ports.

4. The closure device of claim 1, wherein the tab is configured to deflect radially outward as the radial protrusion is coupled with the tab.

5. The closure device of claim 4, wherein a front surface of the radial protrusion is angled or tapered to facilitate coupling of the radial protrusion with the tab.

6. The closure device of claim 4, wherein the flange is positioned within the recessed portion and the housing is moved downward relative to the base member to couple the radial protrusion with the tab.

7. The closure device of claim 1, wherein the tab includes an engagement lip that is positioned axially above a top surface of the radial protrusion when the radial protrusion is coupled with the tab.

8. The closure device of claim 1, the base member includes a coupling flange that extends at least partially around the base member, the coupling flange enabling coupling of the base member to an article.

9. A reel based closure device comprising:

a base member having an inner cavity and an outer peripheral wall that surrounds the inner cavity, the base member being attachable to an article;

a housing;

a spool rotatably positioned within an interior of the housing; and a knob or dial that is rotatably coupled with the housing and that is operationally coupled with the spool; wherein:

a bottom end of the housing is releasably mountable within the inner cavity of the base member to releasably coupleable the housing with the article;

the housing includes lace ports that extend radially outward from a cylindrical body of the housing; and the base member includes channels in the outer peripheral wall within which the lace ports of the housing are positioned when the bottom end of the housing is mounted within the inner cavity of the base member.

10. The closure device of claim 9, wherein the base member includes a recessed portion and a tab, and wherein the housing includes a flange that is positionable within the recessed portion of the base member and a radial protrusion that is releasably coupleable with the tab of the base member to releasably mount the bottom end of the housing within the inner cavity of the base member.

11. The closure device of claim 10, wherein the channels are positioned on opposing sides of the tab.

12. The closure device of claim 10, wherein the radial protrusion is positioned between the lace ports.

13. The closure device of claim 10, wherein the tab includes an engagement lip that is positioned axially above a top surface of the radial protrusion when the radial protrusion is coupled with the tab.

14. The closure device of claim 10, wherein the tab is configured to deflect radially outward as the radial protrusion is coupled with the tab.

15. The closure device of claim 14, wherein a front surface of the radial protrusion is angled or tapered to facilitate coupling of the radial protrusion with the tab.

16. The closure device of claim 9, wherein the base member includes a coupling flange that extends at least partially around the base member, the coupling flange enabling attachment of the base member to the article.

17. A method of releasably coupling a reel based closure device with an article of footwear, the method comprising:

providing a reel based closure system comprising:

a base member having an inner cavity and an outer peripheral wall that surrounds the inner cavity;

a housing;

a spool rotatably positioned within an interior of the housing; and a knob or dial that is rotatably coupled with the housing and that is operationally coupled with the spool;

attaching the base member to an article; and mounting a bottom end of the housing within the inner cavity of the base member so that the housing is releasably coupled with the base member;

wherein the housing includes lace ports that extend radially outward from a cylindrical body of the housing; and wherein the base member includes channels in the outer peripheral wall within which the lace ports of the housing are positioned.

18. The method of claim 17, wherein mounting the bottom end of the housing within the inner cavity of the base member comprising positioning a flange of the housing within a recessed portion of the base member and rotating the housing downward relative to the base member to couple a radial protrusion of the housing with a tab of the base member.

19. The method of claim 18, the channels are positioned on opposing sides of the tab.

20. The method of claim 18, wherein the radial protrusion is positioned between the lace ports.

* * * * *